US008919139B2

(12) United States Patent
Yamada et al.

(10) Patent No.: US 8,919,139 B2
(45) Date of Patent: Dec. 30, 2014

(54) AIR CONDITIONING APPARATUS

(75) Inventors: Takurou Yamada, Sakai (JP); Masato Kotake, Sakai (JP); Takahiro Yamaguchi, Sakai (JP); Tadafumi Nishimura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1096 days.

(21) Appl. No.: 12/919,045

(22) PCT Filed: Feb. 25, 2009

(86) PCT No.: PCT/JP2009/053314

§ 371 (c)(1),
(2), (4) Date: Aug. 24, 2010

(87) PCT Pub. No.: WO2009/107615

PCT Pub. Date: Sep. 3, 2009

(65) Prior Publication Data

US 2011/0000240 A1 Jan. 6, 2011

(30) Foreign Application Priority Data

Feb. 29, 2008 (JP) ..... 2008-050687
Oct. 23, 2008 (JP) ..... 2008-272630

(51) Int. Cl.
*G01K 13/00* (2006.01)
*F25B 49/00* (2006.01)
*F25B 13/00* (2006.01)

(52) U.S. Cl.
CPC ..... *F25B 49/005* (2013.01); *F25B 13/00* (2013.01); *F25B 2700/04* (2013.01)
USPC ..... 62/129; 62/126; 62/158; 62/160; 62/174; 62/180; 62/181; 62/206; 62/208; 62/212; 62/216; 62/222; 62/225; 62/226; 62/228.5; 62/324.1; 62/503; 62/509

(58) Field of Classification Search
CPC ..... F25B 13/00; F25B 19/00; F25B 30/02; F25B 41/043; F25B 2313/005; F25B 2313/02742; F25B 2313/0294; F25B 2313/0311; F25B 2313/0313; F25B 2313/0314; F25B 2313/0315; F25B 2500/222; F25B 2500/28; F25B 2600/0253; F25B 2600/05; F25B 2600/111; F25B 2600/2513; F25B 2600/2519; F25B 2700/191; F25B 2700/1933; F25B 2700/2103; F25B 2700/21
USPC ..... 62/126, 129, 158, 160, 174, 180, 181, 62/206, 208, 212, 216, 222, 225, 226, 62/228.5, 324.1, 503, 509
See application file for complete search history.

(56) References Cited

U.S. PATENT DOCUMENTS

| | | | | |
|---|---|---|---|---|
| 8,109,105 | B2 * | 2/2012 | Unezaki et al. | 62/149 |
| 2008/0209926 | A1 | 9/2008 | Matsuoka et al. | |
| 2009/0126375 | A1 | 5/2009 | Toyoshima et al. | |

FOREIGN PATENT DOCUMENTS

EP 1 876 403 A1 1/2008

(Continued)

OTHER PUBLICATIONS

International Preliminary Report of corresponding PCT Application No. PCT/JP2009/053314.

(Continued)

*Primary Examiner* — Frantz Jules
*Assistant Examiner* — Azim Abdur Rahim
(74) *Attorney, Agent, or Firm* — Global IP Counselors

(57) ABSTRACT

An air conditioning apparatus includes a refrigerant circuit, an operation controlling device and a liquid refrigerant accumulation determining device. The refrigerant circuit has an accumulator. The operation controlling device performs normal operation control where each device of the heat source unit and the utilization unit are controlled in accordance with operating load of the utilization unit, and refrigerant quantity determination operation control where properness of quantity of the refrigerant in the refrigerant circuit is determined while performing the cooling operation. The liquid refrigerant accumulation determining device determines whether or not liquid refrigerant is accumulating in the accumulator. When it has been determined that liquid refrigerant is accumulating in the accumulator, liquid refrigerant accumulation control is performed to eliminate liquid refrigerant accumulation in the accumulator.

17 Claims, 20 Drawing Sheets

(56) References Cited

FOREIGN PATENT DOCUMENTS

| | | | |
|---|---|---|---|
| JP | 2006-23072 | A | 1/2006 |
| WO | WO-2005/121664 | A1 | 12/2005 |
| WO | WO-2007/049372 | A1 | 5/2007 |

OTHER PUBLICATIONS

International Search Report of corresponding PCT Application No. PCT/JP2009/053314.

European Search Report of corresponding EP Application No. 09 71 5295.3 dated Oct. 6, 2014.

* cited by examiner

AIR CONDITIONING APPARATUS

CROSS-REFERENCE TO RELATED APPLICATIONS

This U.S. National stage application claims priority under 35 U.S.C. §119(a) to Japanese Patent Application Nos. 2008-050687, filed in Japan on Feb. 29, 2008, 2008-272630, filed in Japan on Oct. 23, 2008, the entire contents of which are hereby incorporated herein by reference.

TECHNICAL FIELD

The present invention relates to an air conditioning apparatus and a refrigerant quantity determination operation that perform determination of the properness of the quantity of refrigerant accurately in an air conditioning apparatus and a refrigerant quantity determination operation that determine the properness of the quantity of refrigerant inside a refrigerant circuit.

BACKGROUND ART

Generally, there is known an air conditioning apparatus configured as a result of a heat source unit having a compressor and a heat source-side heat exchanger and a utilization unit having a utilization-side expansion valve and a utilization-side heat exchanger being interconnected via a liquid refrigerant connection pipe and a gas refrigerant connection pipe. Additionally, in determination of the properness of the quantity of refrigerant inside a refrigerant circuit of this air conditioning apparatus, the determination is performed by performing operation of the air conditioning apparatus under a predetermined condition and detecting the degree of supercooling of refrigerant in an outlet side of the heat source-side heat exchanger. As this operation under a predetermined condition, there is, for example, operation where the degree of superheating of the refrigerant in the outlet of the utilization-side heat exchanger functioning as an evaporator of the refrigerant is controlled such that it becomes a positive value and where the pressure of the refrigerant on a low pressure side of the refrigerant circuit resulting from the compressor is controlled such that it becomes constant (see Japanese Patent Publication No. 2006-023072).

SUMMARY

Technical Problem

However, when the refrigerant quantity determination method described above is applied, when liquid refrigerant is accumulating on the low pressure side (particularly in an accumulator) of the refrigerant circuit, the liquid refrigerant is moved to the heat source-side heat exchanger by causing the accumulating liquid refrigerant to evaporate, so this ends up needing a lot of time. Further, when determination of the properness of the quantity of the refrigerant is performed on the high pressure side while the liquid refrigerant has accumulated on the low pressure side, there is the fear that error will arise in correspondence to the quantity of the refrigerant that has accumulated on the low pressure side.

It is a problem of the present invention to provide an air conditioning apparatus which, when performing refrigerant quantity determination, is capable of verifying that liquid refrigerant is not accumulating in an accumulator and performing determination of a proper quantity of refrigerant without taking too much time.

Solution to the Problem

An air conditioning apparatus pertaining to a first aspect of the invention comprises a refrigerant circuit, an operation controlling device or means, and a liquid refrigerant accumulation determining device or means. The refrigerant circuit includes a heat source unit, a utilization unit, an expansion mechanism, and a liquid refrigerant connection pipe and a gas refrigerant connection pipe. The heat source unit has a compressor, a heat source-side heat exchanger, and an accumulator. The utilization unit has a utilization-side heat exchanger. The liquid refrigerant connection pipe and the gas refrigerant connection pipe interconnect the heat source unit and the utilization unit. Further, the refrigerant circuit is capable of performing at least cooling operation where the heat source-side heat exchanger is caused to function as a condenser of refrigerant compressed in the compressor and where the utilization-side heat exchanger is caused to function as an evaporator of refrigerant condensed in the heat source-side heat exchanger. Additionally, the operation controlling means performs normal operation control and refrigerant quantity determination operation control. The normal operation control is control where the operation controlling means performs control of each device of the heat source unit and the utilization unit in accordance with the operating load of the utilization unit. Further, the refrigerant quantity determination operation control is control where the operation controlling means determines the properness of the quantity of the refrigerant in the refrigerant circuit while performing the cooling operation. The liquid refrigerant accumulation determining means determines whether or not the liquid refrigerant is accumulating in the accumulator. The operation controlling means further performs liquid refrigerant accumulation elimination control where, when the liquid refrigerant accumulation determining means has determined that the liquid refrigerant is accumulating in the accumulator, the operation controlling means eliminates the liquid refrigerant accumulation in the accumulator.

In the air conditioning apparatus of this aspect, when there is so-called liquid refrigerant accumulation where the liquid refrigerant is accumulating in the accumulator in the refrigerant quantity determination operation control, the operation controlling means performs the liquid refrigerant accumulation elimination control where the operation controlling means eliminates the liquid refrigerant accumulation. Consequently, in the air conditioning apparatus of this aspect, the operation controlling means can eliminate liquid refrigerant accumulation in the accumulator and can perform determination of the properness of the quantity of the refrigerant. For this reason, the operation controlling means can perform determination of the proper quantity of the refrigerant in a state where there is not much error even when the liquid refrigerant is accumulating in the accumulator.

An air conditioning apparatus pertaining to a second aspect of the invention is the air conditioning apparatus pertaining to the first aspect of the invention, further comprising a shut-off mechanism, a refrigerant detection mechanism, and a refrigerant quantity determining device or means. The shut-off mechanism is placed on the downstream side of the heat source-side heat exchanger and on the upstream side of the liquid refrigerant connection pipe in the flow direction of the refrigerant in the cooling operation and is capable of shutting off passage of the refrigerant. The refrigerant detection mechanism is placed on the upstream side of the shut-off mechanism in the flow direction of the refrigerant in the cooling operation and performs detection of a state quantity relating to the quantity of the refrigerant existing on the upstream side of the shut-off mechanism. The refrigerant quantity determining means determines the properness of the quantity of the refrigerant inside the refrigerant circuit on the basis of the state quantity relating to the quantity of the refrigerant that the refrigerant detection mechanism has detected in the liquid refrigerant storage control. The expansion mechanism is placed in the utilization unit and is positioned on the near side of the utilization-side heat exchanger in the flow direction of the refrigerant in the cooling operation. The operation controlling means performs liquid temperature constant control where the operation controlling means controls such that the temperature of the refrigerant in a liquid refrigerant pipe portion between the expansion mechanism and the shut-off mechanism including the liquid refrigerant connection pipe in the refrigerant circuit becomes a constant value, thereafter performs liquid pipe closure control where the operation controlling means closes the shut-off mechanism and the expansion mechanism, and thereafter performs, as the refrigerant quantity determination operation control, liquid refrigerant storage control where the operation controlling means accumulates the liquid refrigerant in a portion on the upstream side of the shut-off mechanism.

In the air conditioning apparatus of this aspect, at the time when the refrigerant circuit performs the cooling operation, when the shut-off mechanism disposed on the downstream side of the heat source-side heat exchanger is closed and the flow of the refrigerant is shut off, the liquid refrigerant that has been condensed in the heat source-side heat exchanger functioning as a condenser, for example, accumulates on the upstream side of the shut-off mechanism mainly inside the heat source-side heat exchanger because circulation of the refrigerant has ceased. When the compressor is driven in the cooling operation state, the portion on the downstream side of the shut-off mechanism and on the upstream side of the compressor in the refrigerant circuit—such as, for example, the utilization-side heat exchanger and the gas refrigerant connection pipe—is depressurized, and the refrigerant becomes virtually nonexistent therein. For this reason, the refrigerant in the refrigerant circuit is intensively collected on the upstream side of the shut-off mechanism, and the refrigerant detection mechanism performs detection relating to this intensively collected refrigerant quantity. Additionally, in this air conditioning apparatus, the liquid refrigerant accumulation determining means determines whether or not the liquid refrigerant is accumulating in the accumulator, and when it has been determined that the liquid refrigerant is accumulating in the accumulator, the operation controlling means performs liquid refrigerant accumulation elimination control where the operation controlling means eliminates the liquid refrigerant accumulating in the accumulator.

Consequently, in the air conditioning apparatus of this aspect, the operation controlling means can eliminate liquid refrigerant accumulation in the accumulator and can perform determination of the properness of the quantity of the refrigerant. For this reason, the operation controlling means can perform determination of the proper quantity of the refrigerant in a state where there is not much error even when liquid refrigerant is accumulating in the accumulator.

An air conditioning apparatus pertaining to a third aspect of the invention is the air conditioning apparatus pertaining to the second aspect of the invention, wherein during the liquid temperature constant control, the liquid refrigerant accumulation determining means determines whether or not the liquid refrigerant is accumulating in the accumulator on the basis of an inlet temperature and an outlet temperature. Here, the inlet temperature is a temperature that an inlet temperature sensor disposed in a refrigerant pipe portion on the inlet side of the accumulator detects. Further, here, the outlet temperature is a temperature that an outlet temperature sensor disposed in a refrigerant pipe portion on the outlet side of the accumulator detects.

In the air conditioning apparatus of this aspect, during the liquid temperature constant control, the liquid refrigerant accumulation determining means determines whether or not the liquid refrigerant is accumulating in the accumulator on the basis of the temperature (that is, the inlet temperature) that the inlet temperature sensor disposed in the pipe on the inlet side of the accumulator detects and the temperature (that is, the outlet temperature) that the outlet temperature sensor disposed in the pipe on the outlet side of the accumulator detects.

Consequently, the liquid refrigerant accumulation determining means can determine whether or not the liquid refrigerant is accumulating in the accumulator in the case of a state where the refrigerant is circulating in the refrigerant circuit like in the liquid temperature constant control.

An air conditioning apparatus pertaining to a fourth aspect of the invention is the air conditioning apparatus pertaining to the third aspect of the invention, wherein the liquid refrigerant accumulation determining means determines that the liquid refrigerant is accumulating in the accumulator when the temperature difference between the inlet temperature and the outlet temperature is equal to or greater than a predetermined temperature difference.

When the liquid refrigerant exists inside the accumulator, it becomes easier for a temperature difference to arise between the inlet temperature and the outlet temperature as a result of the liquid refrigerant evaporating. In the air conditioning apparatus of this aspect, during the liquid temperature constant control, the liquid refrigerant accumulation determining means determines that the liquid refrigerant is accumulating in the accumulator when the temperature difference between the inlet temperature and the outlet temperature is equal to or greater than the predetermined temperature difference.

Consequently, the liquid refrigerant accumulation determining means can determine whether or not the liquid refrigerant is accumulating in the accumulator in the case of a state where the refrigerant is circulating in the refrigerant circuit like in the liquid temperature constant control. Further, for example, in the case of a model where there are temperature sensors in the pipes in front and in back of the accumulator, the sensors can be appropriated and production costs can be reduced.

An air conditioning apparatus pertaining to a fifth aspect of the invention is the air conditioning apparatus pertaining to any of the second to fourth aspects of the invention, wherein during the liquid refrigerant storage control, the liquid refrigerant accumulation determining means determines whether or not the liquid refrigerant is accumulating in the accumulator on the basis of a bottom portion temperature that a bottom portion temperature sensor disposed in a bottom portion of the accumulator detects.

When the liquid refrigerant storage control is performed, the pressure inside the pipe on the gas side between an expansion mechanism and the compressor including also the accumulator becomes low and close to a vacuum, so when the liquid refrigerant is accumulating inside the accumulator, the bottom portion temperature becomes low. In this aspect, the liquid refrigerant accumulation determining means determines whether or not the liquid refrigerant is accumulating in the accumulator on the basis of changes in this bottom portion temperature.

Consequently, when the refrigerant is not circulating that much in the refrigerant circuit and the pressure of the pipe portion on the gas side is low like in the liquid refrigerant storage control, the liquid refrigerant accumulation determining means can relatively accurately determine that the liquid refrigerant exists inside the accumulator.

An air conditioning apparatus pertaining to a sixth aspect of the invention is the air conditioning apparatus pertaining to the fifth aspect of the invention, wherein the liquid refrigerant accumulation determining means determines that the liquid refrigerant is accumulating in the accumulator when the bottom portion temperature is equal to or less than a predetermined temperature.

When the liquid refrigerant storage control is performed, the pressure inside the pipe on the gas side between an expansion mechanism and the compressor including also the accumulator becomes low and close to a vacuum, so when the liquid refrigerant is accumulating inside the accumulator, the bottom portion temperature becomes low. In this aspect, the liquid refrigerant accumulation determining means determines that the liquid refrigerant is accumulating in the accumulator when this bottom portion temperature is equal to or less than the predetermined temperature.

Consequently, when the refrigerant is not circulating that much in the refrigerant circuit and the pressure of the pipe portion on the gas side is low like in the liquid refrigerant storage control, the liquid refrigerant accumulation determining means can relatively accurately determine that the liquid refrigerant exists inside the accumulator.

An air conditioning apparatus pertaining to a seventh aspect of the invention is the air conditioning apparatus pertaining to any of the second to sixth aspects of the invention, further comprising a liquid refrigerant releasing device or means. The liquid refrigerant releasing means has a bypass pipe and a bypass opening-and-closing mechanism. The bypass pipe interconnects the bottom portion of the accumulator and a pipe on the suction side of the compressor. The bypass opening-and-closing mechanism is capable of opening and closing the flow path of the refrigerant inside the bypass pipe.

In the air conditioning apparatus of this aspect, the bypass pipe for releasing the liquid refrigerant from the bottom portion of the accumulator to the suction side of the compressor is disposed, and the bypass opening-and-closing mechanism that can open and close the flow path of the bypass pipe is disposed.

Consequently, for example, when it has been determined that the liquid refrigerant is accumulating in the accumulator, the liquid refrigerant releasing means can release the liquid refrigerant from the accumulator to the pipe on the suction side of the compressor by opening the bypass opening-and-closing mechanism. Further, for example, in the case of a model where there already exists a pipe equipped with an opening-and-closing mechanism such as an oil return pipe for returning oil from the accumulator to the pipe on the suction side of the compressor, the pipe can be appropriated and production costs can be reduced.

An air conditioning apparatus pertaining to an eighth aspect of the invention is the air conditioning apparatus pertaining to the seventh aspect of the invention, wherein when the liquid refrigerant accumulation determining means has determined that the liquid refrigerant is accumulating in the accumulator, the liquid refrigerant releasing means opens the bypass opening-and-closing mechanism.

Consequently, when it has been determined that the liquid refrigerant is accumulating in the accumulator, the liquid refrigerant releasing means can release the liquid refrigerant from the accumulator to the pipe on the suction side of the compressor by opening the bypass opening-and-closing mechanism.

An air conditioning apparatus pertaining to a ninth aspect of the invention is the air conditioning apparatus pertaining to the seventh or eighth aspect of the invention, wherein during the liquid temperature constant control, when the liquid refrigerant accumulation determining means has determined that the liquid refrigerant is accumulating in the accumulator, the operation controlling means performs, as the liquid refrigerant accumulation elimination control, first cancellation control, liquid refrigerant release control, and first re-liquid temperature constant control. The first cancellation control is control where the operation controlling means decreases the opening degree of the expansion mechanism and cancels the liquid temperature constant control. The liquid refrigerant release control is control where the operation controlling means opens the bypass opening-and-closing mechanism and releases the liquid refrigerant from the accumulator after the first cancellation control. The first re-liquid temperature constant control is control where the operation controlling means increases the opening degree of the utilization-side expansion mechanism and again performs the liquid temperature constant control after the liquid refrigerant release control.

During the liquid temperature constant control, the refrigerant inside the refrigerant circuit is circulating, so there is the potential for liquid refrigerant that could not be evaporated by the utilization-side heat exchanger to flow in. In the air conditioning apparatus of this aspect, when it has been determined that the liquid refrigerant is accumulating in the accumulator, the operation controlling means prevents as much as possible inflow of the liquid refrigerant from the utilization-side heat exchanger into the accumulator by narrowing the utilization-side expansion mechanism in order for the liquid refrigerant releasing means to efficiently release the liquid refrigerant.

Consequently, the liquid refrigerant releasing means can efficiently release the liquid refrigerant accumulating inside the accumulator. For this reason, the operation controlling means can more accurately determine the properness of the quantity of the refrigerant inside the refrigerant circuit without taking time as much as possible.

An air conditioning apparatus pertaining to a tenth aspect of the invention is the air conditioning apparatus pertaining to any of the seventh to ninth aspects of the invention, further comprising a supercooler. The supercooler has at least a supercooling expansion mechanism and a supercooling pipe. The supercooling expansion mechanism depressurizes some of the liquid refrigerant that has been condensed by the heat source-side heat exchanger at the time of the cooling operation. The supercooling expansion mechanism is placed in the supercooling pipe, and the supercooling pipe causes some of the liquid refrigerant to branch from a liquid refrigerant pipe portion between the utilization-side expansion mechanism and the shut-off mechanism including the liquid refrigerant connection pipe and is connected to a gas refrigerant pipe portion between the gas refrigerant connection pipe and the accumulator. During the liquid temperature constant control, when the liquid refrigerant accumulation determining means has determined that the liquid refrigerant is accumulating in the accumulator, the operation controlling means performs, as the liquid refrigerant accumulation elimination control, second cancellation control, liquid refrigerant release control, and second re-liquid temperature constant control. The second cancellation control is control where the operation controlling means decreases the opening degree of the supercooling expansion mechanism and cancels the liquid temperature constant control. The liquid refrigerant release control is control where the operation controlling means opens the bypass opening-and-closing mechanism and releases the liquid refrigerant from the accumulator after the second cancellation control. The second re-liquid temperature constant control is control where the operation controlling means increases the opening degree of the supercooling expansion mechanism and again performs the liquid temperature constant control after the liquid refrigerant release control.

When a supercooler is disposed like in the air conditioning apparatus of this aspect, during the liquid temperature constant control, there is the potential for the liquid refrigerant that could not be evaporated inside the supercooler through the supercooling pipe to flow into the accumulator. In the air conditioning apparatus of this aspect, when it has been determined that the liquid refrigerant is accumulating in the accumulator, the operation controlling means prevents as much as possible inflow of the liquid refrigerant from the utilization-side heat exchanger into the accumulator by narrowing the supercooling expansion mechanism in order for the liquid refrigerant releasing means to efficiently release the liquid refrigerant.

Consequently, the liquid refrigerant releasing means can efficiently release the liquid refrigerant accumulating inside the accumulator. For this reason, the operation controlling means can more accurately determine the properness of the quantity of the refrigerant inside the refrigerant circuit without taking time as much as possible.

An air conditioning apparatus pertaining to an eleventh aspect of the invention is the air conditioning apparatus pertaining to any of the second to sixth aspects of the invention, wherein during the liquid temperature constant control, when the liquid refrigerant accumulation determining means has determined that the liquid refrigerant is accumulating in the accumulator, the operation controlling means performs, as the liquid refrigerant accumulation elimination control, first cancellation control, elimination standby control, and first re-liquid temperature constant control. The first cancellation control is control where the operation controlling means decreases the opening degree of the utilization-side expansion mechanism and cancels the liquid temperature constant control. The elimination standby control is control where the operation controlling means waits for liquid refrigerant accumulation to be eliminated in the accumulator after the first cancellation control. The first re-liquid temperature constant control is control where the operation controlling means increases the opening degree of the utilization-side expansion mechanism and again performs the liquid temperature constant control after the elimination standby control.

During the liquid temperature constant control, the refrigerant inside the refrigerant circuit is circulating, so there is the potential for the liquid refrigerant that could not be evaporated by the utilization-side heat exchanger to flow in. In the air conditioning apparatus of this aspect, when it has been determined that the liquid refrigerant is accumulating in the accumulator, the operation controlling means prevents as much as possible inflow of the liquid refrigerant from the utilization-side heat exchanger into the accumulator by narrowing the utilization-side expansion mechanism in order for the liquid refrigerant releasing means to efficiently release the liquid refrigerant.

Consequently, the operation controlling means can eliminate the liquid refrigerant accumulation in the accumulator and can perform determination of the properness of the quantity of the refrigerant. For this reason, the operation controlling means can perform determination of the proper quantity of the refrigerant in a state where there is not much error even when the liquid refrigerant is accumulating in the accumulator.

An air conditioning apparatus pertaining to a twelfth aspect of the invention is the air conditioning apparatus pertaining to the second, third, fourth, fifth, sixth, or eleventh aspect of the invention, further comprising a supercooler. The supercooler has at least a supercooling expansion mechanism and a supercooling pipe. The supercooling expansion mechanism depressurizes some of the liquid refrigerant that has been condensed by the heat source-side heat exchanger at the time of the cooling operation. The supercooling expansion mechanism is placed in the supercooling pipe, and the supercooling pipe causes some of the liquid refrigerant to branch from a liquid refrigerant pipe portion between the expansion mechanism and the shut-off mechanism including the liquid refrigerant connection pipe and is connected to a gas refrigerant pipe portion between the gas refrigerant connection pipe and the accumulator. During the liquid temperature constant control, when the liquid refrigerant accumulation determining means has determined that the liquid refrigerant is accumulating in the accumulator, the operation controlling means performs, as the liquid refrigerant accumulation elimination control, second cancellation control, elimination standby control, and second re-liquid temperature constant control. The second cancellation control is control where the operation controlling means decreases the opening degree of the supercooling expansion mechanism and cancels the liquid temperature constant control. The elimination standby control is control where the operation controlling means waits for the liquid refrigerant accumulation to be eliminated in the accumulator after the second cancellation control. The second re-liquid temperature constant control is control where the operation controlling means increases the opening degree of the supercooling expansion mechanism and again performs the liquid temperature constant control after the elimination standby control.

When a supercooler is disposed like in the air conditioning apparatus of this aspect, during the liquid temperature constant control, there is the potential for the liquid refrigerant that could not be evaporated inside the supercooler through the supercooling pipe to flow into the accumulator. In the air conditioning apparatus of this aspect, when it has been determined that the liquid refrigerant is accumulating in the accumulator, the operation controlling means prevents as much as possible inflow of the liquid refrigerant from the utilization-side heat exchanger into the accumulator by narrowing the supercooling expansion mechanism in order for the liquid refrigerant releasing means to efficiently release the liquid refrigerant.

Consequently, the operation controlling means can eliminate the liquid refrigerant accumulation in the accumulator and can perform determination of the properness of the quantity of the refrigerant. For this reason, the operation controlling means can perform determination of the proper quantity of the refrigerant in a state where there is not much error even when the liquid refrigerant is accumulating in the accumulator.

An air conditioning apparatus pertaining to a thirteenth aspect of the invention is the air conditioning apparatus pertaining to the second, third, fourth, fifth, sixth, eleventh, or twelfth aspect of the invention, wherein during the refrigerant storage control, when the liquid refrigerant accumulation determining means has determined that the liquid refrigerant is accumulating in the accumulator, the operation controlling means causes, without performing, determination of the properness of the quantity of the refrigerant to stand by until the liquid refrigerant accumulation in the accumulator is eliminated and performs determination of the properness of the quantity of the refrigerant after the liquid refrigerant accumulation in the accumulator has been eliminated.

In the air conditioning apparatus of this aspect, during the liquid refrigerant storage control, when the liquid refrigerant is accumulating in the accumulator, the operation controlling means causes performing determination of the properness of the quantity of the refrigerant to stand by and causes determination of the properness of the quantity of the refrigerant to be performed after it has been verified that the liquid refrigerant is not accumulating in the accumulator.

Consequently, the operation controlling means can suppress as much as possible error in the determination of the properness of the quantity of the refrigerant resulting from the liquid refrigerant accumulating in the accumulator and can perform determination of the proper quantity of the refrigerant.

An air conditioning apparatus pertaining to a fourteenth aspect of the invention is the air conditioning apparatus pertaining to the first aspect of the invention, further comprising a detecting device or means. The detecting means is capable of detecting, as a first detection value, a supercooling degree of the refrigerant in the outlet of the heat source-side heat exchanger or an operation state quantity that fluctuates in accordance with fluctuations in the degree of supercooling. Additionally, in the refrigerant quantity determination operation control, the operation controlling means performs, as refrigerant quantity properness determination, determination of the properness of the quantity of the refrigerant with which the inside of the refrigerant circuit is charged on the basis of the first detection value while controlling the expansion mechanism such that the degree of superheating of the refrigerant in at least one place between the outlet of the utilization-side heat exchanger and the inlet of the compressor becomes a positive value.

In the air conditioning apparatus of this aspect, in the refrigerant quantity determination operation control, the operation controlling means performs determination of the properness of the quantity of the refrigerant with which the inside of the refrigerant circuit is charged on the basis of the supercooling degree of the refrigerant in the outlet of the heat source-side heat exchanger or the operation state quantity (e.g., a relative degree of supercooling described later) that fluctuates in accordance with fluctuations in the degree of superheating which is detected as the first detection value while controlling the expansion mechanism such that the degree of supercooling of the refrigerant in at least one place between the outlet of the utilization-side heat exchanger and the inlet of the compressor becomes a positive value.

Consequently, in the air conditioning apparatus that performs the refrigerant quantity determination operation control while controlling the expansion mechanism such that the degree of superheating of the refrigerant in at least one place between the outlet of the utilization-side heat exchanger and the inlet of the compressor becomes a positive value, when there is liquid refrigerant accumulation in the accumulator, the operation controlling means can eliminate the liquid refrigerant accumulation, so the operation controlling means can shorten the amount of time it takes for the refrigerant quantity determination operation control. Further, the operation controlling means can eliminate the liquid refrigerant accumulation in the accumulator and can perform determination of the properness of the quantity of the refrigerant, so the operation controlling means can perform determination of the proper quantity of the refrigerant in a state where there is not much error even when the liquid refrigerant is accumulating in the accumulator.

An air conditioning apparatus pertaining to a fifteenth aspect of the invention is the air conditioning apparatus pertaining to the fourteenth aspect of the invention, wherein during the refrigerant quantity determination operation control, the liquid refrigerant accumulation determining means determines whether or not the liquid refrigerant is accumulating in the accumulator on the basis of an inlet temperature and an outlet temperature. The inlet temperature is a temperature that an inlet temperature sensor disposed in a refrigerant pipe portion on the inlet side of the accumulator detects. Further, the outlet temperature is a temperature that an outlet temperature sensor disposed in a refrigerant pipe portion on the outlet side of the accumulator detects.

In the air conditioning apparatus of this aspect, the operation controlling means performs operation where the operation controlling means controls the expansion mechanism such that the degree of superheating of the refrigerant in at least one place between the outlet of the utilization-side heat exchanger and the inlet of the compressor becomes a positive value, and the refrigerant circulates inside the refrigerant circuit. When the refrigerant is circulating through the inside of the refrigerant circuit, when the liquid refrigerant is accumulating in the accumulator, a temperature difference arises between the temperature on the inlet side and the temperature on the outlet side of the accumulator. In the air conditioning apparatus of this aspect, the liquid refrigerant accumulation determining means determines whether or not the liquid refrigerant is accumulating in the accumulator on the basis of the temperature (that is, the inlet temperature) that the inlet temperature sensor disposed in the pipe on the inlet side of the accumulator detects and the temperature (that is, the outlet temperature) that the outlet temperature sensor disposed in the pipe on the outlet side of the accumulator detects. Consequently, the liquid refrigerant accumulation determining means can determine whether or not the liquid refrigerant is accumulating in the accumulator.

An air conditioning apparatus pertaining to a sixteenth aspect of the invention is the air conditioning apparatus pertaining to the fifteenth aspect of the invention, wherein the liquid refrigerant accumulation determining means determines that the liquid refrigerant is accumulating in the accumulator when the temperature difference between the inlet temperature and the outlet temperature is equal to or greater than a predetermined temperature difference.

When the liquid refrigerant exists inside the accumulator, it becomes easier for a temperature difference to arise between the inlet temperature and the outlet temperature as a result of the liquid refrigerant evaporating. In the air conditioning apparatus of this aspect, the operation controlling means performs the refrigerant quantity determination operation control while the operation controlling means performs operation where the operation controlling means controls the expansion mechanism such that the degree of superheating of the refrigerant in at least one place between the outlet of the utilization-side heat exchanger and the inlet of the compressor becomes a positive value, and the liquid refrigerant accumulation determining means determines that the liquid refrigerant is accumulating in the accumulator when the temperature difference between the inlet temperature and the outlet temperature is equal to or greater than the predetermined temperature difference.

Consequently, the liquid refrigerant accumulation determining means can determine whether or not the liquid refrigerant is accumulating in the accumulator in the case of a state where the refrigerant is circulating in the refrigerant circuit where the operation controlling means controls the expansion mechanism such that the degree of superheating of the refrigerant in at least one place between the outlet of the utilization-side heat exchanger and the inlet of the compressor becomes a positive value. Further, for example, in the case of a model where there are temperature sensors in pipes in front and in back of the accumulator, the sensors can be appropriated and production costs can be reduced.

An air conditioning apparatus pertaining to a seventeenth aspect of the invention is the air conditioning apparatus pertaining to any of the fourteenth to sixteenth aspects of the invention, wherein during the refrigerant quantity determination operation control, when the liquid refrigerant accumulation determining means has determined that the liquid refrigerant is accumulating in the accumulator, the operation controlling means performs, as the liquid refrigerant accumulation elimination control, low-pressure pressure lowering control where the operation controlling means decreases the opening degree of the expansion mechanism and lowers low-pressure pressure.

In this manner, by decreasing the opening degree of the expansion mechanism and lowering low-pressure pressure as the liquid refrigeration accumulation elimination control, the operation controlling means can make it easier to cause the liquid refrigerant inside the accumulator to evaporate. For this reason, in the cooling operation in the refrigerant quantity determination operation control, the operation controlling means can quickly create a state where the refrigerant in the inlet of the compressor is superheated and can shorten the amount of time it takes for the refrigerant quantity determination operation control.

An air conditioning apparatus pertaining to an eighteenth aspect of the invention is the air conditioning apparatus pertaining to any of the fourteenth to seventeenth aspects of the invention, wherein during the refrigerant quantity determination operation control, when the liquid refrigerant accumulation determining means has determined that the liquid refrigerant is accumulating in the accumulator, the operation controlling means performs, as the liquid refrigerant accumulation elimination control, operation capacity increase control where the operation controlling means increases the operation capacity of the compressor.

In this manner, by increasing the operation capacity of the compressor as the liquid refrigeration accumulation elimination control, the operation controlling means can lower low-pressure pressure and make it easier to cause the liquid refrigerant inside the accumulator to evaporate. For this reason, in the cooling operation in the refrigerant quantity determination operation control, the operation controlling means can quickly create a state where the refrigerant in the inlet of the compressor is superheated and can shorten the amount of time it takes for the refrigerant quantity determination operation control.

Advantageous Effects of the Invention

In the air conditioning apparatus pertaining to the first aspect of the invention, the operation controlling means can eliminate liquid refrigerant accumulation in the accumulator and can perform determination of the properness of the quantity of the refrigerant. For this reason, the operation controlling means can perform determination of the proper quantity of the refrigerant in a state where there is not much error even when the liquid refrigerant is accumulating in the accumulator.

In the air conditioning apparatus pertaining to the second aspect of the invention, the operation controlling means can eliminate the liquid refrigerant accumulation in the accumulator and can perform determination of the properness of the quantity of the refrigerant. For this reason, the operation controlling means can perform determination of the proper quantity of the refrigerant in a state where there is not much error even when the liquid refrigerant is accumulating in the accumulator.

In the air conditioning apparatus pertaining to the third aspect of the invention, the liquid refrigerant accumulation determining means can determine whether or not the liquid refrigerant is accumulating in the accumulator in the case of a state where the refrigerant is circulating in the refrigerant circuit like in the liquid temperature constant control.

In the air conditioning apparatus pertaining to the fourth aspect of the invention, the liquid refrigerant accumulation determining means can determine whether or not the liquid refrigerant is accumulating in the accumulator in the case of a state where the refrigerant is circulating in the refrigerant circuit like in the liquid temperature constant control. Further, for example, in the case of a model where there are temperature sensors in the pipes in front and in back of the accumulator, the sensors can be appropriated and production costs can be reduced.

In the air conditioning apparatus pertaining to the fifth aspect of the invention, when the refrigerant is not circulating that much in the refrigerant circuit like in the liquid refrigerant storage control and the pressure of the pipe portion on the gas side is low, the liquid refrigerant accumulation determining means can relatively accurately determine that the liquid refrigerant exists inside the accumulator.

In the air conditioning apparatus pertaining to the sixth aspect of the invention, when the refrigerant is not circulating that much in the refrigerant circuit like in the liquid refrigerant storage control and the pressure of the pipe portion on the gas side is low, the liquid refrigerant accumulation determining means can relatively accurately determine that the liquid refrigerant exists inside the accumulator.

In the air conditioning apparatus pertaining to the seventh aspect of the invention, for example, when it has been determined that the liquid refrigerant is accumulating in the accumulator, the liquid refrigerant releasing means can release the liquid refrigerant from the accumulator to the pipe on the suction side of the compressor by opening the bypass opening-and-closing mechanism. Further, for example, in the case of a model where there already exists a pipe equipped with an opening-and-closing mechanism such as the oil return pipe from the accumulator to the pipe on the suction side of the compressor, the pipe can be appropriated and production costs can be reduced.

In the air conditioning apparatus pertaining to the eighth aspect of the invention, when it has been determined that the liquid refrigerant is accumulating in the accumulator, the liquid refrigerant releasing means can release the liquid refrigerant from the accumulator to the pipe on the suction side of the compressor by opening the bypass opening-and-closing mechanism.

In the air conditioning apparatus pertaining to the ninth aspect of the invention, the liquid refrigerant releasing means can efficiently release the liquid refrigerant accumulating inside the accumulator. For this reason, the operation controlling means can more accurately determine the properness of the quantity of the refrigerant inside the refrigerant circuit without taking time as much as possible.

In the air conditioning apparatus pertaining to the tenth aspect of the invention, the liquid refrigerant releasing means can efficiently release the liquid refrigerant accumulating inside the accumulator. For this reason, the operation controlling means can more accurately determine the properness of the quantity of the refrigerant inside the refrigerant circuit without taking time as much as possible.

In the air conditioning apparatus pertaining to the eleventh aspect of the invention, the operation controlling means can eliminate the liquid refrigerant accumulation in the accumulator and can perform determination of the properness of the quantity of the refrigerant. For this reason, the operation controlling means can perform determination of the proper quantity of the refrigerant in a state where there is not much error even when the liquid refrigerant is accumulating in the accumulator.

In the air conditioning apparatus pertaining to the twelfth aspect of the invention, the operation controlling means can eliminate the liquid refrigerant accumulation in the accumulator and can perform determination of the properness of the quantity of the refrigerant. For this reason, the operation controlling means can perform determination of the proper quantity of the refrigerant in a state where there is not much error even when the liquid refrigerant is accumulating in the accumulator.

In the air conditioning apparatus pertaining to the thirteenth aspect of the invention, the operation controlling means can suppress as much as possible error in the determination of the properness of the quantity of the refrigerant resulting from the liquid refrigerant accumulating in the accumulator and can perform determination of the proper quantity of the refrigerant.

In the air conditioning apparatus pertaining to the fourteenth aspect of the invention, in an air conditioning apparatus that performs the refrigerant quantity determination operation control while controlling the expansion mechanism such that the degree of superheating of the refrigerant in at least one place between the outlet of the utilization-side heat exchanger and the inlet of the compressor becomes a positive value, when there is the liquid refrigerant accumulation in the accumulator, the operation controlling means can eliminate that the liquid refrigerant accumulation, so the operation controlling means can shorten the amount of time it takes for the refrigerant quantity determination operation control. Further, the operation controlling means can eliminate the liquid refrigerant accumulation in the accumulator and can perform determination of the properness of the quantity of the refrigerant, so the operation controlling means can perform determination of the proper quantity of the refrigerant in a state where there is not much error even when the liquid refrigerant is accumulating in the accumulator.

In the air conditioning apparatus pertaining to the fifteenth aspect of the invention, the liquid refrigerant accumulation determining means can determine whether or not the liquid refrigerant is accumulating in the accumulator.

In the air conditioning apparatus pertaining to the sixteenth aspect of the invention, the liquid refrigerant accumulation determining means can determine whether or not the liquid refrigerant is accumulating in the accumulator in the case of a state where the refrigerant is circulating in the refrigerant circuit where the operation controlling means controls the expansion mechanism such that the degree of superheating of the refrigerant in at least one place between the outlet of the utilization-side heat exchanger and the inlet of the compressor becomes a positive value. Further, for example, in the case of a model where there are temperature sensors in pipes in front and in back of the accumulator, the sensors can be appropriated and production costs can be reduced.

In the air conditioning apparatus pertaining to the seventeenth aspect of the invention, by decreasing the opening degree of the expansion mechanism and lowering low-pressure pressure as the liquid refrigeration accumulation elimination control, the operation controlling means can make it easier to cause the liquid refrigerant inside the accumulator to evaporate. For this reason, in the cooling operation in the refrigerant quantity determination operation control, the operation controlling means can quickly create a state where the refrigerant in the inlet of the compressor is superheated and can shorten the amount of time it takes for the refrigerant quantity determination operation control.

In the air conditioning apparatus pertaining to the eighteenth aspect of the invention, by increasing the operation capacity of the compressor as the liquid refrigeration accumulation elimination control, the operation controlling means can lower low-pressure pressure and make it easier to cause the liquid refrigerant inside the accumulator to evaporate. For this reason, in the cooling operation in the refrigerant quantity determination operation control, the operation controlling means can quickly create a state where the refrigerant in the inlet of the compressor is superheated and can shorten the amount of time it takes for the refrigerant quantity determination operation control.

DETAILED DESCRIPTION OF EMBODIMENT(S)

Embodiments of an air conditioning apparatus and a refrigerant quantity determination method pertaining to the present invention will be described below on the basis of the drawings.

First Embodiment

(1) Configuration of Air Conditioning Apparatus

Figure 1:
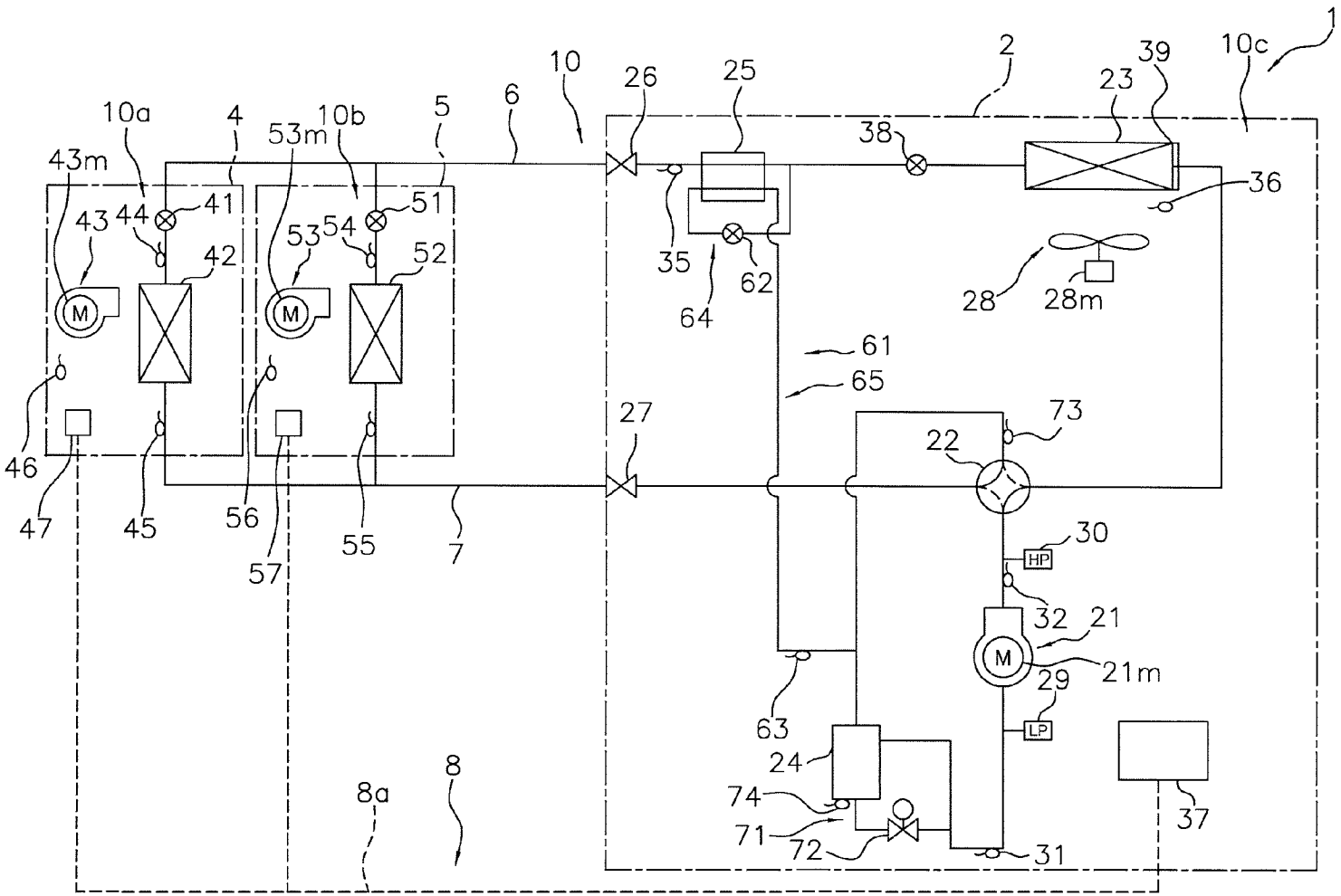
FIG. 1 is a general configuration diagram of an air conditioning apparatus pertaining to a first embodiment of the present invention.

FIG. 1 is a general configuration diagram of an air conditioning apparatus 1 according to a first embodiment of the present invention. The air conditioning apparatus 1 is an apparatus used to cool and heat the inside of a room in a building or the like by performing vapor compression refrigeration cycle operation. The air conditioning apparatus 1 is mainly equipped with one outdoor unit 2 serving as a heat source unit, plural (in the present embodiment, two) indoor units 4 and 5 serving as utilization units that are connected in parallel to the outdoor unit 2, and a liquid refrigerant connection pipe 6 and a gas refrigerant connection pipe 7 serving as refrigerant connection pipes that interconnect the outdoor unit 2 and the indoor units 4 and 5. That is, a vapor compression refrigerant circuit 10 of the air conditioning apparatus 1 of the present embodiment is configured as a result of the outdoor unit 2, the indoor units 4 and 5 and the liquid refrigerant connection pipe 6 and the gas refrigerant connection pipe 7 being connected.

<Indoor Units>

The indoor units 4 and 5 are installed by being embedded in or hung from a ceiling inside a room in a building or the like or by being mounted on a wall surface inside a room. The indoor units 4 and 5 are connected to the outdoor unit 2 via the liquid refrigerant connection pipe 6 and the gas refrigerant connection pipe 7 and configure a part of the refrigerant circuit 10.

Next, the configuration of the indoor units 4 and 5 will be described. The indoor unit 4 and the indoor unit 5 have the same configuration, so only the configuration of the indoor unit 4 will be described here, and in regard to the configuration of the indoor unit 5, reference numerals in the 50s will be added instead of reference numerals in the 40s representing each part of the indoor unit 4 and description of each part will be omitted.

The indoor unit 4 mainly has an indoor-side refrigerant circuit 10*a* (in the indoor unit 5, an indoor-side refrigerant circuit 10*b*) that configures a part of the refrigerant circuit 10. This indoor-side refrigerant circuit 10*a* mainly has an indoor expansion valve 41 serving as a utilization-side expansion mechanism and an indoor heat exchanger 42 serving as a utilization-side heat exchanger.

In the present embodiment, the indoor expansion valve 41 is an electrical expansion valve connected to the liquid side of the indoor heat exchanger 42 in order to perform, for example, regulation of the flow rate of refrigerant flowing through the inside of the indoor-side refrigerant circuit 10*a*, and the indoor expansion valve 41 is also capable of shutting off passage of the refrigerant.

In the present embodiment, the indoor heat exchanger 42 is a cross-fin type fin-and-tube heat exchanger configured by heat transfer tubes and numerous fins and is a heat exchanger that functions as an evaporator of the refrigerant during cooling operation to cool the room air and functions as a condenser of the refrigerant during heating operation to heat the room air. In the present embodiment, the indoor heat exchanger 42 is a cross-fin type fin-and-tube heat exchanger, but it is not limited to this and may also be another type of heat exchanger.

In the present embodiment, the indoor unit 4 has an indoor fan 43 serving as a blowing fan for sucking the room air into the inside of the unit, allowing heat to be exchanged with the refrigerant in the indoor heat exchanger 42, and thereafter supplying the air to the inside of the room as supply air. The indoor fan 43 is a fan capable of varying the flow rate of the air it supplies to the indoor heat exchanger 42 and, in the present embodiment, is a centrifugal fan or a multiblade fan or the like driven by a motor 43*m* comprising a DC fan motor or the like.

Further, various types of sensors are disposed in the indoor unit 4. A liquid-side temperature sensor 44 that detects the temperature of the refrigerant (that is, the temperature of the refrigerant corresponding to the condensation temperature during the heating operation or the evaporation temperature during the cooling operation) is disposed on the liquid side of the indoor heat exchanger 42. A gas-side temperature sensor 45 that detects the temperature of the refrigerant is disposed on the gas side of the indoor heat exchanger 42. An indoor temperature sensor 46 that detects the temperature of the room air (that is, the indoor temperature) flowing into the inside of the unit is disposed on a room air suction opening side of the indoor unit 4. In the present embodiment, the liquid-side temperature sensor 44, the gas-side temperature sensor 45 and the indoor temperature sensor 46 comprise thermistors. Further, the indoor unit 4 has an indoor-side controller 47 that controls the operation of each part configuring the indoor unit 4. Additionally, the indoor-side controller 47 has a microcomputer and a memory and the like disposed in order to perform control of the indoor unit 4 and is configured such that it can exchange control signals and the like with a remote controller (not shown) for individually operating the indoor unit 4 and such that it can exchange control signals and the like with the outdoor unit 2 via a transmission line 8*a*.

<Outdoor Unit>

The outdoor unit 2 is installed outdoors of a building or the like, is connected to the indoor units 4 and 5 via the liquid refrigerant connection pipe 6 and the gas refrigerant connection pipe 7, and configures the refrigerant circuit 10 together with the indoor units 4 and 5.

Next, the configuration of the outdoor unit 2 will be described. The outdoor unit 2 mainly has an outdoor-side refrigerant circuit 10*c* that configures a part of the refrigerant circuit 10. This outdoor-side refrigerant circuit 10*c* mainly has a compressor 21, a four-way switching valve 22, an outdoor heat exchanger 23 serving as a heat source-side heat exchanger, an outdoor expansion valve 38 serving as an expansion mechanism, an accumulator 24, a supercooler 25 serving as a temperature regulation mechanism, a liquid-side stop valve 26, and a gas-side stop valve 27.

The compressor 21 is a compressor capable of varying its operating capacity and, in the present embodiment, is a positive displacement compressor driven by a motor 21*m* whose number of revolutions is controlled by an inverter. In the present embodiment, the compressor 21 comprises only one compressor, but the compressor 21 is not limited to this and two or more compressors may also be connected in parallel depending on the connection number of the indoor units and the like.

The four-way switching valve 22 is a valve for switching the direction of the flow of the refrigerant such that, during the cooling operation, the four-way switching valve 22 is capable of interconnecting the discharge side of the compressor 21 and the gas side of the outdoor heat exchanger 23 and also interconnecting the suction side of the compressor 21 (specifically, the accumulator 24) and the gas refrigerant connection pipe 7 side (cooling operation state: see the solid lines of the four-way switching valve 22 in FIG. 1) to cause the outdoor heat exchanger 23 to function as a condenser of the refrigerant compressed by the compressor 21 and to cause the indoor heat exchangers 42 and 52 to function as evaporators of the refrigerant condensed in the outdoor heat exchanger 23 and such that, during the heating operation, the four-way switching valve 22 is capable of interconnecting the discharge side of the compressor 21 and the gas refrigerant connection pipe 7 side and also interconnecting the suction side of the compressor 21 and the gas side of the outdoor heat exchanger 23 (heating operation state: see the broken lines of the four-way switching valve 22 in FIG. 1) to cause the indoor heat exchangers 42 and 52 to function as condensers of the refrigerant compressed by the compressor 21 and to cause the outdoor heat exchanger 23 to function as an evaporator of the refrigerant condensed in the indoor heat exchangers 42 and 52.

Figure 2:
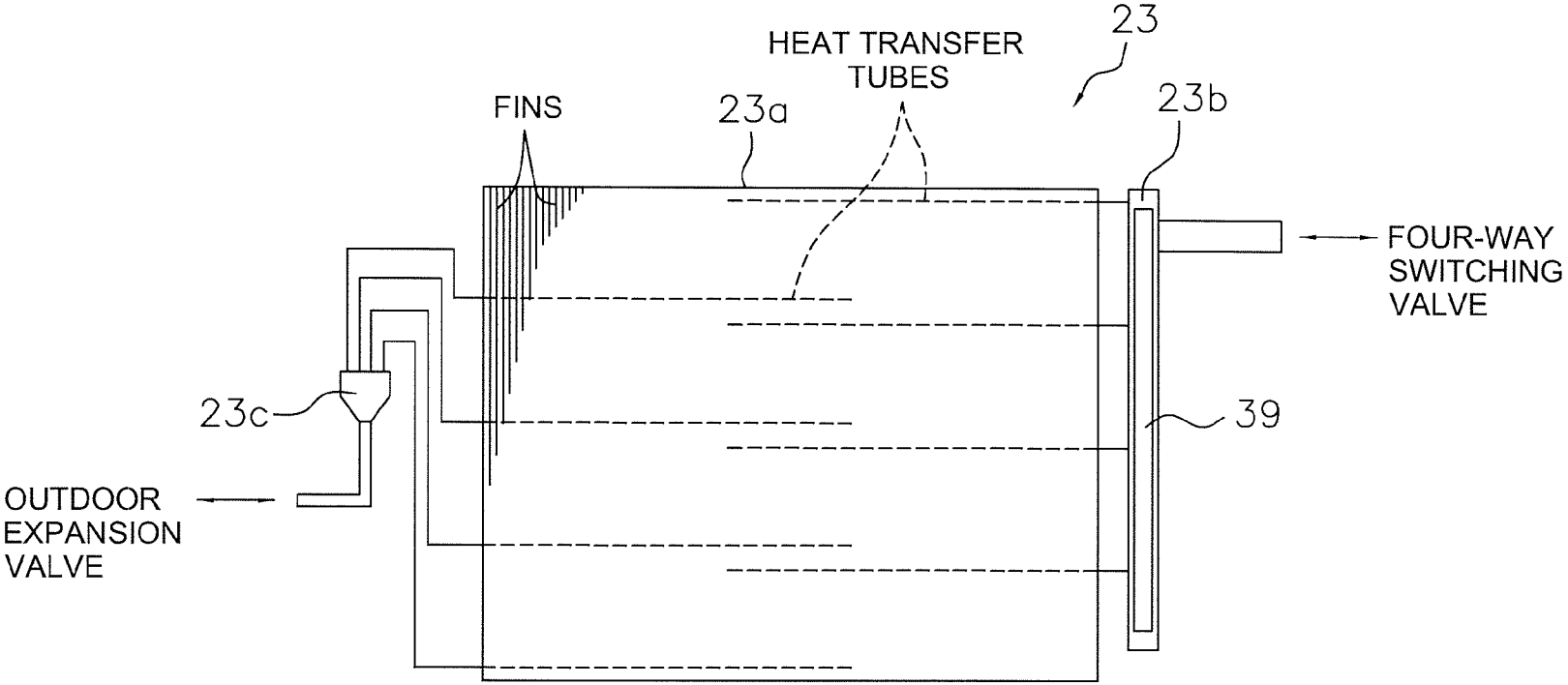
FIG. 2 is a general diagram of an outdoor heat exchanger.

In the present embodiment, the outdoor heat exchanger 23 is a cross-fin type fin-and-tube heat exchanger and, as shown in FIG. 2, mainly has a heat exchanger body 23*a* that is configured from heat transfer tubes and numerous fins, a header 23*b* that is connected to the gas side of the heat exchanger body 23*a*, and a distributor 23*c* that is connected to the liquid side of the heat exchanger body 23*a*. Here, FIG. 2 is a general diagram of the outdoor heat exchanger 23. The outdoor heat exchanger 23 is a heat exchanger that functions as a condenser of the refrigerant during the cooling operation and as an evaporator of the refrigerant during the heating operation. The gas side of the outdoor heat exchanger 23 is connected to the four-way switching valve 22, and the liquid side of the outdoor heat exchanger 23 is connected to the outdoor expansion valve 38. Further, on a side surface of the outdoor heat exchanger 23, as shown in FIG. 2, there is disposed a liquid level detection sensor 39 serving as a refrigerant detection mechanism that is placed on the upstream side of the liquid-side stop valve 26 in the flow direction of the refrigerant in the refrigerant circuit 10 when performing the cooling operation and detects a state quantity relating to the quantity of the refrigerant existing on the upstream side of the outdoor expansion valve 38. The liquid level detection sensor 39 is a sensor for detecting the quantity of the liquid refrigerant accumulating in the outdoor heat exchanger 23 as the state quantity relating to the quantity of the refrigerant existing on the upstream side of the outdoor expansion valve 38 and is configured by a tubular detection member placed along the height direction of the outdoor heat exchanger 23 (more specifically, the header 23*b*). Here, in the case of the cooling operation, high-temperature and high-pressure gas refrigerant discharged from the compressor 21 is cooled by air supplied by the outdoor fan 28, condenses, and becomes high-pressure liquid refrigerant inside the outdoor heat exchanger 23. That is, the liquid level detection sensor 39 detects, as the liquid level, the boundary between the region where the refrigerant exists in a gas state and the region where the refrigerant exists in a liquid state. The liquid level detection sensor 39 is not limited to such a tubular detection member and may also be configured by a temperature thermistor, such as thermistors placed in plural places along the height direction of the outdoor heat exchanger 23 (more specifically, the header 23*b*), for example, to detect, as the liquid level, the boundary between the portion in the outdoor heat exchanger 23 where gas refrigerant of a higher temperature than the ambient temperature exists and the portion in the outdoor heat exchanger 23 where liquid refrigerant of about the same temperature as the ambient temperature exists. In the present embodiment, the outdoor heat exchanger 23 is a cross-fin type fin-and-tube heat exchanger, but it is not limited to this and may also be another type of heat exchanger. Further, in the present embodiment, the header 23*b* is disposed on one end of the heat exchanger body 23*a* and the distributor 23*c* is disposed on the other end of the heat exchanger body 23*a*, but the outdoor heat exchanger 23 is not limited to this and may also be configured such that the header 23*b* and the distributor 23*c* are disposed on the same end portion of the outdoor heat exchanger body 23*a*.

In the present embodiment, the outdoor expansion valve 38 is an electrical expansion valve that is placed on the downstream side of the outdoor heat exchanger 23 and on the upstream side of the supercooler 25 in the flow direction of the refrigerant in the refrigerant circuit 10 when performing the cooling operation (in the present embodiment, the outdoor expansion valve 38 is connected to the liquid side of the outdoor heat exchanger 23) in order to perform regulation, for example, of the pressure and flow rate of the refrigerant flowing through the inside of the outdoor-side refrigerant circuit 10*c* and is also capable of shutting off passage of the refrigerant. In order to prevent a portion (hereinafter called a liquid refrigerant pipe portion) of the refrigerant circuit 10 between the indoor expansion valves 41 and 51 and the outdoor expansion valve 38 including the liquid refrigerant connection pipe 7 from being damaged, a high-pressure control valve 77 capable of allowing the refrigerant to flow out to the outdoor heat exchanger 23 when the pressure of the liquid refrigerant inside the liquid refrigerant pipe portion exceeds a predetermined pressure is disposed in a pipe that bypasses the front and back of the outdoor expansion valve 38. Thus, it becomes possible to prevent damage to the liquid refrigerant pipe portion resulting from a temperature rise or the like.

In the present embodiment, the outdoor unit 2 has an outdoor fan 28 serving as a blowing fan for sucking outdoor air into the inside of the unit, allowing heat to be exchanged with the refrigerant in the outdoor heat exchanger 23, and thereafter expelling the air to the outdoors. This outdoor fan 28 is a fan capable of varying the flow rate of the air it supplies to the outdoor heat exchanger 23 and, in the present embodiment, is a propeller fan or the like driven by a motor 28*m* comprising a DC fan motor or the like.

The accumulator 24 is connected between the four-way switching valve 22 and the compressor 21 and is a container capable of accumulating surplus refrigerant generated inside the refrigerant circuit 10 depending on, for example, fluctuations in the operating loads of the indoor units 4 and 5. Further, in the present embodiment, there is disposed a second bypass refrigerant pipe 71 that interconnects the bottom portion of the accumulator 24 and a pipe between the accumulator 24 and the compressor 21. Additionally, in this second bypass refrigerant pipe 71, there is disposed a refrigerant release valve 72 capable of opening and closing this flow path. The refrigerant release valve 72 comprises a solenoid valve.

The supercooler 25 is, in the present embodiment, a double-pipe heat exchanger or a pipe heat exchanger configured by allowing a refrigerant pipe through which the refrigerant condensed in the heat source-side heat exchanger flows and a first bypass refrigerant pipe 61 described later to touch each other and is disposed between the outdoor heat exchanger 23 and the liquid refrigerant connection pipe 6 in order to cool the refrigerant that is sent to the indoor expansion valves 41 and 51 after being condensed in the outdoor heat exchanger 23. More specifically, the supercooler 25 is connected between the outdoor expansion valve 38 and the liquid-side stop valve 26.

In the present embodiment, there is disposed a first bypass refrigerant pipe 61 serving as a cooling source of the supercooler 25. In the description below, the portion of the refrigerant circuit 10 excluding the first bypass refrigerant pipe 61 and the second bypass refrigerant pipe 71 described later will be called a main refrigerant circuit for the sake of convenience. The first bypass refrigerant pipe 61 is connected to the main refrigerant circuit so as to allow some of the refrigerant sent from the outdoor heat exchanger 23 to the indoor expansion valves 41 and 51 to branch from the main refrigerant circuit, introduce the branched refrigerant to the supercooler 25 after depressurizing the branched refrigerant, allow the branched refrigerant to exchange heat with the refrigerant sent from the outdoor heat exchanger 23 through the liquid refrigerant connection pipe 6 to the indoor expansion valves 41 and 51, and thereafter return the branched refrigerant to the suction side of the compressor 21. Specifically, the first bypass refrigerant pipe 61 has a first branching pipe 64 that is connected so as to allow some of the refrigerant sent from the outdoor expansion valve 38 to the indoor expansion valves 41 and 51 to branch from a position between the outdoor heat exchanger 23 and the supercooler 25, a first merging pipe 65 that is connected to the suction side of the compressor 21 so as to return the branched refrigerant from the outlet on the bypass refrigerant pipe side of the supercooler 25 to the suction side of the compressor 21, and a bypass expansion valve 62 serving as an expansion mechanism for regulating the flow rate of the refrigerant flowing through the first bypass refrigerant pipe 61. Here, the bypass expansion valve 62 comprises a motor-driven expansion valve. Thus, the refrigerant sent from the outdoor heat exchanger 23 to the indoor expansion valves 41 and 51 is cooled in the supercooler 25 by the refrigerant flowing through the first bypass refrigerant pipe 61 after being depressurized by the bypass expansion valve 62. That is, in the supercooler 25, ability control becomes performed by regulation of the opening degree of the bypass expansion valve 62. Further, the first bypass refrigerant pipe 61 is, as described later, configured such that it also functions as a communication pipe that interconnects the portion of the refrigerant circuit 10 between the liquid-side stop valve 26 and the outdoor expansion valve 38 and the portion of the refrigerant circuit 10 on the suction side of the compressor 21. The first bypass refrigerant pipe 61 is, in the present embodiment, disposed so as to allow the refrigerant to branch from a position between the outdoor expansion valve 38 and the supercooler 25, but the first bypass refrigerant pipe 61 is not limited to this and may also be disposed so as to allow the refrigerant to branch from a position between the outdoor expansion valve 38 and the liquid-side stop valve 26.

The liquid-side stop valve 26 and the gas-side stop valve 27 are valves disposed in openings to which external devices and pipes (specifically, the liquid refrigerant connection pipe 6 and the gas refrigerant connection pipe 7) connect. The liquid-side stop valve 26 is placed on the downstream side of the outdoor expansion valve 38 and on the upstream side of the liquid refrigerant connection pipe 6 in the flow direction of the refrigerant in the refrigerant circuit 10 when performing the cooling operation (in the present embodiment, the liquid-side stop valve 26 is connected to the supercooler 25) and is capable of shutting off passage of the refrigerant. The gas-side stop valve 27 is connected to the four-way switching valve 22.

Further, various types of sensors are disposed in the outdoor unit 2 in addition to the liquid level detection sensor 39 described above. Specifically, a suction pressure sensor 29 that detects the suction pressure of the compressor 21, a discharge pressure sensor 30 that detects the discharge pressure of the compressor 21, a suction temperature sensor 31 that detects the suction temperature of the compressor 21 and a discharge temperature sensor 32 that detects the discharge temperature of the compressor 21 are disposed in the outdoor unit 2. A liquid pipe temperature sensor 35 that detects the temperature of the refrigerant (that is, the liquid pipe temperature) is disposed in the outlet on the main refrigerant circuit side of the subcooler 25. A bypass temperature sensor 63 for detecting the temperature of the refrigerant flowing through the outlet on the bypass refrigerant pipe side of the supercooler 25 is disposed in the first merging pipe 65 of the first bypass refrigerant pipe 61. An outdoor temperature sensor 36 that detects the temperature of the outdoor air (that is, the outdoor temperature) flowing into the inside of the unit is disposed on an outdoor air suction opening side of the outdoor unit 2. A gas pipe temperature sensor 73 that detects the temperature of the refrigerant (that is, the gas pipe temperature) is disposed between the gas-side stop valve 27 and the accumulator 24 of the outdoor unit 2. Further, an accumulator temperature sensor 74 that detects the temperature inside the accumulator 24 (that is, the accumulator temperature) is disposed in the bottom portion of the accumulator 24 of the outdoor unit 2. In the present embodiment, the suction temperature sensor 31, the discharge temperature sensor 32, the liquid pipe temperature sensor 35, the outdoor temperature sensor 36, the bypass temperature sensor 63, the gas pipe temperature sensor 73 and the accumulator temperature sensor 74 comprise thermistors. Further, the outdoor unit 2 has an outdoor-side controller 37 that controls the operation of each part configuring the outdoor unit 2. Additionally, the outdoor-side controller 37 has a microcomputer and a memory disposed in order to perform control of the outdoor unit 2 and an inverter circuit that controls the motor 21*m*, and the outdoor-side controller 37 is configured such that it can exchange control signals and the like via the transmission line 8*a* with the indoor-side controllers 47 and 57 of the indoor units 4 and 5. That is, a controller 8 that performs operation control of the entire air conditioning apparatus 1 is configured by the indoor-side controllers 47 and 57, the outdoor-side controller 37, and the transmission line 8*a* that interconnects the controllers 37, 47 and 57.

Figure 3:
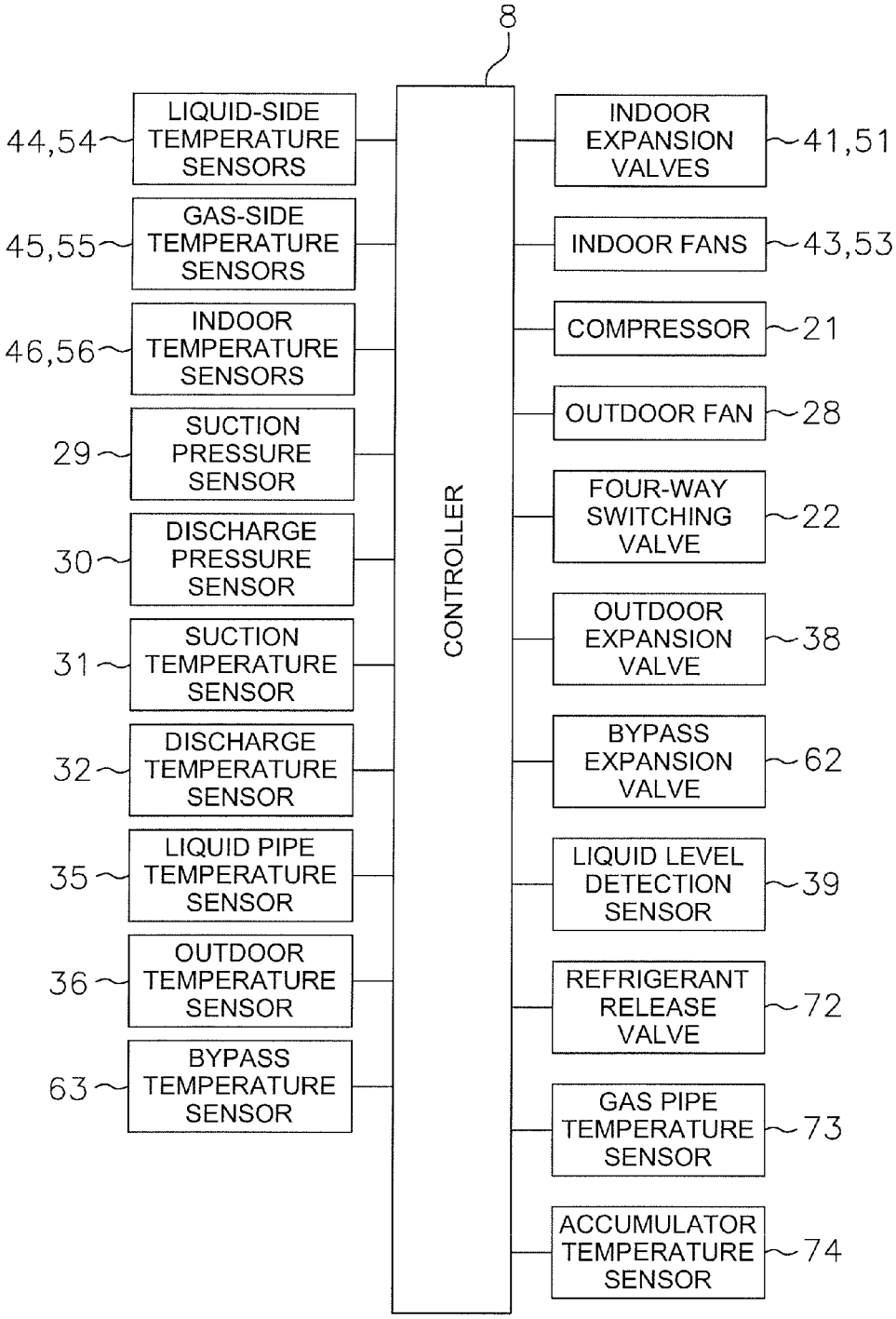
FIG. 3 is a control block diagram of the air conditioning apparatus.

The controller 8 is, as shown in FIG. 3, connected such that it can receive detection signals of the various types of sensors 29 to 32, 35, 36, 39, 44 to 46, 54 to 56, 63 73 and 74 and is connected such that it can control the various types of devices and valves 21, 22, 28, 38, 41, 43, 51, 53 62 and 72 on the basis of these detection signals and the like. Further, various types of data are stored in a memory configuring the controller 8; for example, proper refrigerant quantity data of the refrigerant circuit 10 of the air conditioning apparatus 1 per property where, for example, pipe length has been considered after being installed in a building are stored. Additionally, when performing automatic refrigerant charging operation and refrigerant leak detection operation described later, the controller 8 reads these data, charges the refrigerant circuit 10 with just the proper quantity of the refrigerant, and judges whether or not there is a refrigerant leak by comparison with the proper refrigerant quantity data. Further, in the memory of the controller 8, liquid pipe fixed refrigerant quantity data (a liquid pipe fixed refrigerant quantity Y) and outdoor heat exchange collected refrigerant quantity data (an outdoor heat exchange collected refrigerant quantity X) are stored separately from the proper refrigerant quantity data (a proper refrigerant quantity Z), and the relationship of Z=X+Y is satisfied. Here, the liquid pipe fixed refrigerant quantity Y is a quantity of the refrigerant which, when operation described later which seals, with liquid refrigerant of a constant temperature, the portion (hereinafter called a liquid refrigerant pipe portion) from the downstream side of the outdoor heat exchanger 23 via the outdoor expansion valve 38, the supercooler 25 and the liquid refrigerant connection pipe 6 to the indoor expansion valves 41 and 51, from the first branching pipe 64 to the bypass expansion valve 62 is fixed in this liquid refrigerant pipe portion. Further, the outdoor heat exchange collected refrigerant quantity X is a refrigerant quantity obtained by subtracting the liquid pipe fixed refrigerant quantity Y from the proper refrigerant quantity Z. Moreover, a relational expression with which the quantity of the refrigerant accumulated from the outdoor expansion valve 38 to the outdoor heat exchanger 23 can be calculated on the basis of data of the liquid level in the outdoor heat exchanger 23 is stored in the memory of the controller 8. Here, FIG. 3 is a control block diagram of the air conditioning apparatus 1.

<Refrigerant Connection Pipes>

The refrigerant connection pipes 6 and 7 are refrigerant pipes constructed on site when installing the air conditioning apparatus 1 in an installation location such as a building, and pipes having various lengths and pipe diameters are used depending on installation conditions such as the installation location and the combination of outdoor units and indoor units. For this reason, for example, when installing a new air conditioning apparatus, it is necessary to charge the air conditioning apparatus 1 with the proper quantity of the refrigerant corresponding to installation conditions such as the lengths and the pipe diameters of the refrigerant connection pipes 6 and 7.

As described above, the refrigerant circuit 10 of the air conditioning apparatus 1 is configured as a result of the indoor-side refrigerant circuits 10*a* and 10*b*, the outdoor-side refrigerant circuit 10*c* and the refrigerant connection pipes 6 and 7 being connected. Additionally, the air conditioning apparatus 1 of the present embodiment is configured to switch between the cooling operation and the heating operation with the four-way switch valve 22 and also to perform control of each device of the outdoor unit 2 and the indoor units 4 and 5 in accordance with the operating loads of each of the indoor units 4 and 5 with the controller 8 configured by the indoor-side controllers 47 and 57 and the outdoor-side controller 37.

(2) Operation of Air Conditioning Apparatus

Next, operation of the air conditioning apparatus 1 of the present embodiment will be described.

As operation modes of the air conditioning apparatus 1 of the present embodiment, there are a normal operation mode where control of the configural devices of the outdoor unit 2 and the indoor units 4 and 5 is performed in accordance with the operating loads of each of the indoor units 4 and 5, the automatic refrigerant charging operation mode where the refrigerant circuit 10 is charged with the proper quantity of the refrigerant when test operation is performed, for example, after installation of the configural devices of the air conditioning apparatus 1, and the refrigerant leak detection operation mode where it is determined whether or not there is leakage of the refrigerant from the refrigerant circuit 10 after test operation including this automatic refrigerant charging operation is ended and normal operation is started.

Operation in each operation mode of the air conditioning apparatus 1 will be described below.

<Normal Operation Mode>

First, the cooling operation in the normal operation mode will be described using FIG. 1.

During the cooling operation, the four-way switching valve 22 is in the state indicated by the solid lines in FIG. 1, a cooling operation state, that is, a state where the discharge side of the compressor 21 is connected to the gas side of the outdoor heat exchanger 23 and where the suction side of the compressor 21 is connected to the gas sides of the indoor heat exchangers 42 and 52 via the gas-side stop valve 27 and the gas refrigerant connection pipe 7. Here, the outdoor expansion valve 38, and the bypass expansion valve 62 and the second opening-and-closing valve 74 are placed in a completely open state, and the liquid-side stop valve 26 and the gas-side stop valve 27 are also placed in an open state. Further, the refrigerant release valve 72 is placed in a closed state.

When the compressor 21, the outdoor fan 28 and the indoor fans 43 and 53 are operated in this state of the refrigerant circuit 10, low-pressure gas refrigerant is sucked into the compressor 21, compressed, and becomes high-pressure gas refrigerant. Thereafter, the high-pressure gas refrigerant is sent to the outdoor heat exchanger 23 via the four-way switching valve 22, performs heat exchange with the outdoor air supplied by the outdoor fan 28, condenses, and becomes high-pressure liquid refrigerant. Then, this high-pressure liquid refrigerant passes through the outdoor expansion valve 38, flows into the supercooler 25, performs heat exchange with the refrigerant flowing through the first bypass refrigerant pipe 61, is further cooled, and reaches a supercooled state. At this time, some of the high-pressure liquid refrigerant condensed in the outdoor heat exchanger 23 is branched to the first bypass refrigerant pipe 61, depressurized by the bypass expansion valve 62, and returned to the suction side of the compressor 21. Here, the refrigerant passing through the bypass expansion valve 62 is depressurized until it becomes close to the suction pressure of the compressor 21, whereby some of the refrigerant evaporates. Then, the refrigerant flowing from the outlet of the bypass expansion valve 62 of the first bypass refrigerant pipe 61 toward the suction side of the compressor 21 passes through the supercooler 25 and performs heat exchange with the high-pressure liquid refrigerant sent from the outdoor heat exchanger 23 on the main refrigerant circuit side to the indoor units 4 and 5.

Then, the high-pressure liquid refrigerant that has reached a supercooled state is sent to the indoor units 4 and 5 via the liquid-side stop valve 26 and the liquid refrigerant connection pipe 6.

This high-pressure liquid refrigerant sent to the indoor units 4 and 5 is depressurized until it becomes close to the suction pressure of the compressor 21 by the indoor expansion valves 41 and 51, becomes a low-pressure refrigerant in a gas-liquid two-phase state, is sent to the indoor heat exchangers 42 and 52, and performs heat exchange with the room air, evaporates, and becomes a low-pressure gas refrigerant in the indoor heat exchangers 42 and 52.

This low-pressure gas refrigerant is sent to the outdoor unit 2 via the gas refrigerant connection pipe 7 and flows into the accumulator 24 via the gas-side stop valve 27 and the four-way switching valve 22. Then, the low-pressure gas refrigerant flowing into the accumulator 24 is again sucked into the compressor 21. In this manner, the air conditioning apparatus 1 is capable of performing at least cooling operation where the outdoor heat exchanger 23 is caused to function as a condenser of the refrigerant compressed in the compressor 21 and where the indoor heat exchangers 42 and 52 are caused to function as evaporators of the refrigerant sent through the liquid refrigerant connection pipe 6 and the indoor expansion valves 41 and 51 after being condensed in the outdoor heat exchanger 23.

Figure 4:
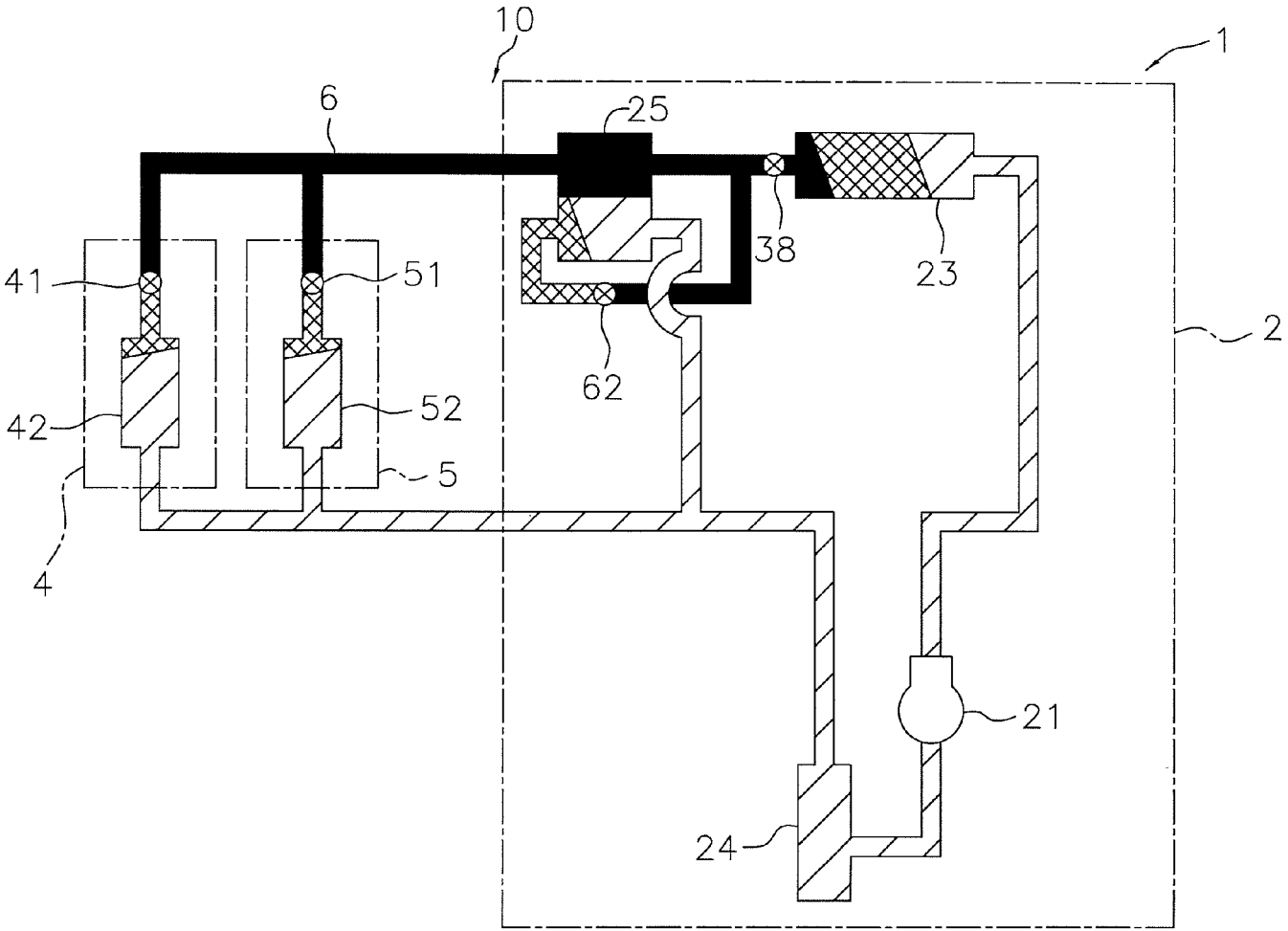
FIG. 4 is a schematic diagram showing states of refrigerant flowing through the inside of a refrigerant circuit in cooling operation.

Here, the distribution state of the refrigerant in the refrigerant circuit 10 when performing the cooling operation in the normal operation mode is such that, as shown in FIG. 4, the refrigerant takes each of the states of a liquid state (the filled-in hatching portions in FIG. 4), a gas-liquid two-phase state (the grid-like hatching portions in FIG. 4) and a gas state (the diagonal line hatching portions in FIG. 4). Specifically, the portion between the portion, via the outdoor expansion valve 38, in the vicinity of the outlet of the outdoor heat exchanger 23 and the indoor expansion valves 41 and 51 via the portion on the main refrigerant circuit side of the supercooler 25 and the liquid refrigerant connection pipe 6 and the portion on the downstream side of the bypass expansion valve 62 of the first bypass refrigerant pipe 61 are filled with the refrigerant in the liquid state. Additionally, the portion in the middle of the outdoor heat exchanger 23, the portion on the upstream side of the bypass expansion valve 62 of the first bypass refrigerant pipe 61, the portion on the bypass refrigerant pipe side and near the inlet of the supercooler 25, and the portions near the inlets of the indoor heat exchangers 42 and 52 are filled with the refrigerant in the gas-liquid two-phase state. Further, the portion via the gas refrigerant connection pipe 7 and the compressor 21 from the portions in the middles of the indoor heat exchangers 42 and 52 to the inlet of the outdoor heat exchanger 23, the portion near the inlet of the outdoor heat exchanger 23, and the portion from the portion on the bypass refrigerant pipe side and in the middle of the supercooler 25 to where the first bypass refrigerant pipe 61 merges with the suction side of the compressor 21 are filled with the refrigerant in the gas state. Here, FIG. 4 is a schematic diagram showing states of the refrigerant flowing through the inside of the refrigerant circuit 10 in the cooling operation.

Figure 6:
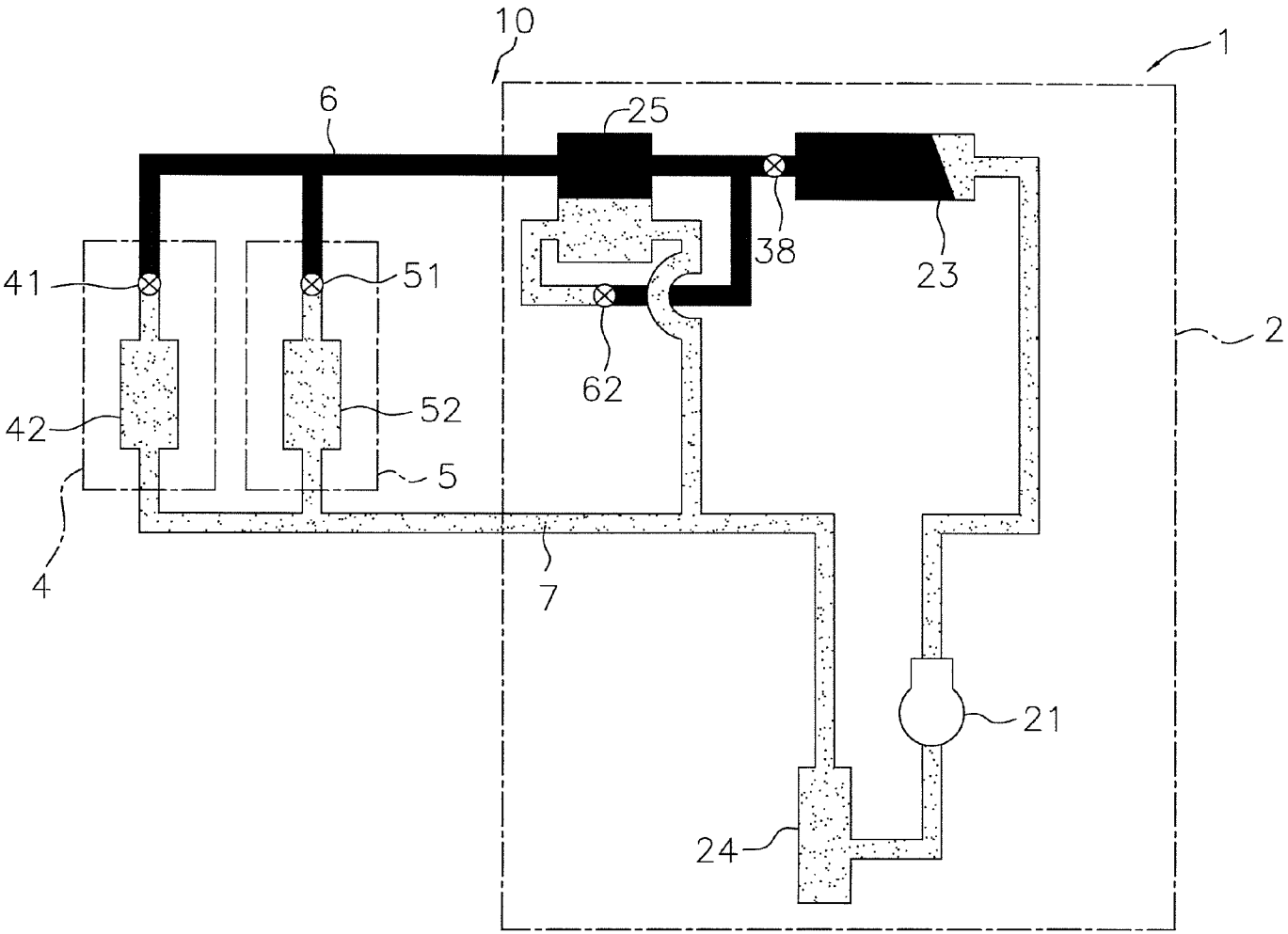
FIG. 6 is a schematic diagram showing states of the refrigerant flowing through the inside of the refrigerant circuit in the refrigerant quantity determination operation.

In the cooling operation in the normal operation mode, the refrigerant is distributed inside the refrigerant circuit 10 in this distribution, but in refrigerant quantity determination operation in the automatic refrigerant charging operation mode and in the refrigerant leak detection operation mode described later, the distribution becomes one where the liquid refrigerant is collected in the liquid refrigerant connection pipe 6 and in the outdoor heat exchanger 23 (see FIG. 6).

Next, the heating operation in the normal operation mode will be described.

During the heating operation, the four-way switching valve 22 is in the state indicated by the broken lines in FIG. 1, a heating operation, that is, a state where the discharge side of the compressor 21 is connected to the gas sides of the indoor heat exchangers 42 and 52 via the gas-side stop valve 27 and the gas refrigerant connection pipe 7 and where the suction side of the compressor 21 is connected to the gas side of the outdoor heat exchanger 23. The opening degree of the outdoor expansion valve 38 is regulated in order to depressurize the refrigerant flowing into the outdoor heat exchanger 23 to a pressure capable of causing the refrigerant to evaporate in the outdoor heat exchanger 23 (that is, the evaporation pressure). Further, the liquid-side stop valve 26 and the gas-side stop valve 27 are placed in an open state. The opening degrees of the indoor expansion valves 41 and 51 are regulated such that the degree of supercooling of the refrigerant in the outlets of the indoor heat exchangers 42 and 52 becomes constant at a target degree of supercooling. In the present embodiment, the degree of supercooling of the refrigerant in the outlets of the indoor heat exchangers 42 and 52 is detected by converting the discharge pressure of the compressor 21 detected by the discharge pressure sensor 30 into a saturation temperature value corresponding to the condensation temperature and subtracting the refrigerant temperature values detected by the liquid-side temperature sensors 44 and 54 from this saturation temperature value of the refrigerant. Although it is not employed in the present embodiment, the degree of supercooling of the refrigerant in the outlets of the indoor heat exchangers 42 and 52 may also be detected by disposing temperature sensors that detect the temperature of the refrigerant flowing through the insides of each of the indoor heat exchangers 42 and 52 and subtracting the refrigerant temperature values corresponding to the condensation temperatures detected by these temperature sensors from the refrigerant temperature values detected by the liquid-side temperature sensors 44 and 54. Further, the bypass expansion valve 62 are closed.

When the compressor 21, the outdoor fan 28 and the indoor fans 43 and 53 are operated in this state of the refrigerant circuit 10, low-pressure gas refrigerant is sucked into the compressor 21, compressed, becomes high-pressure gas refrigerant, and is sent to the indoor units 4 and 5 via the four-way switching valve 22, the gas-side stop valve 27 and the gas refrigerant connection pipe 7.

Then, the high-pressure gas refrigerant sent to the indoor units 4 and 5 performs heat exchange with the room air, condenses and becomes high-pressure liquid refrigerant in the outdoor heat exchangers 42 and 52 and is thereafter depressurized in accordance with the valve opening degrees of the indoor expansion valves 41 and 51 when it passes through the indoor expansion valves 41 and 51.

This refrigerant traveling through the indoor expansion valves 41 and 51 is sent to the outdoor unit 2 via the liquid refrigerant connection pipe 6, is further depressurized via the liquid-side stop valve 26, the supercooler 25 and the outdoor expansion valve 38, and thereafter flows into the outdoor heat exchanger 23. Then, the low-pressure refrigerant in the gas-liquid two-phase state flowing into the outdoor heat exchanger 23 performs heat exchange with the outdoor air supplied by the outdoor fan 28, evaporates, becomes low-pressure gas refrigerant, and flows into the accumulator 24 via the four-way switching valve 22. Then, the low-pressure gas refrigerant flowing into the accumulator 24 is again sucked into the compressor 21.

Operation control in the normal operation mode described above is performed by the controller 8 (more specifically, the indoor-side controllers 47 and 57, the outdoor-side controller 37, and the transmission line 8*a* that interconnects the controllers 37, 47 and 57), which functions as an operation controlling device or means that performs normal operation including the cooling operation and the heating operation.

<Automatic Refrigerant Charging Operation Mode>

Figure 5:
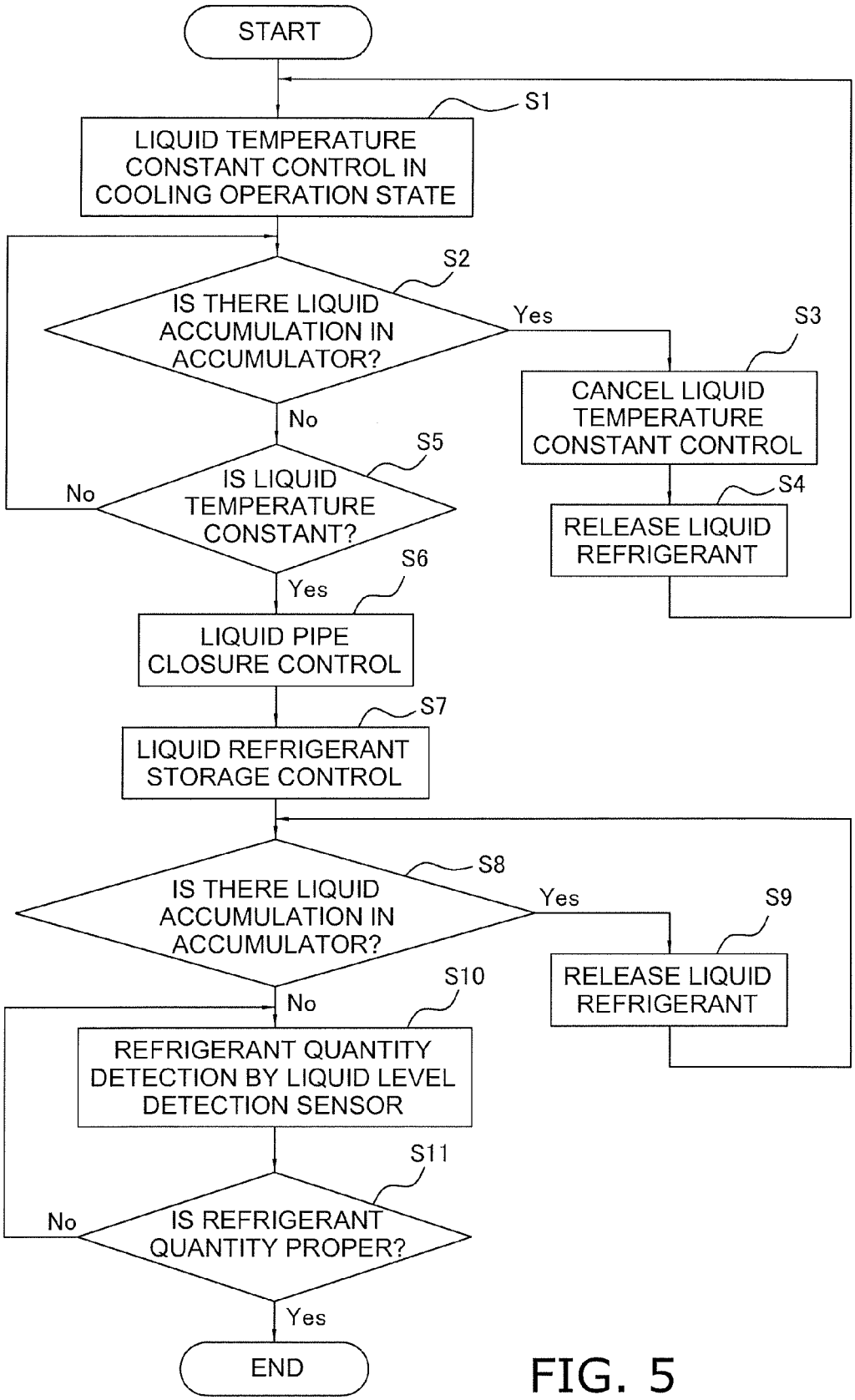
FIG. 5 is a flowchart of refrigerant quantity determination operation.
Figure 7:
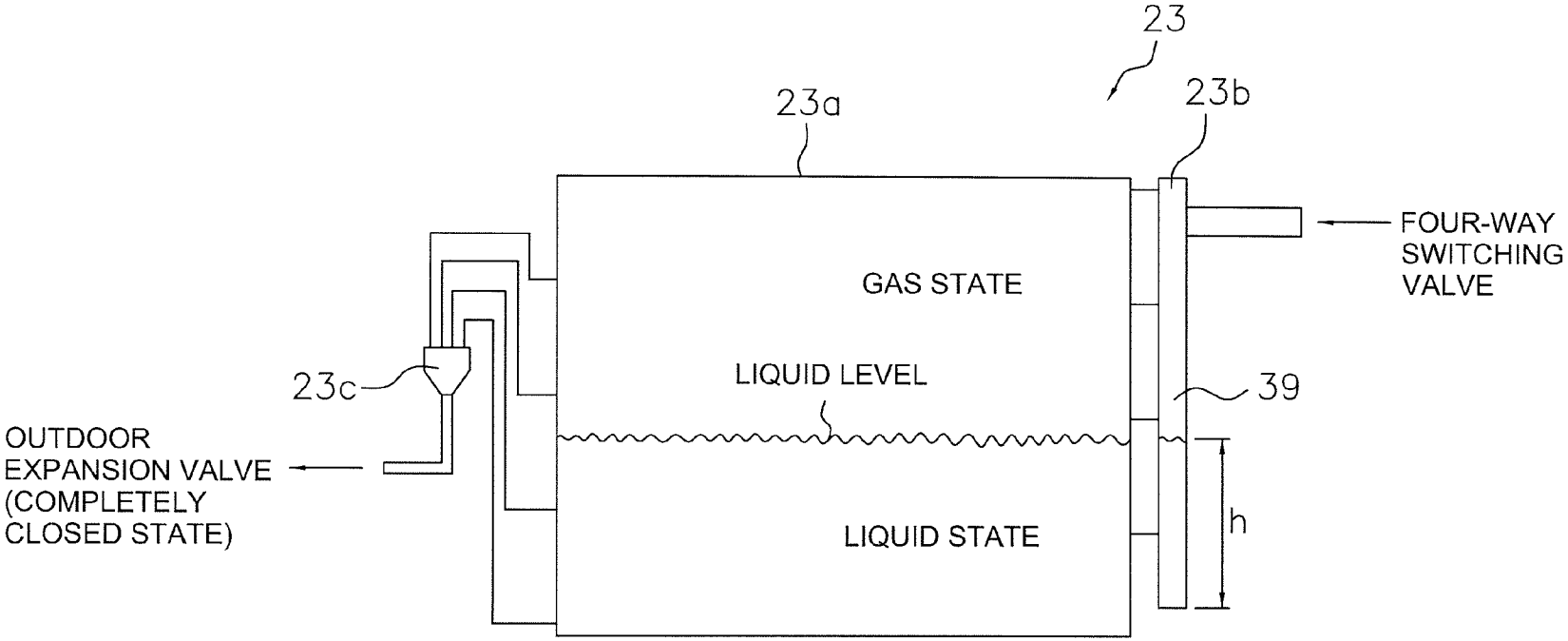
FIG. 7 is a diagram schematically showing the insides of a body of the heat exchanger and a header of FIG. 2 and showing the refrigerant accumulating in the outdoor heat exchanger in the refrigerant quantity determination operation.
Figure 8:
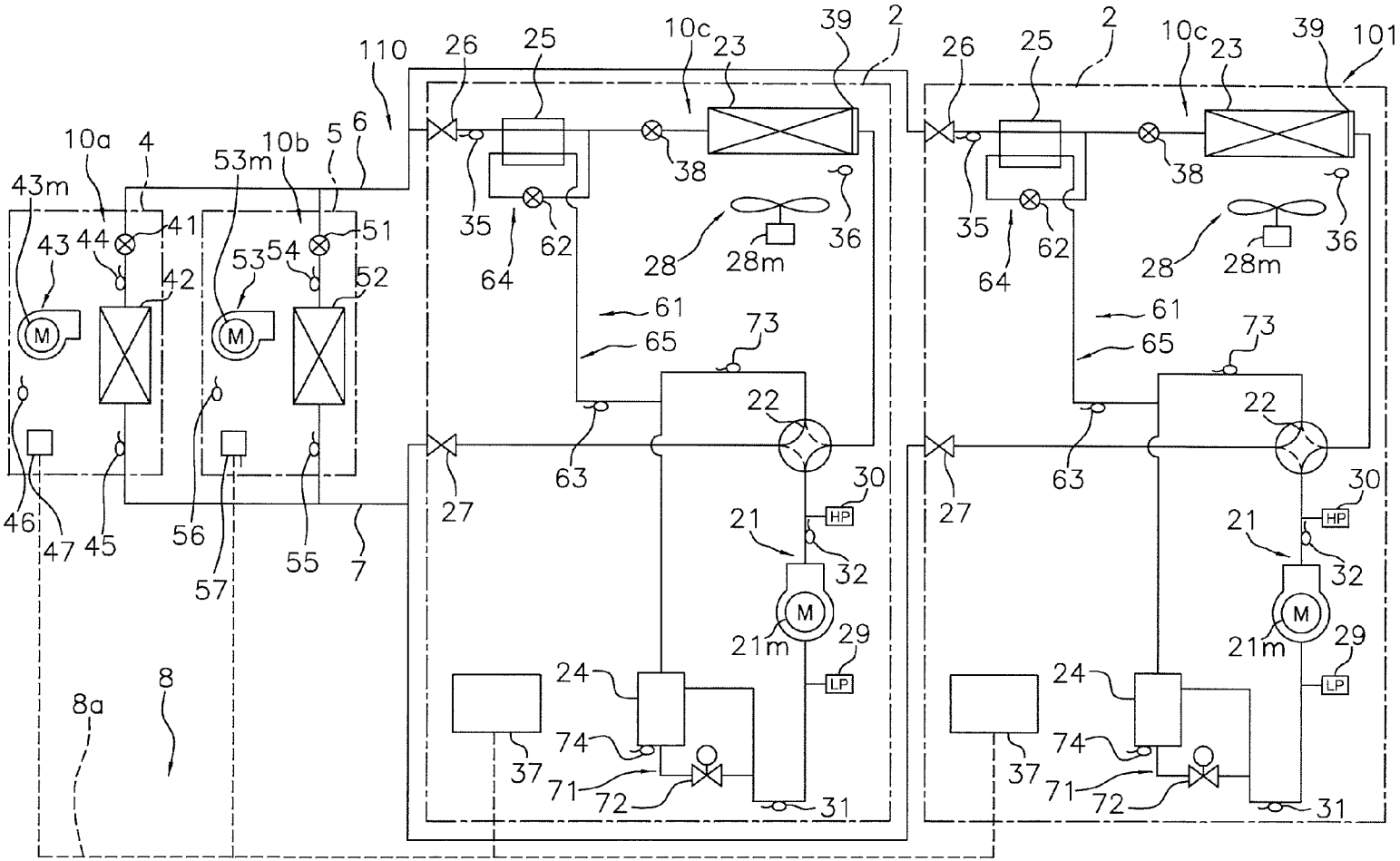
FIG. 8 is a general configuration diagram of an air conditioning apparatus pertaining to a second embodiment.
Figure 9:
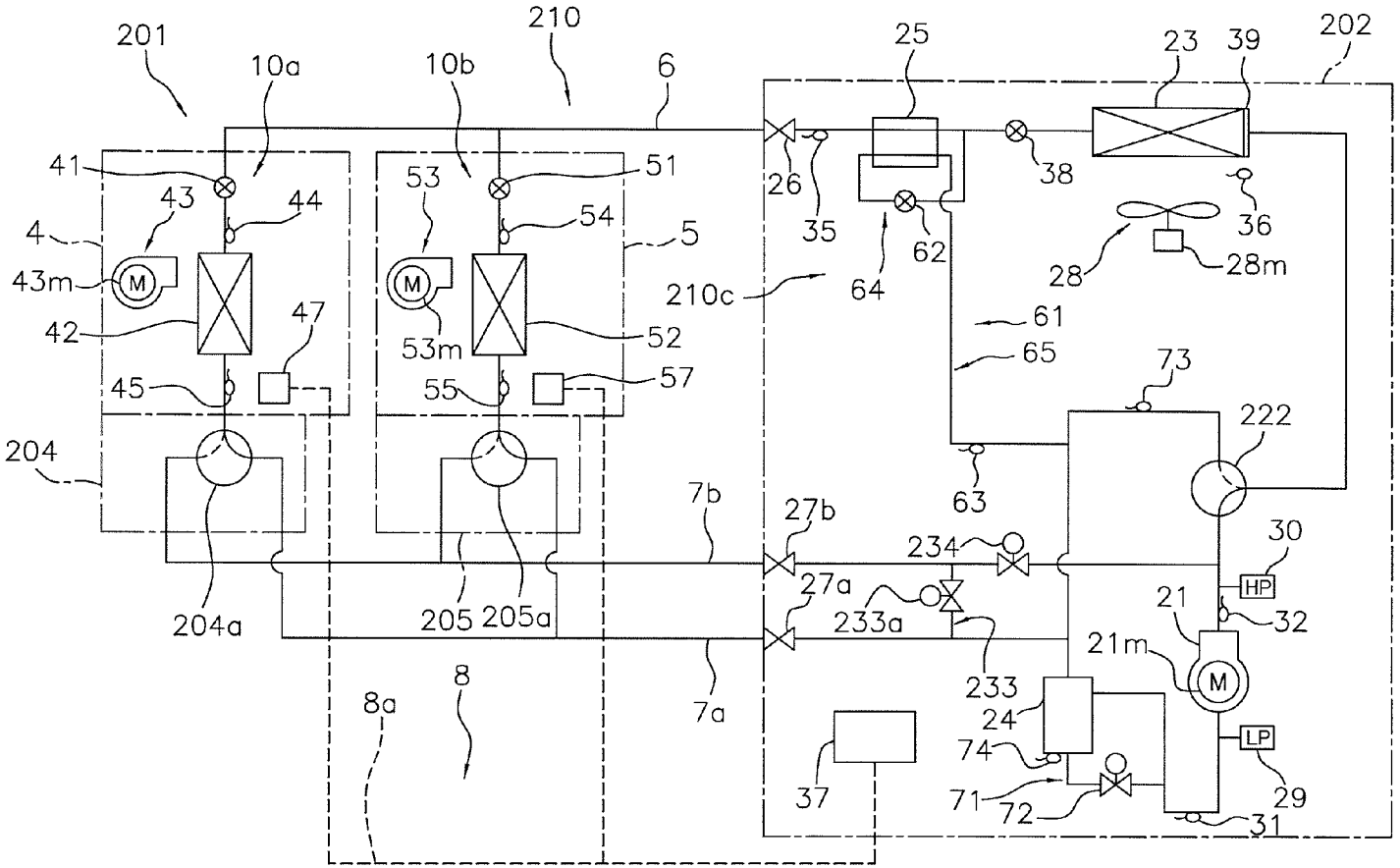
FIG. 9 is a general configuration diagram of an air conditioning apparatus pertaining to a third embodiment.

Next, the automatic refrigerant charging operation mode performed at the time of test operation will be described using FIG. 5 to FIG. 7. Here, FIG. 5 is a flowchart of refrigerant quantity determination operation. FIG. 6 is a schematic diagram showing states of the refrigerant flowing through the inside of the refrigerant circuit 10 in the refrigerant quantity determination operation. FIG. 7 is a diagram schematically showing the insides of the heat exchanger body 23*a* and the header 23*b* of FIG. 2 and shows the refrigerant accumulating in the outdoor heat exchanger 23 in the refrigerant quantity determination operation.

The automatic refrigerant charging operation mode is an operation mode performed at the time of test operation, for example, after installation of the configural devices of the air conditioning apparatus 1 and is a mode where the refrigerant circuit 10 is automatically charged with the proper quantity of the refrigerant corresponding to the volumes of the liquid refrigerant connection pipe 6 and the gas refrigerant connection pipe 7.

First, the liquid-side stop valve 26 and the gas-side stop valve 27 of the outdoor unit 2 are opened and the refrigerant with which the outdoor unit 2 is charged beforehand is allowed to fill the inside of the refrigerant circuit 10.

Next, the worker performing the automatic refrigerant charging operation connects a refrigerant canister for additional charging to the refrigerant circuit 10 (for example, the suction side of the compressor 21) and starts charging.

Then, when the worker issues, directly or with a remote controller (not shown) or the like, a command to the controller 8 to start the automatic refrigerant charging operation, the refrigerant quantity determination operation and determination of the properness of the refrigerant quantity accompanied by the processing of step S1 to step S11 shown in FIG. 5 are performed by the controller 8.

—Step S1: Liquid Temperature Constant Control—

First, in step S1, liquid temperature constant control is started in the cooling operation state, and basically device control is performed such that the controller 8 performs the same operation as the cooling operation in the normal operation mode described above. However, what differs from the cooling operation in the normal operation mode is that the controller 8 performs liquid temperature constant control. In this liquid temperature constant control, condensation pressure control and liquid pipe temperature control are performed. In the condensation pressure control, the controller 8 controls the volume of the outdoor air supplied to the outdoor heat exchanger 23 by the outdoor fan 28 such that the condensation pressure of the refrigerant in the outdoor heat exchanger 23 becomes constant. The condensation pressure of the refrigerant in the condenser is greatly changed by the affect of the outdoor temperature, so the controller 8 controls the volume of the room air supplied to the outdoor heat exchanger 23 from the outdoor fan 28 by the motor 28*m*. Thus, the condensation pressure of the refrigerant in the outdoor heat exchanger 23 becomes constant, and the state of the refrigerant flowing through the inside of the condenser stabilizes. Additionally, the high-pressure liquid refrigerant flows in the flow path including the outdoor expansion valve 38, the portion on the main refrigerant circuit side of the supercooler 25 and the liquid refrigerant connection pipe 6 between the outdoor heat exchanger 23 and the indoor expansion valves 41 and 51 and in the flow path from the outdoor heat exchanger 23 to the bypass expansion valve 62 of the first bypass refrigerant pipe 61. Thus, the pressure of the refrigerant in the portion from the outdoor heat exchanger 23 to the indoor expansion valves 41 and 51 and the bypass expansion valve 62 also becomes stable. In the condensation pressure control of the present embodiment, the discharge pressure of the compressor 21 detected by the discharge pressure sensor 30 is used as the condensation pressure. Although it is not employed in the present embodiment, a temperature sensor that detects the temperature of the refrigerant flowing through the inside of the outdoor heat exchanger 23 may also be disposed, and the refrigerant temperature value corresponding to the condensation temperature detected by this temperature sensor may be converted into the condensation pressure and used in the condensation pressure control. In the liquid pipe temperature control, in contrast to the degree of superheating control in the cooling operation in the normal operation mode described above, the controller 8 controls the ability of the supercooler 25 such that the temperature of the refrigerant sent from the supercooler 25 to the indoor expansion valves 41 and 51 becomes constant. More specifically, in the liquid pipe temperature control, the controller 8 regulates the opening degree of the bypass expansion valve 62 of the first bypass refrigerant pipe 61 such that the temperature of the refrigerant detected by the liquid pipe temperature sensor 35 disposed in the outlet on the main refrigerant circuit side of the supercooler 25 becomes constant at a liquid pipe temperature target value. Thus, the density of the refrigerant inside the refrigerant pipe including the liquid refrigerant connection pipe 6 from the outlet on the main refrigerant circuit side of the supercooler 25 to the indoor expansion valves 41 and 51 stabilizes.

—Step S2: Determination of Liquid Accumulation Inside Accumulator—

In step S2, during this liquid temperature constant control, the controller 8 determines whether or not liquid refrigerant is accumulating in the accumulator 24 on the basis of the temperature difference hereinafter, referred as an inlet/outlet temperature between the temperature of the pipe on the inlet side of the accumulator 24 (that is, the gas pipe temperature) detected by the gas pipe temperature sensor 73 and the temperature of the pipe on the outlet side of the accumulator 24 (that is, the suction temperature) detected by the suction temperature sensor 31. Specifically, the controller 8 determines that the liquid refrigerant is accumulating in the accumulator 24 when this inlet/outlet temperature difference becomes equal to or greater than a predetermined temperature difference. Thus, the controller 8. which functions as an operation controlling means, further functions as a liquid refrigerant accumulation determining device or means. In step S2, when it is determined that liquid refrigerant is accumulating in the accumulator 24, the controller 8 moves to step S3, and when it is determined that liquid refrigerant is not accumulating in the accumulator 24, the controller 8 moves to step S5.

—Step S3: Cancellation of Liquid Temperature Constant Control—

In step S3, the controller 8 cancels the liquid temperature constant control it started in step S1. Specifically, the controller 8 decreases the opening degrees of the indoor expansion valves 41 and 51. When the processing of step S3 ends, the controller 8 moves to step S4.

—Step S4: Release of Liquid Refrigerant—

In step S4, the controller 8 opens the refrigerant release valve 72 disposed in the second bypass refrigerant pipe 71 and releases the liquid refrigerant accumulating in the accumulator 24 to the compressor 21. Thus, the controller 8 can quickly release the liquid refrigerant accumulating in the accumulator 24 during the liquid temperature constant control. The controller 8 closes the refrigerant release valve 72 when release of the liquid refrigerant accumulating in the accumulator 24 ends. When the processing of step S4 ends, the controller 8 returns to step S1, and the liquid temperature constant control is again started.

In this manner, in step S2, when it has been determined that the liquid refrigerant is accumulating in the accumulator 24, the controller 8 temporarily cancels the liquid temperature constant control, narrows the indoor expansion valves 41 and 51, and opens the refrigerant release valve 72 by the processing of step S3 and step S4. By performing this processing, the controller 8 can restrict liquid refrigerant which has the potential to flow into the accumulator 24 from the indoor heat exchangers 42 and 52 and can efficiently release the liquid refrigerant from the accumulator 24. Although it is not employed in the present embodiment, in the processing of step S3, the controller 8 may also cancel the liquid temperature constant control not only by narrowing the indoor expansion valves 41 and 51 but also by narrowing the bypass expansion valve 62. In this case, the controller 8 can also restrict inflow of the liquid refrigerant from the supercooler 25, so the controller 8 can more efficiently release the liquid refrigerant from the accumulator 24. Further, the controller 8 performs this control to cancel the liquid temperature constant control in step S3 with the purpose of temporarily cancelling the liquid temperature constant control and restricting inflow of the liquid refrigerant into the accumulator 24, so it suffices for the controller 8 to perform this control by controlling either the indoor expansion valves 41 and 51 or the bypass expansion valve 62 described above, and this control is not limited as described above.

—Step S5: Determination of Whether or not Liquid Temperature is Constant—

Then, step S5 is performed when the controller 8 has determined in step S2 that liquid refrigerant is not accumulating in the accumulator 24, and the controller 8 judges whether or not the liquid temperature has become constant by performing the liquid temperature constant control of step S1. Here, when it is judged that the liquid temperature has become constant, the controller 8 moves to step S6, and when it is judged that the liquid temperature has not yet become constant, the liquid temperature constant control of step S1 is continued and the controller 8 returns to the processing of step S2. Additionally, when the liquid temperature is controlled to a constant by the liquid temperature constant control, the inside of the refrigerant pipe including the liquid refrigerant connection pipe 6 from the outlet on the main refrigerant circuit side of the supercooler 25 to the indoor expansion valves 41 and 51 of the filled-in hatching portions in FIG. 4 becomes stably sealed by a liquid refrigerant of a constant temperature.

—Step S6: Liquid Pipe Closure Control—

Thus, before the indoor expansion valves 41 and 51 and the outdoor expansion valve 38 seal the liquid refrigerant in the portion of the refrigerant circuit 10 between the indoor expansion valves 41 and 51 and the outdoor expansion valve 38 including the liquid refrigerant connection pipe 6 in step S6 described later, the temperature of the refrigerant sent from the outdoor heat exchanger 23 through the liquid refrigerant connection pipe 6 to the indoor expansion valves 41 and 51 is regulated to be constant by the supercooler, and the liquid pipe fixed refrigerant quantity Y that is a fixed quantity of the refrigerant in the liquid refrigerant pipe portion becomes held.

Next, in step S6, the controller 8 places the indoor expansion valves 41 and 51 in a completely closed state, places the bypass expansion valve 62 in a completely closed state and places the outdoor expansion valve 38 in a completely closed state to thereby seal the liquid refrigerant in the portion of the refrigerant circuit 10 between the indoor expansion valves 41 and 51 and the outdoor expansion valve 38 including the liquid refrigerant connection pipe 6 (liquid pipe closure control). Thus, the controller 8 can cause circulation of the refrigerant to cease, with the liquid pipe fixed refrigerant quantity Y being held as is, and seal, in the portion of the refrigerant circuit 10 between the indoor expansion valves 41 and 51 and the outdoor expansion valve 38 including the liquid refrigerant connection pipe 6, the liquid refrigerant of the accurate liquid pipe fixed refrigerant quantity Y where the temperature of the refrigerant has also been considered. When step S6 ends, the controller 8 moves to step S7.

—Step S7: Liquid Refrigerant Storage Control—

Then, in step S7, control where the controller 8 continues operation of the compressor 21 and the outdoor fan 28 even after the controller 8 has placed each of the expansion valves 38, 41 and 51 in a completely closed state (hereinafter called liquid refrigerant storage control) is performed. Thus, as shown in FIG. 6, the refrigerant that has been condensed in the outdoor heat exchanger 23 functioning as a condenser is cooled and condensed in the outdoor heat exchanger 23 by the outdoor air supplied by the outdoor fan 28 and gradually accumulates in the portion of the refrigerant circuit 10 on the upstream side of the outdoor expansion valve 38 and on the downstream side of the compressor 21 such as in the outdoor heat exchanger 23 because circulation of the refrigerant inside the refrigerant circuit 10 has ceased because of the outdoor expansion valve 38. Thus, the refrigerant inside the refrigerant circuit 10 becomes intensively collected in the portion of the refrigerant circuit 10 on the upstream side of the outdoor expansion valve 38 and on the downstream side of the compressor 21. More specifically, as shown in FIG. 7, the refrigerant that has been condensed into a liquid state accumulates from the upstream side of the outdoor expansion valve 38 inside the outdoor heat exchanger 23. As described above, the controller 8 seals the liquid refrigerant in the portion of the refrigerant circuit 10 between the indoor expansion valves 41 and 51 and the outdoor expansion valve 38 including the liquid refrigerant connection pipe 6, so the quantity of the liquid refrigerant accumulating from the upstream side of the outdoor expansion valve 38 inside the outdoor heat exchanger 23 in the cooling operation in the normal operation mode does not become excessive.

—Step S8: Determination of Liquid Accumulation Inside Accumulator—

In step S8, during the liquid refrigerant storage control, the controller 8 determines whether or not liquid refrigerant is accumulating in the accumulator 24 on the basis of the accumulator temperature detected by the accumulator temperature sensor 74. Specifically, the controller 8 determines that liquid refrigerant is accumulating in the accumulator 24 when the accumulator temperature becomes equal to or less than a predetermined temperature. In step S8, when it is determined that liquid refrigerant is accumulating in the accumulator 24, the controller 8 moves to step S9, and when it is determined that liquid refrigerant is not accumulating in the accumulator 24, the controller 8 moves to step S10.

—Step S9: Release of Liquid Refrigerant—

In step S9, the controller 8 opens the refrigerant release valve 72 disposed in the second bypass refrigerant pipe 71 and releases the liquid refrigerant accumulating in the accumulator 24 to the compressor 21. Thus, the controller 8 can quickly release the liquid refrigerant accumulating in the accumulator 24 during the liquid temperature constant control. The controller 8 closes the refrigerant release valve 72 when release of the liquid refrigerant accumulating in the accumulator 24 ends. When the processing of step S9 ends, the controller 8 returns to step S8.

—Step S10: Detection of Refrigerant Quantity—

Further, in step S10, the liquid level detection sensor 39 detects the liquid level of the refrigerant accumulating in the outdoor heat exchanger 23. Here, the liquid level detection sensor 39 detects, as the liquid level, the boundary between the region where the refrigerant exists in the gas state and the region where the refrigerant exists in the liquid state. Thus, the controller 8 calculates the quantity of the refrigerant accumulated in the outdoor heat exchanger 23 from the outdoor expansion valve 38 by assigning the height h of the liquid level obtained by the liquid level detection sensor 39 (see FIG. 7) to the relational expression stored in the memory of the controller 8.

—Step S11: Determination of Properness of Refrigerant Quantity—

Next, in step S11, the controller 8 judges whether or not the refrigerant quantity calculated in step S10 described above has reached the outdoor heat exchange collected refrigerant quantity X stored in the memory of the controller 8. Here, when the refrigerant quantity has not reached the outdoor heat exchange collected refrigerant quantity X, the controller 8 returns to the processing of step S10 and continues charging the refrigerant circuit 10 with the refrigerant, and when the controller 8 has judged that the refrigerant quantity has reached the outdoor heat exchange collected refrigerant quantity X, the controller 8 ends charging the refrigerant circuit 10 with the refrigerant. Thus, the controller 8 can detect, with the liquid level detection sensor 39, the state quantity relating to the quantity of the refrigerant that has been collected in the portion of the refrigerant circuit 10 on the upstream side of the outdoor expansion valve 38 and on the downstream side of the compressor 21, can perform determination of the proper refrigerant quantity, and becomes capable of performing determination of the proper refrigerant quantity while making the condition for performing determination relating to the refrigerant quantity simple.

In this manner, in the air conditioning apparatus 1, as described above, the liquid temperature constant control is performed by step S1, the liquid pipe closure control is performed by step S6 thereafter, and the liquid refrigerant storage control is performed by step S7. Additionally, because of the processing of steps S10 and S11 described above, the controller 8 can detect the state quantity relating to the quantity of the refrigerant existing on the upstream side of the outdoor expansion valve 38 and can determine the properness of the quantity of the refrigerant inside the refrigerant circuit 10 on the basis of the state quantity relating to the quantity of the refrigerant that the liquid level detection sensor 39 has detected in the refrigerant quantity determination operation.

Processing such as these controls is performed by the controller 8 (more specifically, the indoor-side controllers 47 and 57, the outdoor-side controller 37, and the transmission line 8*a* that interconnects the controllers 37, 47 and 57), which functions as operation controlling means that performs the refrigerant quantity determination operation and as a refrigerant quantity determining device or means that determines the properness of the quantity of the refrigerant inside the refrigerant circuit 10.

In the present embodiment, by performing the liquid temperature constant control (particularly the liquid pipe temperature control), the controller 8 always seals a constant quantity of the refrigerant in the portion of the refrigerant circuit 10 between the utilization-side expansion mechanism and the shut-off mechanism including the liquid refrigerant connection pipe 6, so even when the length of the liquid refrigerant connection pipe 6 configuring the refrigerant circuit 10 is long and the quantity of the refrigerant sealed in the liquid refrigerant connection pipe 6 by the processing of step S6 is relatively large, the controller 8 can seal an accurate quantity of the refrigerant in the liquid refrigerant connection pipe 6, and thus the controller 8 can suppress affects with respect to the quantity of the refrigerant in the portion of the refrigerant circuit 10 on the upstream side of the outdoor expansion valve 38 and on the downstream side of the compressor 21 and can perform stable detection of the state quantity relating to the refrigerant quantity with the liquid level detection sensor 39, but when the length of the liquid refrigerant connection pipe 6 configuring the refrigerant circuit 10 is short and the quantity of the refrigerant sealed in the liquid refrigerant connection pipe 6 by the processing of step S6 is small, affects with respect to the quantity of the refrigerant in the portion of the refrigerant circuit 10 on the upstream side of the outdoor expansion valve 38 and on the downstream side of the compressor 21 are small, so it is not invariably necessary for the controller 8 to perform the liquid temperature constant control (particularly the liquid pipe temperature control), and the processing of step S6 may also be omitted.

<Refrigerant Leak Detection Operation Mode>

Next, the refrigerant leak detection operation mode will be described.

The refrigerant leak detection operation mode is substantially the same as the automatic refrigerant charging operation mode excluding being accompanied by refrigerant charging work, so only the differences will be described.

In the present embodiment, the refrigerant leak detection operation mode is, for example, operation performed periodically (a time frame when it is not necessary to perform air conditioning, such as a holiday or late at night) when detecting whether or not the refrigerant is leaking to the outside from the refrigerant circuit 10 due to some accidental cause.

In the refrigerant leak operation, the same processing as the processing of the flowchart of the automatic refrigerant charging operation mentioned above.

That is, the controller 8 performs the liquid temperature constant control in the cooling operation state or the heating operation state in the refrigerant circuit 10 and, when the liquid temperature has become constant, places the indoor expansion valves 41 and 51 and the liquid-side stop valve 26 in a completely closed state to fix the liquid pipe fixed refrigerant quantity Y (see step S1 to step S6). Further, together with operation of the indoor expansion valves 41 and 51 and the liquid-side stop valve 26, the refrigerant quantity determination operation where the controller 8 accumulates the liquid refrigerant in the outdoor heat exchanger 23 by placing the bypass expansion valve 62 in a completely open state, placing the outdoor expansion valve 38 in a completely closed state and sustaining the cooling operation is performed.

Here, when the liquid level height h resulting from the liquid level detection sensor 39 is maintained as is without it changing during a predetermined amount of time, the liquid level height h at that time is assigned to the relational expression stored in the memory of the controller 8 to calculate a determined liquid refrigerant quantity X' accumulating in the outdoor heat exchanger 23 from the outdoor expansion valve 38. Here, it is judged whether or not there is a refrigerant leak in the refrigerant circuit 10 depending on whether or not the sum of the determined liquid refrigerant quantity X' that has been calculated and the liquid pipe fixed refrigerant quantity Y is equal to the proper refrigerant quantity Z.

After data of the liquid level height h have been acquired without the liquid level height h changing during the predetermined amount of time, operation of the compressor 21 is quickly stopped. Thus, the refrigerant leak detection operation is ended.

Further, determination of refrigerant leak detection is not limited to the method that calculates the determined liquid refrigerant quantity X' described above; for example, a reference liquid level height H corresponding to an optimum refrigerant quantity may also be calculated beforehand and stored in the memory of the controller 8, so that it is not necessary to perform calculation of the determined liquid refrigerant quantity X' described above, and the refrigerant leak detection may be performed by directly comparing the liquid level height h that is detected to the reference liquid level height H that becomes an index.

(3) Characteristics of Air Conditioning Apparatus

The air conditioning apparatus 1 of the first embodiment has the following characteristics.

(3-1)

In the air conditioning apparatus 1 of the present embodiment, at the time when the refrigerant circuit 10 performs the cooling operation, when the outdoor expansion valve 38 disposed on the downstream side of the outdoor heat exchanger 23 is closed and the flow of the refrigerant is shut off, liquid refrigerant that has been condensed in the outdoor heat exchanger 23 functioning as a condenser, for example, accumulates on the upstream side of the outdoor expansion valve 38 mainly inside the outdoor heat exchanger 23 because circulation of the refrigerant has ceased. When the compressor 21 is driven in the cooling operation state, the portion of the refrigerant circuit 10 on the downstream side of the outdoor expansion valve 38 and on the upstream side of the compressor 21 (specifically, the indoor heat exchangers 42 and 52 and the gas refrigerant connection pipe 6) is depressurized, and the refrigerant becomes virtually nonexistent therein. For this reason, the refrigerant in the refrigerant circuit 10 is intensively collected on the upstream side of the outdoor expansion valve 38, and the liquid level detection sensor 39 performs detection relating to this intensively collected refrigerant quantity. Additionally, in this air conditioning apparatus 1, the controller 8 determines whether or not liquid refrigerant is accumulating in the accumulator 24, and when it has been determined that liquid refrigerant is accumulating in the accumulator, the controller 8 opens the refrigerant release valve 72 to thereby open the flow path of the second bypass refrigerant pipe 71 and release the liquid refrigerant accumulating in the accumulator 24. During the liquid temperature constant control, the controller 8 determines that liquid refrigerant is accumulating in the accumulator 24 when the inlet/outlet temperature difference between the gas pipe temperature that the gas pipe temperature sensor 73 detects and the suction temperature that the suction temperature sensor 31 detects is equal to or greater than a predetermined temperature difference, and during the liquid refrigerant storage control after the liquid pipe closure control, the controller 8 determines that liquid refrigerant is accumulating in the accumulator 24 when the accumulator temperature that the accumulator temperature sensor 74 detects is equal to or less than a predetermined temperature.

When the refrigerant circulates through the inside the refrigerant circuit 10 and there is a flow of the refrigerant like in the liquid temperature constant control (strictly speaking, when the flowing quantity of the refrigerant is large), when liquid refrigerant exists inside the accumulator 24, it becomes easy for a temperature difference to arise between the gas pipe temperature and the suction temperature as a result of that liquid refrigerant evaporating. In the air conditioning apparatus 1 of the present embodiment, during the liquid temperature constant control, the controller 8 determines that liquid refrigerant is accumulating in the accumulator 24 when the inlet/outlet temperature difference that is the temperature difference between the gas pipe temperature and the suction temperature is equal to or greater than a predetermined temperature difference. Consequently, the controller 8 can determine whether or not liquid refrigerant is accumulating in the accumulator 24 in the case of a state where the refrigerant is circulating in the refrigerant circuit 10 like in the liquid temperature constant control. Further, for example, in the case of a model where there are temperature sensors in pipes in front and in back of the accumulator 24, those sensors can be appropriated and production costs can be reduced. Further, in a state where the refrigerant is not circulating in the refrigerant circuit 10 and there is no flow of the refrigerant (strictly speaking, a state where the flowing quantity of the refrigerant is lower than in the case of the liquid temperature constant control) and when the pressure inside the pipe portion on the gas side between the indoor expansion valves 41 and 51 and the compressor 21 including also the accumulator 24 is low and close to a vacuum like in the liquid refrigerant storage control, when liquid refrigerant is accumulating inside the accumulator 24 the accumulator temperature becomes lower. In the air conditioning apparatus 1 of the present embodiment, the controller 8 determines whether or not liquid refrigerant is accumulating in the accumulator 24 on the basis of changes in this accumulator temperature. Consequently, when the refrigerant is not circulating that much in the refrigerant circuit 10 and the pressure of the pipe portion on the gas side is low like in the liquid refrigerant storage control, the controller 8 can relatively accurately determine that liquid refrigerant exists inside the accumulator 24. In this manner, in the air conditioning apparatus 1 of the present embodiment, when liquid refrigerant is accumulating in the accumulator 24, the controller 8 can quickly release the liquid refrigerant from the accumulator 24. For this reason, even when the controller 8 performs determination of the refrigerant quantity in a condition where liquid refrigerant easily accumulates in the accumulator, the controller 8 can perform determination of the proper quantity of the refrigerant without taking too much time.

(3-2)

In the air conditioning apparatus 1 of the present embodiment, during the liquid temperature constant control, when it has been determined that liquid refrigerant is accumulating in the accumulator 24, the controller 8 prevents as much as possible inflow of the liquid refrigerant from the indoor heat exchangers 42 and 52 into the accumulator 24 by narrowing the indoor expansion valves 41 and 51 in order to efficiently release that liquid refrigerant. During the liquid temperature constant control, the refrigerant inside the refrigerant circuit 10 is circulating, so there is the potential for liquid refrigerant that could not be evaporated by the indoor heat exchangers 42 and 52 to flow into the accumulator 24.

Consequently, the controller 8 can efficiently release the liquid refrigerant accumulating inside the accumulator. For this reason, the controller 8 can more accurately determine the properness of the quantity of the refrigerant inside the refrigerant circuit without taking time as much as possible.

(4) Modification 1

The air conditioning apparatus 1 of the first embodiment is equipped with the second bypass refrigerant pipe 71 that is capable of releasing the liquid refrigerant inside the accumulator 24 from the bottom portion of the accumulator 24 and the refrigerant release valve 72 that is capable of opening and closing the flow path of the second bypass refrigerant pipe 71, and when it is determined that liquid refrigerant is accumulating in the accumulator 24, the controller 8 opens the refrigerant release valve 72 and releases the liquid refrigerant in the accumulator 24, but the air conditioning apparatus 1 is not limited to this and does not have to be equipped with the second bypass refrigerant pipe 71 and the refrigerant release valve 72. In this case, step S4 and step S9 in the flowchart of the refrigerant quantity determination operation shown in FIG. 5 become omitted, and the controller 8 moves to the next step after verifying that liquid refrigerant is not accumulating in the accumulator 24.

Second Embodiment

Figure 11:
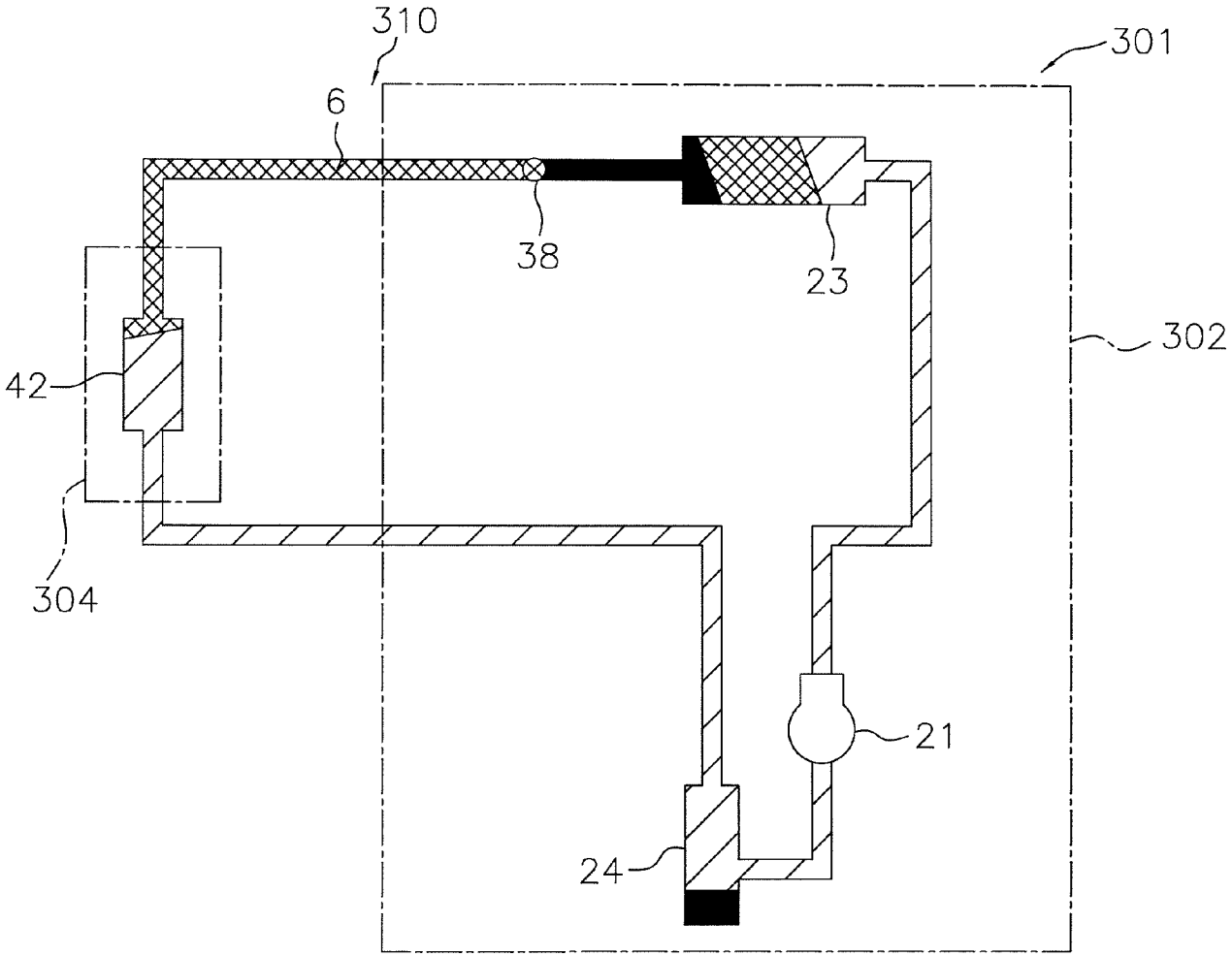
FIG. 11 is a schematic diagram showing states of refrigerant flowing through the inside of a refrigerant circuit in cooling operation.

In the air conditioning apparatus 1 of the first embodiment described above and the modifications thereof, a case where there is one outdoor unit has been taken as an example, but the invention is not limited to this and may also, for example, be given a configuration equipped with a plurality (in the present embodiment, two) of the outdoor units 2 in parallel such as in an air conditioning apparatus 101 of the present embodiment shown in FIG. 11. Here, the outdoor units 2 and the indoor units 4 and 5 have the same configurations as those of the outdoor unit 2 and the indoor units 4 and 5 in the first embodiment described above, so description will be omitted here.

In the air conditioning apparatus 101 of the present embodiment, what differs is that, in the automatic refrigerant charging operation and the refrigerant leak detection operation, detection by the liquid level detection sensors 39 is performed individually in each of the outdoor units 2 and judgment of whether or not the outdoor heat exchange collected refrigerant quantity X has accumulated is performed with respect to the quantity of the refrigerant inside the refrigerant circuit 110 where all of the outdoor units 2 are combined, but basically it is the same as determination of the properness of the quantity of the refrigerant inside the refrigerant circuit 10 in the first embodiment described above. Further, in the air conditioning apparatus 101 of the present embodiment also, the same configurations as in modifications 1 to 3 of the first embodiment described above may also be applied.

Third Embodiment

Figure 12:
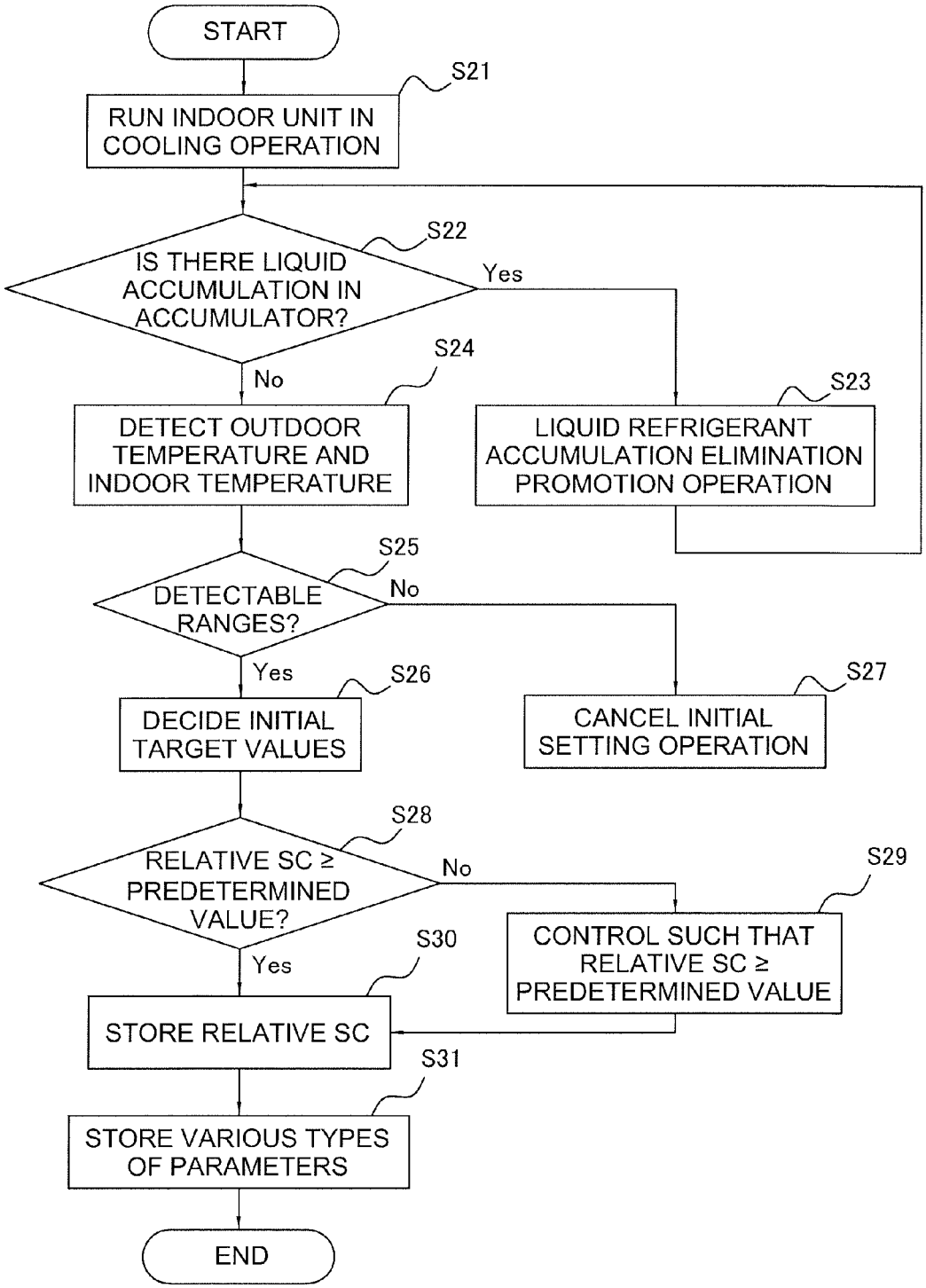
FIG. 12 is a flowchart of initial setting operation.

In the air conditioning apparatus 1 and 101 of the first and second embodiments described above and the modifications thereof, a case where the present invention is applied with respect to a configuration capable of switching between cooling operation and heating operation has been taken as an example, but the present invention is not limited to this and may also, for example, be applied with respect to a configuration capable of simultaneous cooling and heating operation depending on the demands of each of the air-conditioned spaces inside the rooms where the indoor units 4 and 5 are installed such that, for example, cooling operation is performed in regard to a certain air-conditioned space while heating operation is performed in regard to another air-conditioned space such as in an air conditioning apparatus 201 of the present embodiment shown in FIG. 12.

The air conditioning apparatus 201 of the present embodiment is mainly equipped with a plurality of (here, two) indoor units 4 and 5 serving as utilization units, an outdoor unit 202 serving as a heat source unit, and refrigerant connection pipes 6, 7*a* and 7*b*.

The indoor units 4 and 5 are connected to the outdoor unit 202 via a liquid refrigerant connection pipe 6, a suction gas refrigerant connection pipe 7*a* and a discharge gas refrigerant connection pipe 7*b* serving as gas refrigerant connection pipes, and connection units 204 and 205 and configure a refrigerant circuit 210 together with the outdoor unit 202. The indoor units 4 and 5 have the same configuration as that of the indoor units 4 and 5 in the first embodiment described above, so description will be omitted here.

The outdoor unit 202 mainly configures part of the refrigerant circuit 210 and is equipped with an outdoor-side refrigerant circuit 210*c*. The outdoor-side refrigerant circuit 210*c* mainly has a compressor 21, a three-way switching valve 222, an outdoor heat exchanger 23 serving as a heat source-side heat exchanger, a liquid level detection sensor 39 serving as a refrigerant detection mechanism, an outdoor expansion valve 38 serving as a second shut-off mechanism or an expansion mechanism, an accumulator 24, a supercooler 25 serving as a temperature regulation mechanism, a first bypass refrigerant pipe 61 serving as a cooling source of the supercooler 25 and a communication pipe, a liquid-side stop valve 26 serving as a first shut-off mechanism, a suction gas-side stop valve 27*a*, a discharge gas-side stop valve 27*b*, a high-and-low-pressure communication pipe 233, a high-pressure shut-off valve 234, and an outdoor fan 28. Here, the devices and valves excluding the three-way switching valve 222, the suction gas-side stop valve 27*a*, the discharge gas-side stop valve 27*b*, the high-and-low-pressure communication pipe 233 and the high-pressure shut-off valve 234 have the same configurations as those of the devices and valves of the outdoor unit 2 in the first embodiment described above, so description will be omitted.

The three-way switching valve 222 is a valve for switching the flow path of the refrigerant inside the outdoor-side refrigerant circuit 210*c* so as to interconnect the discharge side of the compressor 21 and the gas side of the outdoor heat exchanger 23 when the outdoor heat exchanger 23 is caused to function as a condenser (called a condensation operation state below) and so as to interconnect the suction side of the compressor 21 and the gas side of the outdoor heat exchanger 23 when the outdoor heat exchanger 23 is caused to function as an evaporator (called an evaporation operation state below). Further, the discharge gas refrigerant connection pipe 7*b* is connected via the discharge gas-side stop valve 27*b* between the discharge side of the compressor 21 and the three-way switching valve 222. Thus, the high-pressure gas refrigerant compressed in and discharged from the compressor 21 can be supplied to the indoor units 4 and 5 regardless of the switching operation of the three-way switching valve 222. Further, the suction gas refrigerant connection pipe 7*a* is connected via the suction gas-side stop valve 27*a* to the suction side of the compressor 21. Thus, the low-pressure gas refrigerant returning from the indoor units 4 and 5 can be returned to the suction side of the compressor 21 regardless of the switching operation of the three-way switching valve 222. Further, the high-and-low-pressure communication pipe 233 is a refrigerant pipe that allows the refrigerant pipe interconnecting a position between the discharge side of the compressor 21 and the three-way switching valve 222 and the discharge gas refrigerant connection pipe 7*b* and the refrigerant pipe interconnecting the suction side of the compressor 21 and the suction gas refrigerant connection pipe 7*a* to be communicated with each other and has a high/low-pressure communication valve 233*a* that is capable of shutting off passage of the refrigerant. Thus, the suction gas refrigerant connection pipe 7*a* and the discharge gas refrigerant connection pipe 7*b* can be placed in a state where they are communicated with each other as needed. Further, the high-pressure shut-off valve 234 is disposed in the refrigerant pipe interconnecting a position between the discharge side of the compressor 21 and the three-way switching valve 222 and the discharge gas refrigerant connection pipe 7*b* and enables sending of the high-pressure gas refrigerant discharged from the compressor 21 to the discharge gas refrigerant connection pipe 7*b* to be shut off as needed. In the present embodiment, the high-pressure shut-off valve 234 is placed further on the discharge side of the compressor 21 than the position where the high-and-low-pressure communication pipe 233 is connected in the refrigerant pipe interconnecting a position between the discharge side of the compressor 21 and the three-way switching valve 222 and the discharge gas refrigerant connection pipe 7*b*. In the present embodiment, the high/low-pressure communication valve 233*a* and the high-pressure shut-off valve 234 are solenoid valves. In the present embodiment, the three-way switching valve 222 is used as the mechanism for switching between the condensation operation state and the evaporation operation state, but the mechanism is not limited to this, and a mechanism configured by a four-way switching valve or a plurality of solenoid valves or the like may also be used.

Further, various types of sensors and an outdoor-side controller 37 are disposed in the outdoor unit 202, but these also have the same configurations as those of the various types of sensors and the outdoor-side controller 37 of the outdoor unit 2 in the first embodiment described above, so description will be omitted.

Further, the gas sides of the indoor heat exchangers 42 and 52 of the indoor units 4 and 5 are switchably connected to the suction gas refrigerant connection pipe 7*a* and the discharge gas refrigerant connection pipe 7*b* via the connection units 204 and 205. The connection units 204 and 205 are mainly equipped with cooling/heating switching valves 204*a* and 205*a*. The cooling/heating switching valves 204*a* and 205*a* are valves that function as switching mechanisms that perform switching between a state where they interconnect the gas sides of the indoor heat exchangers 42 and 52 of the indoor units 4 and 5 and the suction gas refrigerant connection pipe 7*a* when the indoor units 4 and 5 perform the cooling operation (called a cooling operation state below) and a state where they interconnect the gas sides of the indoor heat exchangers 42 and 52 of the indoor units 4 and 5 and the discharge gas refrigerant connection pipe 7*b* when the indoor units 4 and 5 perform the heating operation (called a heating operation state below). In the present embodiment, the cooling/heating switching valves 204*a* and 205*a* comprising three-way switching valves are used as the mechanisms for switching between the cooling operation state and the heating operation state, but the mechanisms are not limited thereto, and mechanisms configured by four-way switching valves or a plurality of solenoid valves or the like may also be used.

Because of the configuration of this air conditioning apparatus 201, it becomes possible for the indoor units 4 and 5 to perform so-called simultaneous cooling and heating operation where, for example, the indoor unit 4 performs the cooling operation while the indoor unit 5 performs the heating operation.

Additionally, the air conditioning apparatus 201 capable of this simultaneous cooling and heating operation can perform the same refrigerant quantity determination operation and determination of the properness of the refrigerant quantity as the air conditioning apparatus 1 in the first embodiment described above by placing the three-way switching valve 222 in the condensation operation state to cause the outdoor heat exchanger 23 to function as a condenser of the refrigerant and placing the cooling/heating switching valves 204*a* and 205*a* in the cooling operation state to cause the indoor heat exchangers 42 and 52 to function as evaporators of the refrigerant.

However, the air conditioning apparatus 201 of the present embodiment has the suction gas refrigerant connection pipe 7*a* and the discharge gas refrigerant connection pipe 7*b* as the gas refrigerant connection pipe 7, so when the suction gas refrigerant connection pipe 7*a* and the discharge gas refrigerant connection pipe 7*b* are not communicated with each other and the refrigerant circuit is placed in a state where it is capable of sending the high-pressure gas refrigerant discharged from the compressor 21 to the discharge gas refrigerant connection pipe 7*b* by placing the high/low-pressure communication valve 233*a* in a fully closed state and placing the high-pressure shut-off valve 234 in a fully opened state such as in the cooling operation in the normal operation mode, there is the fear that the high-pressure gas refrigerant accumulated in the discharge gas refrigerant connection pipe 7*b* will become unable to be condensed in the outdoor heat exchanger 23 and accumulated in the portion on the upstream side of the outdoor expansion valve 38 including the outdoor heat exchanger 23 and that this will have an adverse affect on the determination precision of the properness of the quantity of the refrigerant inside the refrigerant circuit 10, so in the refrigerant quantity determination operation, the suction gas refrigerant connection pipe 7*a* and the discharge gas refrigerant connection pipe 7*b* are communicated with each other to shut off sending of the high-pressure gas refrigerant discharged from the compressor 21 to the discharge gas refrigerant connection pipe 7*b* by placing the high/low-pressure communication valve 233*a* in a fully closed state and placing the high-pressure shut-off valve 234 in a fully opened state. Thus, the pressure of the refrigerant inside the discharge gas refrigerant connection pipe 7*b* becomes the same as the pressure of the refrigerant inside the suction gas refrigerant connection pipe 7*a*, and the refrigerant does not accumulate in the discharge gas refrigerant connection pipe 7*b*, so the high-pressure gas refrigerant accumulated in the discharge gas refrigerant connection pipe 7*b* can be condensed in the outdoor heat exchanger 23 and accumulated in the portion on the upstream side of the outdoor expansion valve 38 including the outdoor heat exchanger 23, and it becomes difficult for this to have an adverse affect on the determination precision of the properness of the quantity of the refrigerant inside the refrigerant circuit 10.

In this manner, the air conditioning apparatus 201 of the present embodiment differs from the air conditioning apparatus 1 in the first embodiment described above in that it performs operation where the high/low-pressure communication valve 233*a* is placed in a fully closed state and the high pressure shut-off valve 234 is placed in a fully opened state to allow the suction gas refrigerant connection pipe 7*a* and the discharge gas refrigerant connection pipe 7*b* to be communicated with each other and shut off sending of the high-pressure gas refrigerant discharged from the compressor 21 to the discharge gas refrigerant connection pipe 7*b*, but basically it is the same as determination of the properness of the quantity of the refrigerant inside the refrigerant circuit 10 in the first embodiment described above. Further, in the air conditioning apparatus 201 of the present embodiment also, the same configurations of modifications 1 to 3 of the first embodiment described above may also be applied, and it may also be given a configuration where a plurality of the outdoor units 202 are connected such as in the air conditioning apparatus 101 of the second embodiment.

Fourth Embodiment

In the air conditioning apparatus 1, 101 and 201 in the first, second and third embodiments and the modifications thereof described above, in operation where the refrigerant quantity determination operation called the automatic refrigerant charging operation and the refrigerant leak detection operation is performed, the controller 8 performs determination of the properness of the quantity of the refrigerant by placing the outdoor expansion valve 38 in a fully closed state, accumulating the liquid refrigerant in the outdoor heat exchanger 23, and detecting, with the liquid level detection sensor 39, the liquid level of the refrigerant accumulating in the outdoor heat exchanger 23, but the controller 8 is not limited to this and may also perform determination of the properness of the quantity of the refrigerant by, for example, using as an index a degree of supercooling on the outlet side of the outdoor heat exchanger 23 or a relative degree of supercooling (described later) derived from the degree of supercooling.

(1) Configuration of Air Conditioning Apparatus

Figure 10:
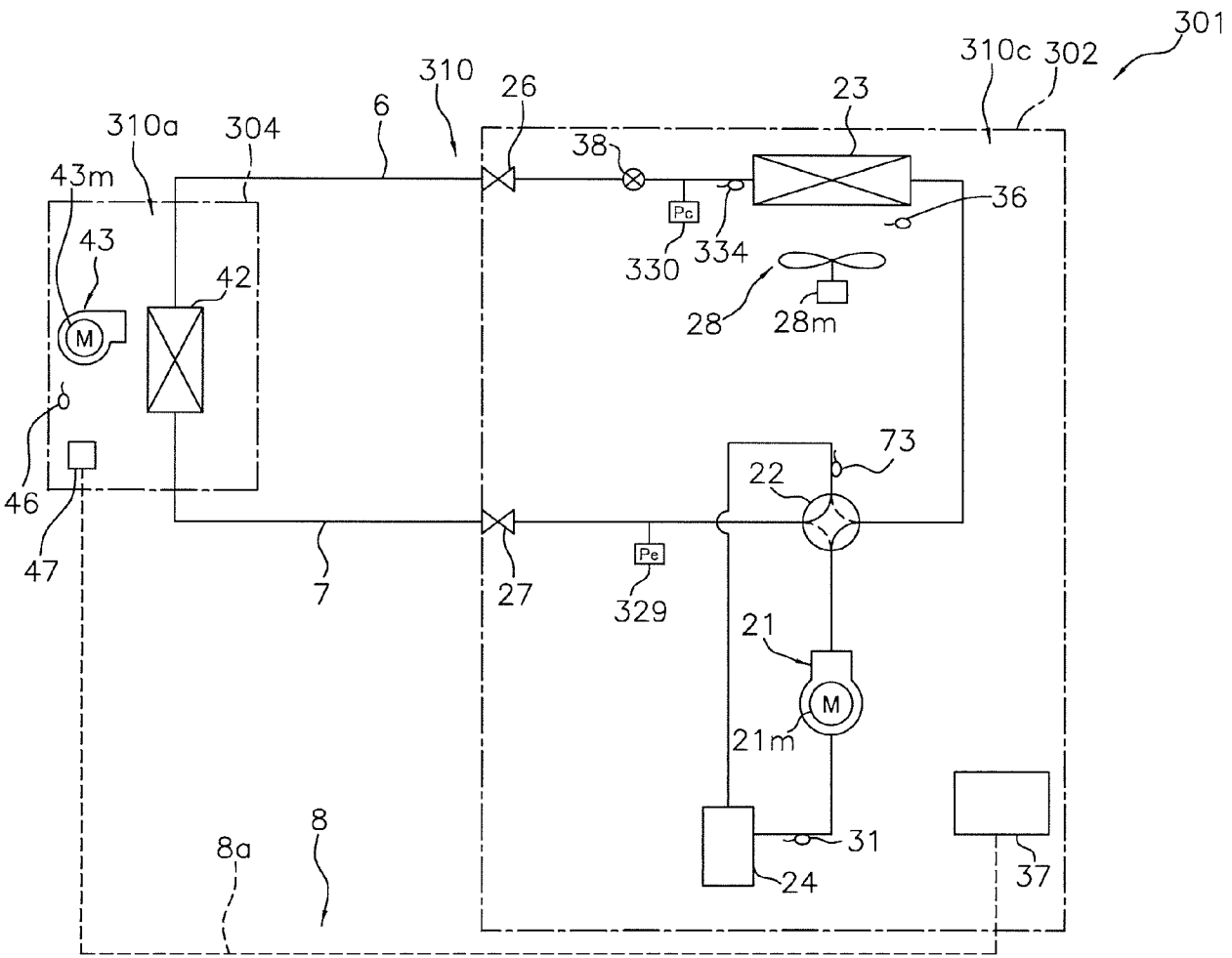
FIG. 10 is a general configuration diagram of an air conditioning apparatus pertaining to a fourth embodiment.

FIG. 10 is a general configuration diagram of an air conditioning apparatus 301 pertaining to a fourth embodiment. The air conditioning apparatus 301 of the present embodiment is mainly equipped with an indoor unit 304 serving as a utilization unit, an outdoor unit 302 serving as a heat source unit, and refrigerant connection pipes 6 and 7.

The indoor unit 304 is connected to the outdoor unit 302 via the liquid refrigerant connection pipe 6 and the gas refrigerant connection pipe 7 and configures a refrigerant circuit 310 together with the outdoor unit 302. The indoor unit 304 mainly has an indoor-side refrigerant circuit 310*a* that configures part of the refrigerant circuit 310. This indoor-side refrigerant circuit 310*a* mainly has an indoor heat exchanger 42 serving as a utilization-side heat exchanger. Here, the indoor heat exchanger 42 configuring the indoor-side refrigerant circuit 310*a* has the same configuration as that of the indoor heat exchanger 42 of the indoor unit 4 in the first embodiment described above, so description thereof will be omitted.

Further, an indoor temperature sensor 46 and an indoor-side controller 47 are disposed in the indoor unit 304, but these also have the same configurations as those of the indoor temperature sensor 46 and the indoor-side controller 47 of the indoor unit 4 in the first embodiment described above, so description thereof will be omitted.

The outdoor unit 302 mainly configures part of the refrigerant circuit 310 and is equipped with an outdoor-side refrigerant circuit 310*c*. The outdoor-side refrigerant circuit 310*c* mainly has a compressor 21, a four-way switching valve 22, an outdoor heat exchanger 23 serving as a heat source-side heat exchanger, an outdoor expansion valve 38 serving as an expansion mechanism, an accumulator 24, a liquid-side stop valve 26, a gas-side stop valve 27, and an outdoor fan 28. Here, the devices and valves 21 to 24, 38, and 26 to 28 configuring the outdoor-side refrigerant circuit 310*c* have the same configurations as those of the devices and valves 21 to 24, 38, and 26 to 28 of the outdoor unit 2 in the first embodiment described above, so description thereof will be omitted.

Further, in the outdoor unit 302, there are disposed an evaporation pressure sensor 329 that detects the pressure of the gas refrigerant flowing in from the indoor heat exchanger 42, a condensation pressure sensor 330 that detects the condensation pressure of the refrigerant condensed by the outdoor heat exchanger 23, a liquid-side temperature sensor 334 that is placed on the liquid side of the outdoor heat exchanger 23 and detects the temperature of the refrigerant in the liquid state or the gas-liquid two-phase state, a suction temperature sensor 31, an outdoor temperature sensor 36, and a gas pipe temperature sensor 73. Here, the suction temperature sensor 31, the outdoor temperature sensor 36 and the gas pipe temperature sensor 73 are the same as the suction temperature sensor 31, the outdoor temperature sensor 36 and the gas pipe temperature sensor 73 of the outdoor unit 2 in the first embodiment described above, so description thereof will be omitted. In the present embodiment, the liquid-side temperature sensor 334 comprises a thermistor.

Moreover, an outdoor-side controller 37 is disposed in the outdoor unit 302, but this also has the same configuration as that of the outdoor-side controller 37 of the outdoor unit 2 in the first embodiment described above, so description thereof will be omitted.

(2) Operation of Air Conditioning Apparatus

Next, operation of the air conditioning apparatus 301 of the present embodiment will be described.

As operation modes of the air conditioning apparatus 301 of the present embodiment, there are a normal operation mode and a refrigerant leak detection operation mode in correspondence to the air conditioning apparatus 1 in the first embodiment described above.

Operation in each operation mode of the air conditioning apparatus 301 will be described below.

<Normal Operation Mode>

First, the cooling operation in the normal operation mode will be described using FIG. 10.

During the cooling operation, the four-way switching valve 22 is in the state indicated by the solid lines in FIG. 10, that is, a state where the discharge side of the compressor 21 is connected to the gas side of the outdoor heat exchanger 23 and where the suction side of the compressor 21 is connected to the gas side of the indoor heat exchanger 42. Here, the liquid-side stop valve 26 and the gas-side stop valve 27 are placed in an open state. Further, the opening degree of the outdoor expansion valve 38 is regulated such that the degree of supercooling of the refrigerant in the outlet of the outdoor heat exchanger 23 becomes a predetermined value. In the present embodiment, the degree of supercooling of the refrigerant in the outlet of the outdoor heat exchanger 23 is detected by converting the refrigerant pressure (condensation pressure) value on the outlet side of the outdoor heat exchanger 23 detected by the condensation pressure sensor 330 into a saturation temperature value of the refrigerant and subtracting the refrigerant temperature value detected by the liquid-side temperature sensor 334 from this saturation temperature value of the refrigerant.

When the compressor 21 and the outdoor fan 28 are started in this state of the refrigerant circuit 310, low-pressure gas refrigerant is sucked into the compressor 21, compressed, and becomes high-pressure gas refrigerant. Thereafter, the high-pressure gas refrigerant is sent to the outdoor heat exchanger 23 via the four-way switching valve 22, performs heat exchange with the outdoor air supplied by the outdoor fan 28, is condensed, and becomes high-pressure liquid refrigerant. Then, the high-pressure liquid refrigerant is depressurized by the outdoor expansion valve 38, becomes low-pressure refrigerant in a gas-liquid two-phase state, and is sent to the indoor unit 304 via the liquid-side stop valve 26 and the liquid refrigerant connection pipe 6. Here, the outdoor expansion valve 38 controls the flow rate of the refrigerant flowing through the inside of the outdoor heat exchanger 23 such that the degree of supercooling in the outlet of the outdoor heat exchanger 23 becomes a predetermined value, so the high-pressure liquid refrigerant that has been condensed in the outdoor heat exchanger 23 has a predetermined degree of supercooling.

The low-pressure refrigerant in the gas-liquid two-phase state that has been sent to the indoor unit 304 is sent to the indoor heat exchanger 42 and performs heat exchange with the room air, is evaporated, and becomes low-pressure gas refrigerant in the indoor heat exchanger 42. Then, refrigerant of a flow rate corresponding to the operating load required in the air-conditioned space where the indoor unit 304 is installed flows in the indoor heat exchanger 42.

This low-pressure gas refrigerant is sent to the outdoor unit 302 via the gas refrigerant connection pipe 7 and flows into the accumulator 24 via the gas-side stop valve 26 and the four-way switching valve 22. Then, the low-pressure gas refrigerant flowing into the accumulator 24 is again sucked into the compressor 21. Here, depending on the operating load of the indoor unit 304, for example, when the operating load of the indoor unit 304 is small or when the indoor unit 304 is stopped, surplus refrigerant accumulates in the accumulator 24.

Here, the distribution state of the refrigerant in the refrigerant circuit 310 when performing the cooling operation in the normal operation mode is such that, as shown in FIG. 11, the refrigerant takes each of the states of a liquid state (the filled-in hatching portion in FIG. 11), a gas-liquid two-phase state (the grid-like hatching portions in FIG. 11) and a gas state (the diagonal line hatching portion in FIG. 11). Specifically, the portion between the vicinity of the outlet of the outdoor heat exchanger 23 and the outdoor expansion valve 38 is filled with the refrigerant in the liquid state. Additionally, the portion in the middle of the outdoor heat exchanger 23 and the portion between the outdoor expansion valve 38 and the vicinity of the inlet of the indoor heat exchanger 42 are filled with the refrigerant in the gas-liquid two-phase state. Further, the portion between the middle portion of the indoor heat exchanger 42 and the vicinity of the inlet of the outdoor heat exchanger 23 via the gas refrigerant connection pipe 7, a portion excluding part of the accumulator 24 and the compressor 21 is filled with the refrigerant in the gas state. Sometimes liquid refrigerant that has accumulated as surplus refrigerant accumulates in part of the accumulator that is excluded here. Here, FIG. 11 is a schematic diagram showing states of the refrigerant flowing through the inside of the refrigerant circuit 310 in the cooling operation.

Next, the heating operation in the normal operation mode will be described.

During the heating operation, the four-way switching valve 22 is in the state indicated by the broken lines in FIG. 10, that is, a state where the discharge side of the compressor 21 is connected to the gas side of the indoor heat exchanger 42 and where the suction side of the compressor 21 is connected to the gas side of the outdoor heat exchanger 23. The opening degree of the outdoor expansion valve 38 is regulated in order to depressurize the refrigerant flowing into the outdoor heat exchanger 23 to a pressure capable of causing the refrigerant to evaporate in the outdoor heat exchanger 23 (that is, the evaporation pressure). Further, the liquid-side stop valve 26 and the gas-side stop valve 27 are placed in an open state.

When the compressor 21 and the outdoor fan 28 are started in this state of the refrigerant circuit 310, low-pressure gas refrigerant is sucked into the compressor 21, compressed, becomes high-pressure gas refrigerant, and is sent to the indoor unit 304 via the four-way switching valve 22, the gas-side stop valve 27 and the gas refrigerant connection pipe 7.

Then, the high-pressure gas refrigerant sent to the indoor unit 304 performs heat exchange with the room air, is condensed and becomes high-pressure liquid refrigerant in the indoor heat exchanger 42 and is thereafter sent to the outdoor unit 302 via the liquid refrigerant connection pipe 6.

This high-pressure liquid refrigerant is depressurized by the outdoor expansion valve 38 via the liquid-side stop valve 26, becomes low-pressure refrigerant in a gas-liquid two-phase state, and flows into the outdoor heat exchanger 23. Then, the low-pressure refrigerant in the gas-liquid two-phase state flowing into the outdoor heat exchanger 23 performs heat exchange with the outdoor air supplied by the outdoor fan 28, is evaporated, becomes low-pressure gas refrigerant, and flows into the accumulator 24 via the four-way switching valve 22. Then, the low-pressure gas refrigerant flowing into the accumulator 24 is again sucked into the compressor 21. Here, depending on the operating load of the indoor unit 304, when a surplus refrigerant quantity occurs inside in the refrigerant circuit 310 such as, for example, when the operating load of the indoor unit 304 is small, surplus refrigerant accumulates in the accumulator like during the cooling operation.

<Refrigerant Leak Detection Operation Mode>

In the refrigerant leak detection operation mode, the operation method differs between operation that is first performed after the air conditioning apparatus 301 has been installed (hereinafter called initial setting operation) and operation from the second time on (hereinafter called determination operation). For this reason, below, the refrigerant quantity leak detection operation mode will be divided into the initial setting operation and the determination operation and described.

When the worker issues, through a remote controller (not shown) or directly with respect to the indoor-side controller 47 of the indoor unit 304 or the outdoor-side controller 37 of the outdoor unit 302, a command to perform the refrigerant leak detection operation mode after configuring the refrigerant circuit 310 by interconnecting the outdoor unit 302 charged beforehand with refrigerant and the indoor unit 304 via the liquid refrigeration connection pipe 6 and the gas refrigerant connection pipe 7 on site, the initial setting operation is performed by the procedure of step S21 to step S29 described below (see FIG. 12).

—Step S21: Running of Indoor Unit in Cooling Operation—

First, in step S21, when a command to start the initial setting operation is issued, in the refrigerant circuit 310, the four-way switching valve 22 of the outdoor unit 302 is placed in the state (cooling operation state) indicated by the solid lines in FIG. 10. Then, the outdoor fan 28 is started, and the cooling operation (the method of controlling the outdoor fan 28 differs from that of the cooling operation in the normal operation mode) is forcibly performed in regard to all of the indoor units 304 (see FIG. 11). Then, after the cooling operation is implemented a predetermined amount of time, the controller 8 moves to the next step S22.

—Step S22: Determination of Liquid Accumulation Inside Accumulator—

In step S22, during the cooling operation, the controller 8 determines whether or not liquid refrigerant is accumulating in the accumulator 24 on the basis of the temperature difference (hereinafter called an inlet/outlet temperature difference) between the temperature of the pipe on the inlet side of the accumulator 24 (that is, the gas pipe temperature) detected by the gas pipe temperature sensor 73 and the temperature of the pipe on the outlet side of the accumulator 24 (that is, the suction temperature) detected by the suction temperature sensor 31. Specifically, the controller 8 determines that liquid refrigerant is accumulating in the accumulator 24 when this inlet/outlet temperature difference becomes equal to or greater than a predetermined temperature difference. In step S22, when it is determined that liquid refrigerant is accumulating in the accumulator 24, the controller 8 moves to step S23, and when it is determined that liquid refrigerant is not accumulating in the accumulator 24, the controller 8 moves to step S24.

—Step S23: Liquid Accumulation Elimination Promotion Operation—

In step S23, the controller 8 performs operation (liquid accumulation elimination promotion operation) where the controller 8 decreases the opening degree of the outdoor expansion valve 38 as much as possible and increases the rotational frequency of the compressor 21. By decreasing the opening degree of the outdoor expansion valve 38, the controller 8 can lower low-pressure pressure and make it easier to cause the liquid refrigerant inside the accumulator 24 to evaporate. Further, by also increasing the rotational frequency of the compressor 21, the controller 8 can lower low-pressure pressure and make it easier to cause the liquid refrigerant inside the accumulator 24 to evaporate. Consequently, by performing the liquid accumulation elimination promotion operation, the controller 8 can quickly eliminate the liquid refrigerant accumulating inside the accumulator 24. After the liquid accumulation elimination promotion operation of step S23 has been implemented a predetermined amount of time, the controller 8 returns to step S22.

—Step S24: Reading of Temperatures—

In step S24, reading of the indoor temperature Tb detected by the indoor temperature sensor 46 and the outdoor temperature Ta detected by the outdoor temperature sensor is performed. When the indoor temperature Tb and the outdoor temperature Ta are detected, the controller 8 moves to the next step S25.

—Step S25: Determination of Detectable Ranges or not—

In step S25, the controller 8 determines whether the indoor temperature Tb and the outdoor temperature Ta that have been detected are within predetermined temperature ranges suitable for the refrigerant leak detection operation mode that are set beforehand (e.g., in the case of the indoor temperature, the range of Tb1<Tb<Tbu, and in the case of the outdoor temperature, the range of Ta1<Ta<Tau). In step S25, when the indoor temperature Tb and the outdoor temperature Ta are within the predetermined temperature ranges, the controller 8 moves to the next step S26, and when the indoor temperature Tb and the outdoor temperature Ta are not within the predetermined temperature ranges, the controller 8 moves to step S27.

—Step S26: Decision of Initial Target Values—

Figure 13:
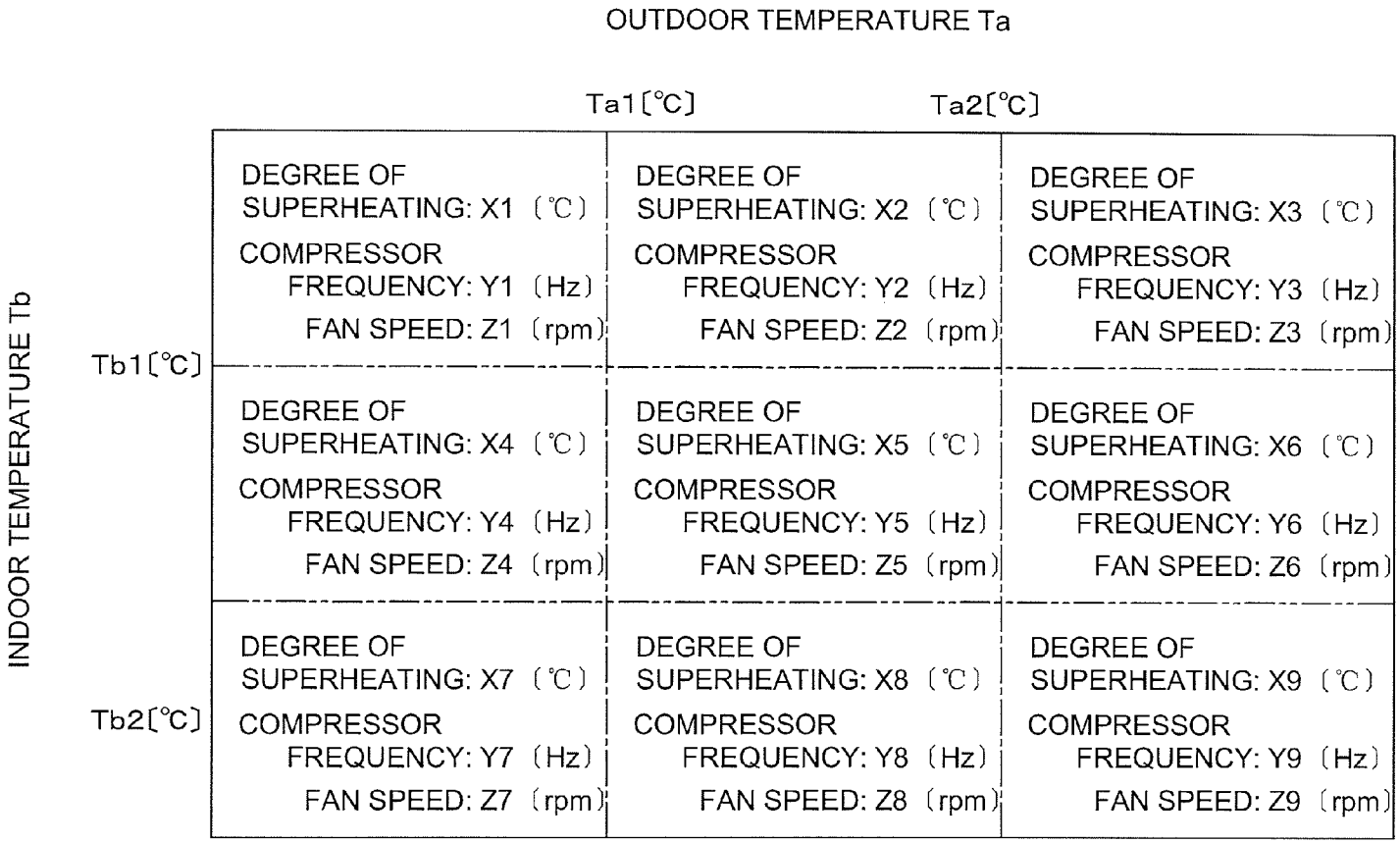
FIG. 13 is a general diagram of a map.

In step S26, on the basis of the indoor temperature Tb and the outdoor temperature Ta that have been detected, the supercooling degree of the refrigerant in the inlet of the accumulator 24, the rotational frequency of the compressor 231 and the fan speed of the outdoor fan 28 corresponding to those values are derived from a map that is set beforehand. The "map" referred to here is, as shown in FIG. 13, one where the indoor temperature Tb and the outdoor temperature Ta are associated with degrees of superheating of the refrigerant in the inlet of the accumulator 24 (written as "degree of superheating" in FIG. 13), rotational frequencies of the compressor 21 (written as "compressor frequency" in FIG. 13) and fan speeds of the outdoor fan 28 (written as "fan speed" in FIG. 13). Additionally, as for the degrees of superheating of the refrigerant in the inlet of the accumulator 24, the rotational frequencies of the compressor 21 and the fan speeds of the outdoor fan 28 in this map, values where the relative degree of supercooling becomes 0.5 when the cooling operation has been performed are set with respect to the detection values of the indoor temperature and the outdoor temperature that are detected (environmental conditions). In FIG. 13, the outdoor temperature Ta is divided into the three cases of a case where it is equal to or greater than Ta1° C. and less than Ta1° C., a case where it is equal to or greater than Ta1° C. and less than Ta2° C., and a case where it is equal to or greater than Ta2° C. and less than Tau° C., the indoor temperature Tb is divided into the three cases of a case where it is equal to or greater than Tb1° C. and less than Tb1° C., a case where it is equal to or greater than Tb1° C. and less than Tb2° C., and a case where it is equal to or greater than Tb2° C. and less than Tbu° C., so that the map is divided into nine cases. The "relative degree of supercooling value" referred to here is a value obtained by dividing the degree of supercooling value in the outlet of the outdoor heat exchanger 23 by the difference between the condensation temperature value and the outdoor temperature. Further, in the drawings, the relative degree of supercooling is written as "relative SC". The "relative degree of supercooling value" will be described in detail later. In the present embodiment, the condensation temperature value uses a value obtained by converting the pressure (condensation pressure) value on the outlet side of the outdoor heat exchanger 23 detected by the condensation pressure sensor 330 into a saturation temperature of the refrigerant. For example, when the indoor temperature Tb that has been detected is in the range of being equal to or greater than Tb1° C. and less than Tb1° C. and the outdoor temperature Ta that has been detected is in the range of being equal to or greater than Ta1° C. and less than Ta2° C., on the basis of the map of FIG. 13, the degree of superheating of the refrigerant in the inlet of the accumulator 24 is decided as X2° C., the rotational frequency of the compressor 21 is decided as Y2 Hz, and the fan speed of the outdoor fan 28 is decided as Z2 rpm. In step S26, the degree of superheating of the refrigerant in the inlet of the accumulator 24, the rotational frequency of the compressor 21 and the fan speed of the outdoor fan 28 that are derived on the basis of the indoor temperature Tb and the outdoor temperature Ta that have been detected and the map in this manner are decided as an initial degree of superheating, an initial frequency and an initial fan speed and are utilized as setting values of control in step S28.

Consequently, in the cooling operation, the controller 8 can start operation at least in a state where the relative degree of supercooling value is close to 0.5 by setting the degree of superheating of the refrigerant in the inlet of the accumulator 24 to the initial degree of superheating, setting the rotational frequency of the compressor 21 to the initial frequency, and setting the fan speed of the outdoor fan 28 to the initial fan speed.

—Step S27: Cancellation of Initial Setting Operation—

Step S27 is performed when, in contrast to step S26, the indoor temperature Tb and the outdoor temperature Ta were not within the predetermined temperature ranges in step S25, and the controller 8 displays on a display (not shown) disposed in the outdoor unit 302 or in a remote controller and the like an indication that the temperature conditions are outside the ranges of the refrigerant leak detection operation and cancels the initial setting operation.

—Step S28: Determination of Whether or not Relative Degree of Supercooling is Equal to or Greater than Predetermined Value—

In step S28, the controller 8 derives the relative degree of supercooling value and determines whether or not the relative degree of supercooling value is equal to or greater than a predetermined value (e.g., equal to or greater than 0.5). In step S28, when it is determined that the relative degree of supercooling value is less than the predetermined value, the controller 8 moves to the next step S29, and when it is determined that the relative degree of supercooling value is greater than the predetermined value, the controller 8 moves to step S30. When 10% of the refrigerant with which the inside of the refrigerant circuit is charged has leaked, the relative degree of supercooling falls 0.3, so in the present embodiment, the value of the relative degree of supercooling is equal to or greater than 0.3 as an example. That is, it is desirable for this predetermined value to be at least equal to or greater than 0.3.

—Step S29: Control of Relative Degree of Supercooling—

In step S29, the relative degree of supercooling value is less than the predetermined value, so the controller 8 controls the rotational frequency of the compressor 21 and the degree of superheating of the refrigerant in the inlet of the accumulator 24 such that the relative degree of supercooling value becomes equal to or greater than the predetermined value. For example, the controller 8 performs the cooling operation in step S21 in a state where the rotational frequency of the compressor 21 is 40 Hz as a first frequency and where the degree of superheating of the refrigerant in the inlet of the accumulator 24 is 5° C. and determines whether or not the relative degree of supercooling value is equal to or greater than the predetermined value. In this operation state, when the relative degree of supercooling value is less than the predetermined value, the controller 8 leaves the rotational frequency of the compressor 21 at 40 Hz, raises the degree of superheating of the refrigerant in the inlet of the accumulator 24 by 5° C. to 10° C., derives the relative degree of supercooling value, and determines whether or not the relative degree of supercooling value will become equal to or greater than the predetermined value. Then, when the relative degree of supercooling value is less than the predetermined value, the controller 8 repeats this, and when the relative degree of supercooling value is less than the predetermined value even when the degree of superheating of the refrigerant in the inlet of the accumulator 24 has risen as far as it can, the controller 8 raises the rotational frequency of the compressor 21 from 40 Hz to 50 Hz as a second frequency, for example, lowers the degree of superheating of the refrigerant in the inlet of the accumulator 24 to 5° C., and similarly determines whether or not the relative degree of supercooling value is equal to or greater than the predetermined value. Then, the controller 8 controls such that the relative degree of supercooling value becomes equal to or greater than the predetermined value by repeating raising again the degree of superheating of the refrigerant in the inlet of the accumulator 24 by 5° C. at a time as described above. Then, when the relative degree of supercooling value becomes equal to or greater than the predetermined value, the controller 8 moves to step S30. As for control of the degree of superheating of the refrigerant in the inlet of the accumulator 24 (e.g., control to raise the degree of superheating from 5° C. by 5° C. at a time), the controller 8 controls by narrowing the outdoor expansion valve 38 from an open state. Further, control of the degree of superheating of the refrigerant in the inlet of the accumulator 24 is not limited to this; the controller 8 may also perform this control by controlling the air volume of the indoor fan 42 or may perform this control by combining control of the valve opening degree of the outdoor expansion valve 38 and control of the air volume of the indoor fan 42. Here, the degree of superheating of the refrigerant in the inlet of the accumulator 24 is detected by subtracting, from the refrigerant temperature value detected by the gas pipe temperature sensor 73, a value obtained by converting the evaporation pressure value detected by the evaporation pressure sensor 329 into a saturation temperature value of the refrigerant. Further, here, as the degree of superheating of the refrigerant, the controller 8 utilizes the refrigerant temperature value detected by the gas pipe temperature sensor 73 placed in the inlet of the accumulator 24, but the degree of superheating of the refrigerant is not limited to this; a temperature sensor may also be disposed in the refrigerant pipe between the indoor heat exchanger 42 and the accumulator 24, and the controller 8 may utilize the refrigerant temperature value that that temperature sensor detects.

Figure 16:
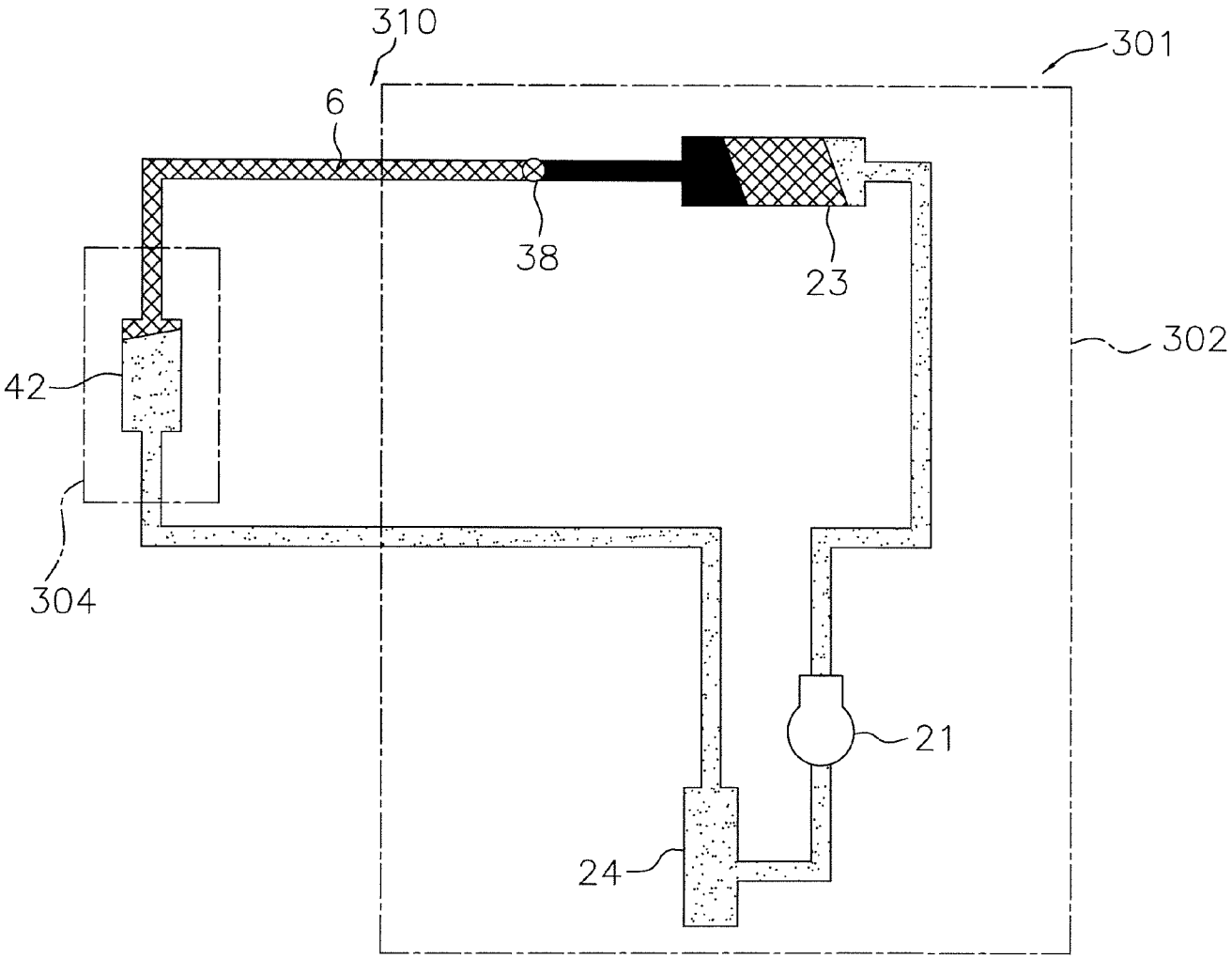
FIG. 16 is a schematic diagram showing states of the refrigerant flowing through the inside of the refrigerant circuit in a refrigerant quantity determination operation mode (initial setting operation and determination operation).

Because the degree of superheating is controlled so as to become a positive value by step S29, as shown in FIG. 16, surplus refrigerant does not accumulate in the accumulator 24, and the refrigerant that had accumulated in the accumulator 24 moves to the outdoor heat exchanger 23.

Figure 14:
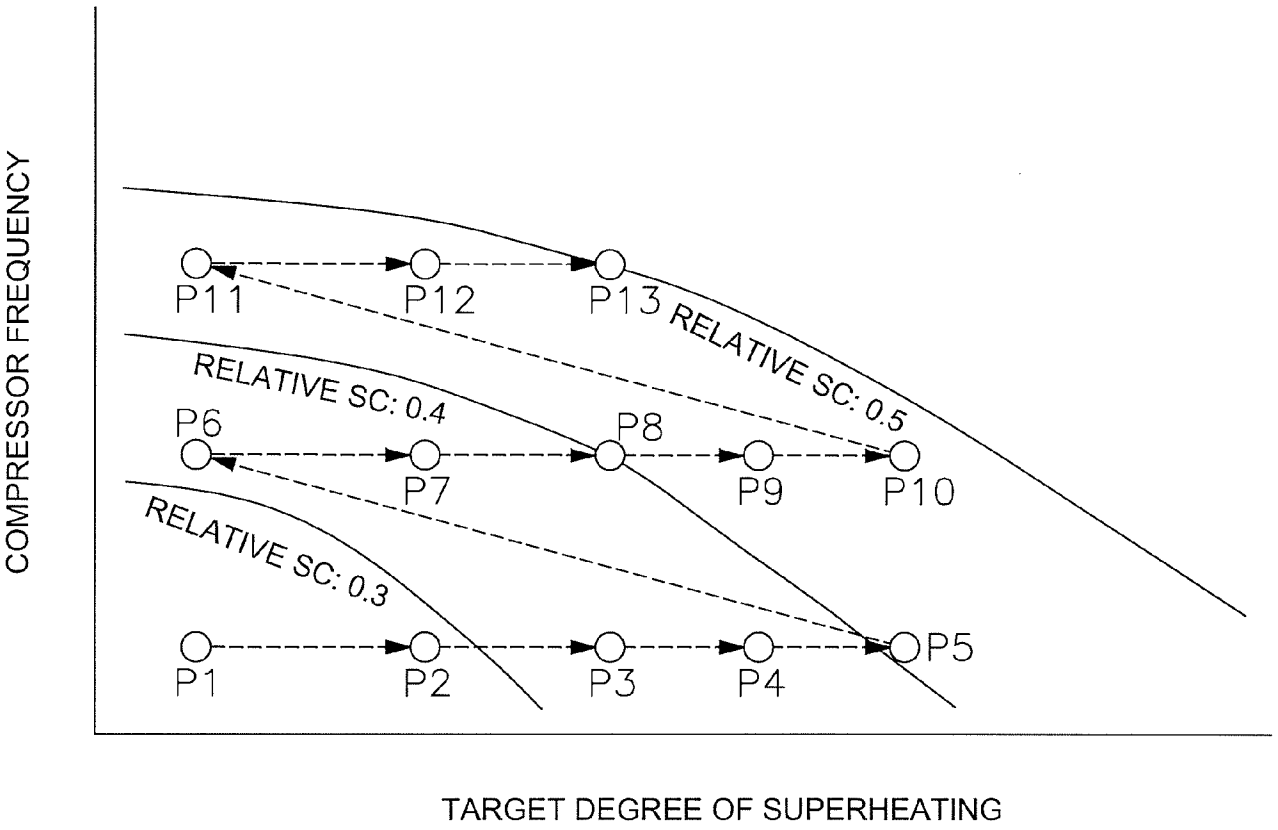
FIG. 14 is a model diagram when there is no step S26 and control of a relative degree of supercooling of step S29 has been performed without deciding initial target values.

Here, the effect of deciding the initial target values in step S26 will be described when there is no step S26 and the controller 8 does not decide the initial target values (see FIG. 14) and when the controller 8 decides the initial target values in step S26 (see FIG. 15). FIG. 14 is a model diagram when there is no step S26 and the controller 8 has performed control of the relative degree of supercooling of step S29, and FIG. 15 is a model diagram when the controller 8 has performed control of the relative degree of supercooling of step S29 via step S26.

First, when there is no step S26 and the controller 8 does not decide the initial target values, the rotational frequency of the compressor 21 and the degree of superheating of the refrigerant in the inlet of the accumulator 24 are set like at point P1 in FIG. 14, and at point P1, the relative SC is less than 0.3, so the controller 8 moves the degree of superheating of the refrigerant in the inlet of the accumulator 24 from the position of point P1 to point P2 at which the degree of superheating of the refrigerant is raised by 5° C., and detection of the relative degree of supercooling value is performed. In this manner, even when the controller 8 raises the degree of superheating of the refrigerant in the inlet of the accumulator 24 by 5° C. at a time to the position of point P5, the relative degree of supercooling value amounts to nothing more than a value slightly exceeding 0.4 and is less than 0.5, and the degree of superheating of the refrigerant in the inlet of the accumulator 24 has risen as far as it can, so next the controller 8 moves, in a state where the controller 8 has raised the rotational frequency of the compressor 21, the degree of superheating to point P6 where the degree of superheating is returned to the same state as at point P1, and the controller 8 performs detection of the relative degree of supercooling value. At point P6 also, the relative degree of supercooling value is a value slightly exceeding 0.3 and is less than 0.5, so the controller 8 moves the degree of superheating of the refrigerant in the inlet of the accumulator 24 to point P7 at which the degree of superheating is raised by 5° C. In this manner, the controller 8 performs detection of the relative degree of supercooling value and repeats detection of the relative degree of supercooling value until the relative degree of supercooling value exceeds 0.5 (eventually at point P13).

Figure 15:
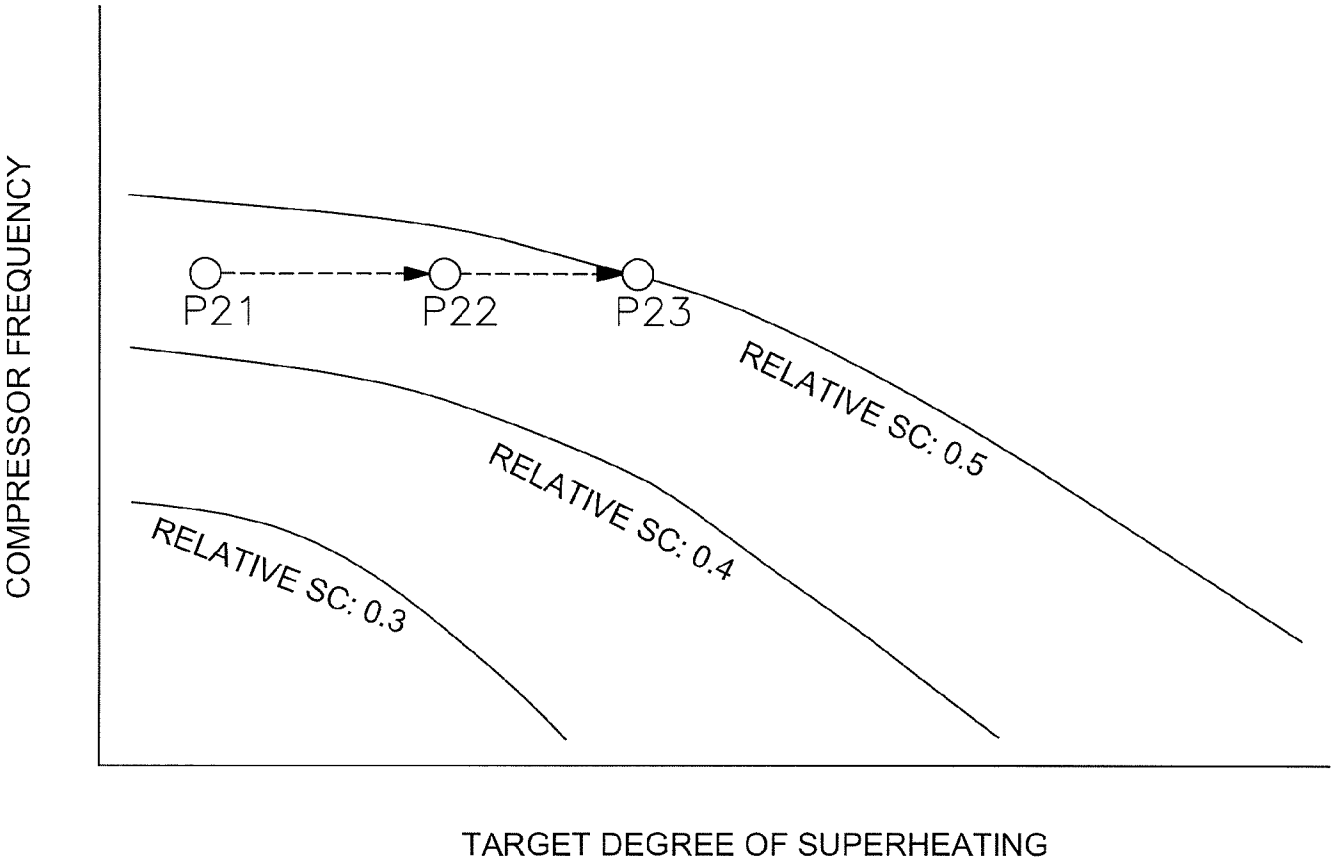
FIG. 15 is a model diagram when initial target values have been decided in step S26 and control of the relative degree of supercooling of step S29 has been performed.

On the other hand, when the controller 8 decides the initial target values from the map by step S26, the controller 8 can perform control of the relative degree of supercooling of step S29 from a state where the relative degree of supercooling value is close to 0.5 beforehand like at point P21 in FIG. 15, and the controller 8 can cause the degree of superheating of the refrigerant in the inlet of the accumulator 24 to reach point P23 at which the relative degree of supercooling value becomes 0.5 just by raising the degree of superheating in two stages. Consequently, by holding the map and going through the processing of step S26, the controller 8 can perform the cooling operation in a state where the relative degree of supercooling value is close to 0.5, and the controller 8 can shorten the amount of time it takes for step S29. Further, the controller 8 can also increase cases where the relative degree of supercooling degree exceeds 0.5 at the stage of step S29. In this manner, by going through the processing of step S26, the controller 8 achieves the effect that it can shorten the amount of time it takes for the initial setting operation.

—Step S30: Storage of Relative Degree of Supercooling—

In step S30, the controller 8 stores, as an initial relative degree of supercooling value, the relative degree of supercooling value that is equal to or greater than the predetermined value in step S28 or step S29, and then the controller 8 moves to the next step S31.

—Step S31: Storage of Parameters—

In step S31, the controller 8 stores the degree of superheating in the inlet of the inlet of the accumulator 24, the rotational frequency of the compressor 21, the fan speed of the indoor fan 42, the fan speed of the outdoor fan 28, the outdoor temperature Ta, and the indoor temperature Tb in the operation state at the time of the degree of supercooling value stored in step S30, and then the controller 8 ends the initial setting operation.

Figure 17:
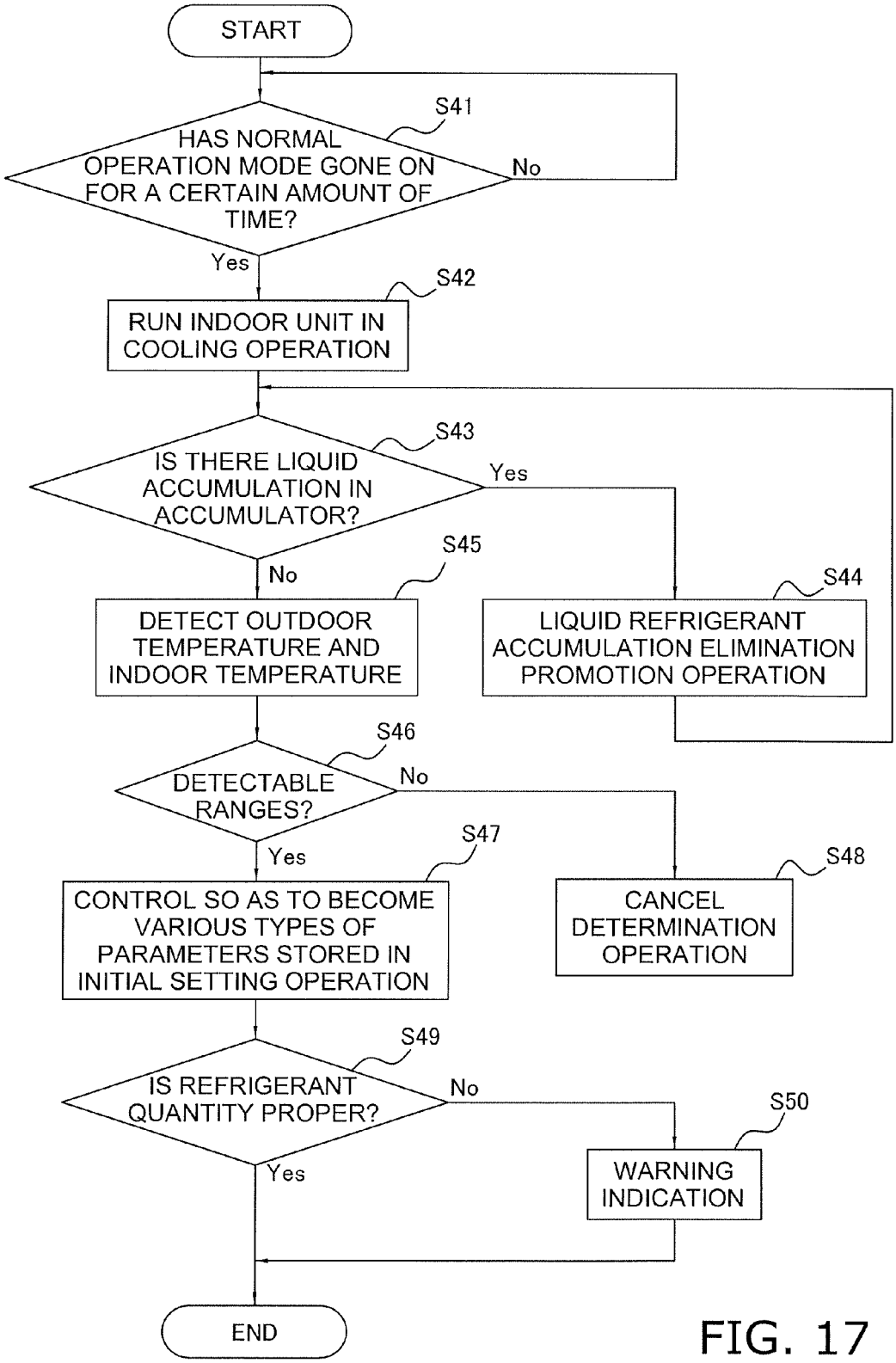
FIG. 17 is a flowchart of the determination operation.

Next, the determination operation that is one in the refrigerant leak detection operation will be described using FIG. 17. FIG. 17 is a flowchart at the time of the determination operation.

This determination operation is operation to which the controller 8 switches from the cooling operation or the heating operation in the normal operation mode periodically (e.g., once a year, when a load is not required in the air-conditioned space, etc.) after the initial setting operation has been performed and where the controller 8 detects whether or not the refrigerant inside the refrigerant circuit is not leaking to the outside due to some accidental cause.

—Step S41: Determination of Whether or not Normal Operation Mode has Gone on a Certain Amount of Time—

First, the controller 8 determines whether or not operation in the normal operation mode such as the cooling operation or the heating operation described above has gone on a certain amount of time, and when operation in the normal operation mode has gone on a certain amount of time, the controller 8 moves to the next step S42.

—Step S42: Running of Indoor Unit in Cooling Operation—

When operation in the normal operation mode has gone on a certain amount of time, like in step S21 of the initial setting operation described above, in the refrigerant circuit 310, the four-way switching valve 22 of the outdoor unit 302 is placed in the state indicated by the solid lines in FIG. 10, the compressor 21 and the outdoor fan 28 are started, and the cooling operation is forcibly performed in regard to all of the indoor units 304.

—Step S43: Determination of Liquid Accumulation Inside Accumulator—

In step S43, like in step S22 of the initial setting operation described above, during the cooling operation, the controller 8 determines whether or not liquid refrigerant is accumulating in the accumulator 24 on the basis of the inlet/outlet temperature difference. In step S43, when it is determined that liquid refrigerant is accumulating in the accumulator 24, the controller 8 moves to step S44, and when it is determined that liquid refrigerant is not accumulating in the accumulator 24, the controller 8 moves to step S45.

—Step S44: Liquid Accumulation Elimination Promotion Operation—

In step S44, like in step S23 of the initial setting operation described above, the controller 8 performs operation (liquid accumulation elimination promotion operation) where the controller 8 decreases as much as possible the opening degree of the outdoor expansion valve 38 and increases the rotational frequency of the compressor 21. After the liquid accumulation elimination promotion operation of step S44 has been implemented a predetermined amount of time, the controller 8 returns to step S43.

—Step S45: Reading of Temperatures—

In step S45, like in step S24 of the initial setting operation described above, reading of the indoor temperature and the outdoor temperature is performed. When the indoor temperature Tb and the outdoor temperature Ta are detected, the controller 8 moves to the next step S46.

—Step S46: Determination of Detectable Ranges or not—

In step S46, like in step S25 of the initial setting operation described above, the controller 8 determines whether or not the indoor temperature Tb and the outdoor temperature Ta that have been detected are within predetermined temperature ranges suited for the refrigerant leak detection operation mode that are set beforehand. In step S46, when the indoor temperature Tb and the outdoor temperature Ta were within the predetermined temperature ranges, the controller 8 moves to the next step S47, and when the indoor temperature Tb and the outdoor temperature Ta were not within the predetermined temperature ranges, the controller 8 moves to step S48.

—Step S47: Control to Conditions in Initial Setting Operation—

In step S47, the controller 8 controls the outdoor expansion valve 38, the compressor 21, the indoor fan 42 and the outdoor fan 28 to the degree of superheating of the refrigerant in the inlet of the accumulator 24, the rotational frequency of the compressor 21, the fan speed of the indoor fan 42 and the fan speed of the outdoor fan 28 stored in step S30 of the initial setting operation described above. Thus, the state of the refrigerant inside the refrigerant circuit 310 can be regarded as being in the same state as in the initial setting operation. That is, when the quantity of the refrigerant inside the refrigerant circuit 310 has not changed and the indoor temperature Tb and the outdoor temperature Ta were within the predetermined temperature ranges, the controller 8 recreates the conditions of the cooling operation performed in the initial setting operation as substantially the same conditions, and the controller 8 can make the degree of supercooling value and the like into substantially the same values. When step S47 ends, the controller 8 moves to step S49.

—Step S48: Cancellation of Determination Operation—

Step S48 is performed when, in contrast to step S47, the indoor temperature Tb and the outdoor temperature Ta were not within the predetermined temperature ranges in step S46, and the controller 8 displays on a display (not shown) disposed in the outdoor unit 302 or in a remote controller and the like an indication that the temperature conditions are outside the ranges of the refrigerant leak detection operation and cancels the determination operation.

—Step S49: Determination of Properness of Refrigerant Quantity—

In step S49, like in step S28 of the initial setting operation described above, the controller 8 derives the relative degree of supercooling. Then, the controller 8 determines whether or not the difference value (hereinafter called a relative degree of supercooling difference) between the initial relative degree of supercooling and the degree of supercooling is equal to or greater than a second predetermined value. In step S49, when it is determined that the relative degree of supercooling difference is less than the second predetermined value, the controller 8 ends the determination operation, and when it is determined that the relative degree of supercooling difference is equal to or greater than the second predetermined value, the controller 8 moves to step S50.

—Step S50: Warning Indication—

In step S50, the controller 8 determines that leakage of the refrigerant is occurring, performs a warning indication informing the user that it has detected a refrigerant leak, and thereafter ends the determination operation.

<Regarding Relative Degree of Supercooling Value>

The relative degree of supercooling value will be described on the basis of FIGS. 18 to 20.

Figure 18:
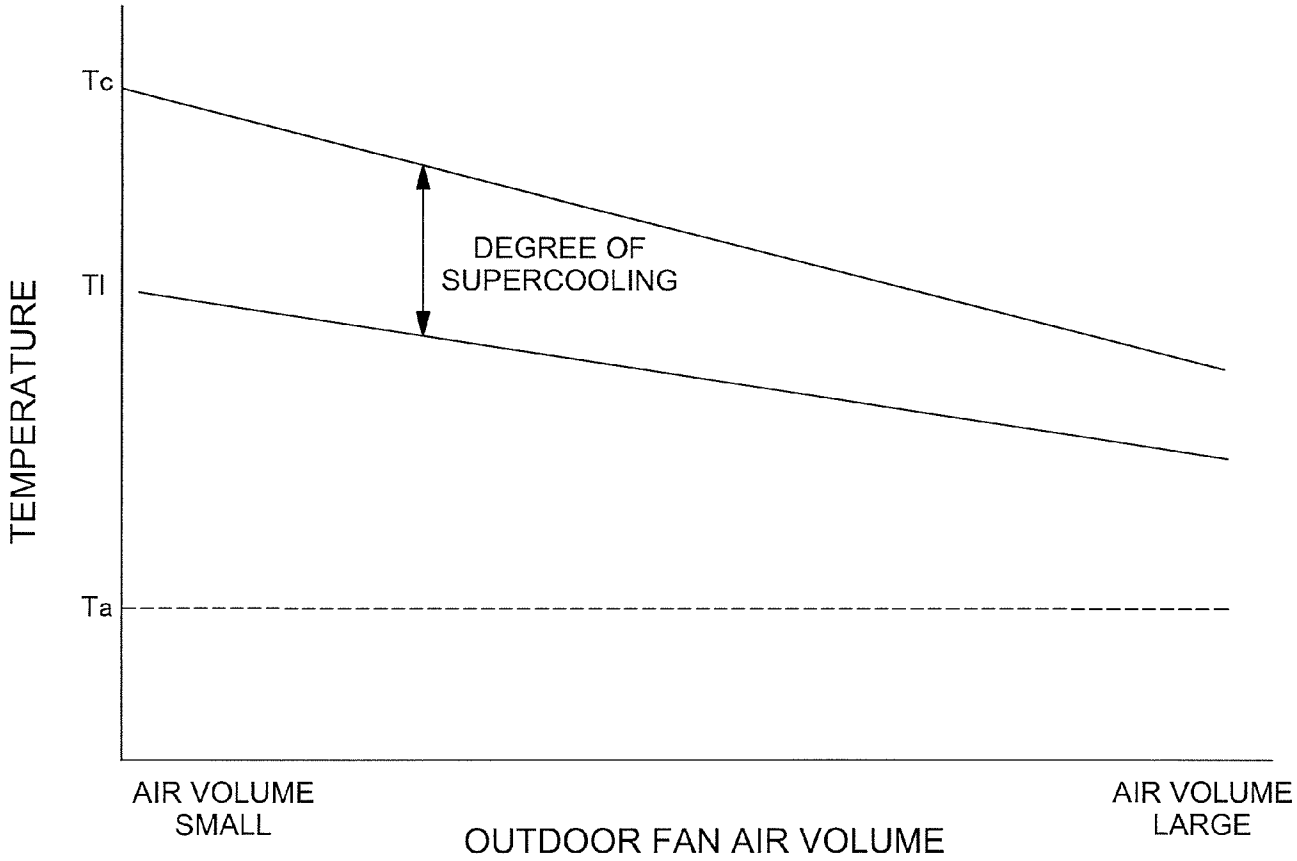
FIG. 18 is a graph showing a condensation temperature Tc and an outdoor heat exchanger outlet temperature T1 when an outdoor temperature Ta with respect to outdoor fan air volume is constant.

First, FIG. 18 is a graph showing the condensation temperature Tc and the outdoor heat exchanger outlet temperature T1 when the outdoor temperature Ta with respect to outdoor fan air volume is constant. Looking at FIG. 18, in a condition where the outdoor temperature Ta is constant, as the outdoor fan air volume increases, the condensation temperature Tc and the outdoor heat exchanger outlet temperature T1 decreases. Additionally, the drop in that decrease is larger in the condensation temperature Tc than in the outdoor heat exchanger outlet temperature T1. That is, it will be understood that when the outdoor fan air volume becomes larger, the degree of supercooling value that is the difference between the condensation temperature Tc and the outdoor heat exchanger outlet temperature T1 becomes smaller.

Figure 19:
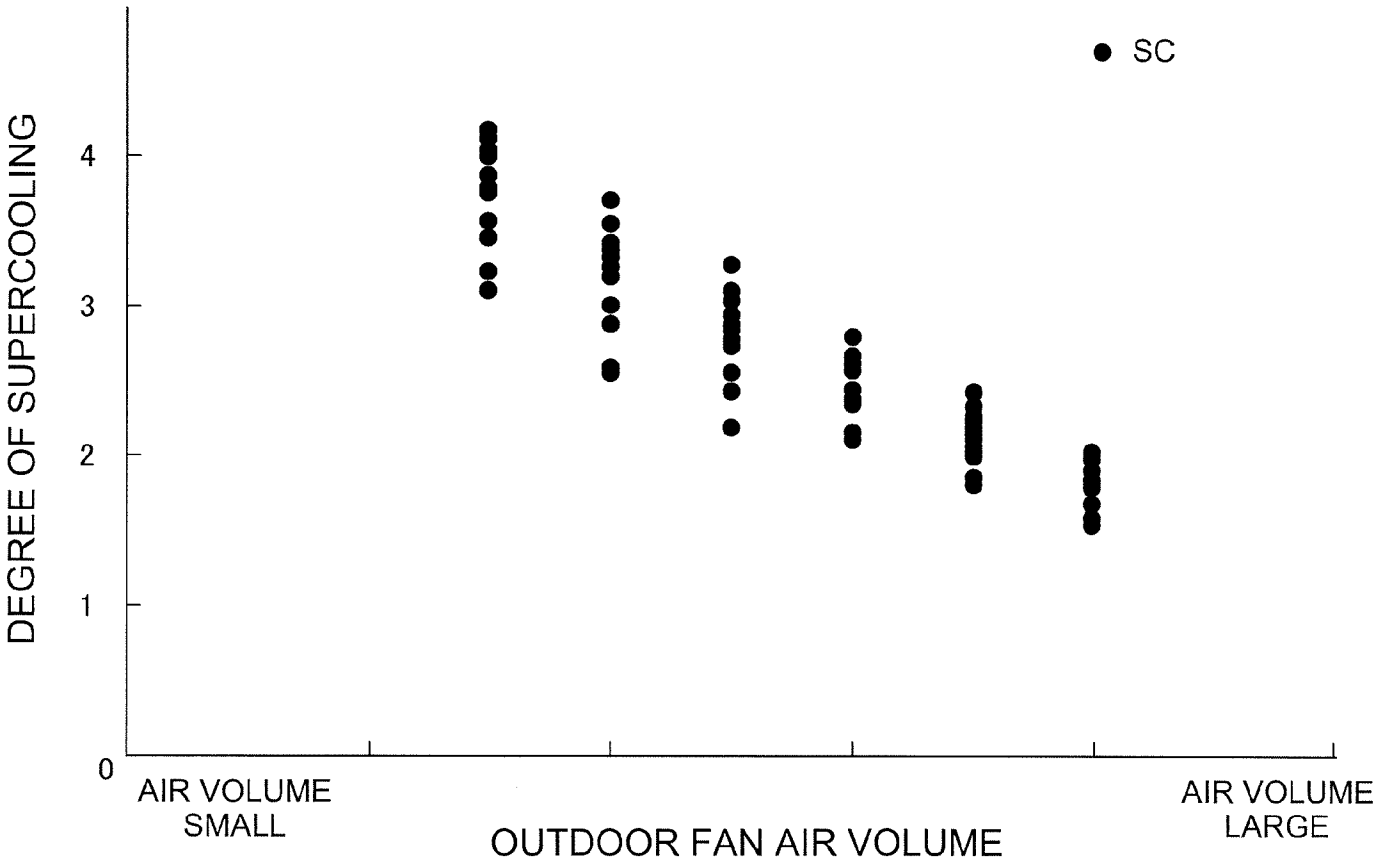
FIG. 19 is a graph showing a distribution of degree of supercooling values with respect to outdoor fan air volume.

Here, when looking at FIG. 19, which is a graph showing a distribution of degree of supercooling values with respect to outdoor fan air volume, it will be understood that when the outdoor fan air volume increases, the degree of supercooling value becomes smaller. Further, in FIG. 19, variations in the degree of supercooling value become larger when the outdoor fan air volume is small than when the outdoor fan air volume is large. This is because the air-side heat transfer coefficient in the outdoor heat exchanger becomes larger in proportion to the magnitude of the outdoor fan air volume and because it is easier when the outdoor fan air volume is small to be affected by disturbances such as dirt in the outdoor heat exchanger, the outdoor unit installation condition, and wind and rain and it is more difficult when the outdoor fan air volume is large to be affected by disturbances. For this reason, increasing the outdoor fan air volume to maximum and performing the refrigerant leak detection operation is effective in order to use the degree of supercooling, suppress variations in the degree of supercooling, and reduce detection error in the refrigerant quantity determination.

Figure 20:
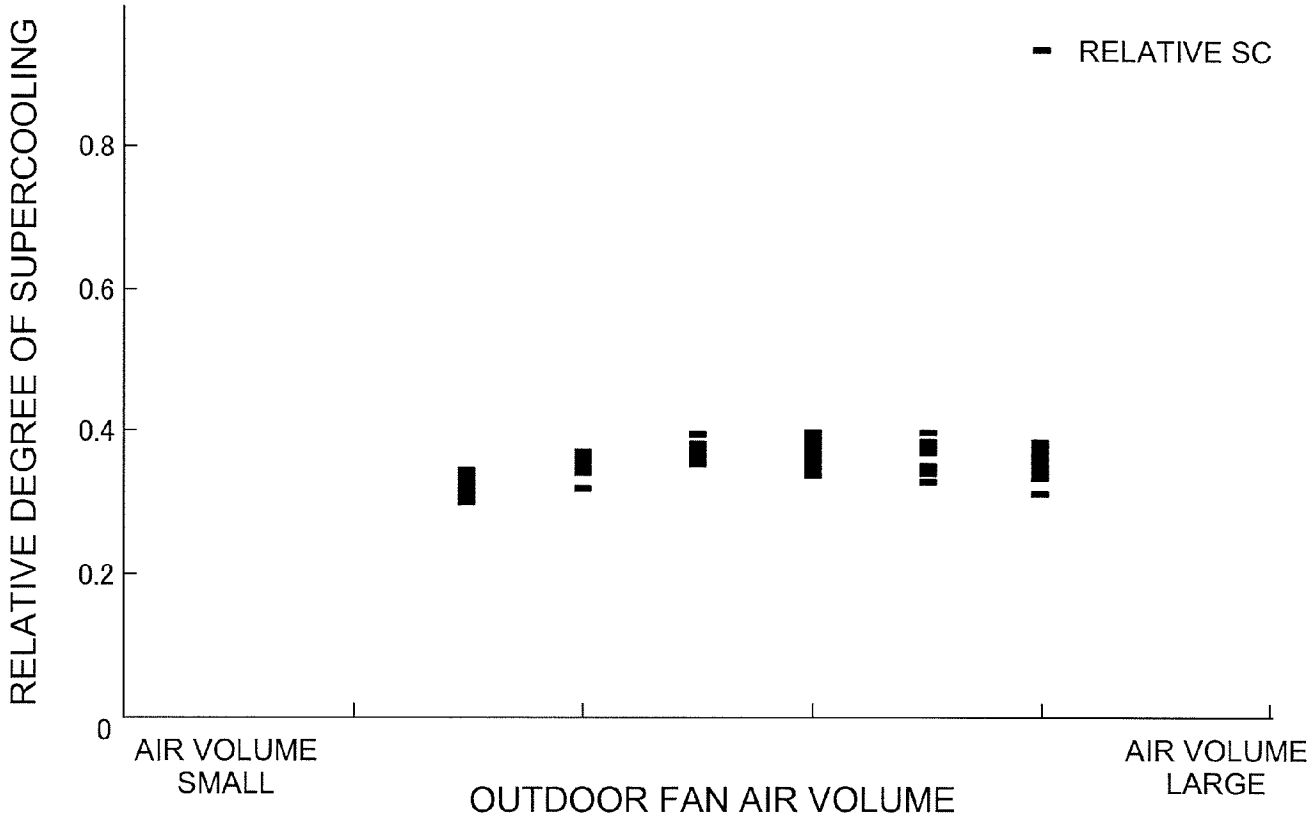
FIG. 20 is a graph showing a distribution of relative degree of supercooling values with respect to outdoor fan air volume.

Additionally, FIG. 20 is a graph showing a distribution of relative degree of supercooling values with respect to outdoor fan air volume. The relative degree of supercooling value is, as described above, a value obtained by dividing the degree of supercooling value by the difference between the condensation temperature and the outdoor temperature. Looking at FIG. 20, it will be understood that those values stay substantially between 0.3 to 0.4 regardless of the magnitude of the outdoor fan air volume and that there are few variations. For this reason, by utilizing this relative degree of supercooling value as an index instead of the degree of supercooling when determining the properness of the quantity of the refrigerant, the controller 8 can determine the properness of the quantity of the refrigerant without needing to increase the outdoor fan air volume to maximum and without being affected as much as possible by disturbances, and the controller 8 can suppress detection error. Consequently, utilizing the relative degree of supercooling value to determine the properness of the quantity of the refrigerant is useful.

(3) Characteristics of Air Conditioning Apparatus

The air conditioning apparatus 301 of the fourth embodiment has the following characteristics.

(3-1)

In the air conditioning apparatus 301 of the present embodiment, when performing the cooling operation in the refrigerant leak detection operation mode, the controller 8 determines in step S22 or step S43 whether or not liquid refrigerant is accumulating in the accumulator 24 on the basis of the temperature difference (the inlet/outlet temperature difference) between the pipe on the inlet side and the pipe on the outlet side of the accumulator 24. Additionally, when it has been determined that liquid refrigerant is accumulating in the accumulator 24, the controller 8 performs operation (the liquid accumulation elimination promotion operation) where the controller 8 decreases as much as possible the opening degree of the outdoor expansion valve 38 and increases the rotational frequency of the compressor 21.

In this manner, by decreasing the opening degree of the outdoor expansion valve 38, the controller 8 can lower low-pressure pressure and make it easier to cause the liquid refrigerant inside the accumulator 24 to evaporate. Further, by also increasing the rotational frequency of the compressor 21, the controller 8 can lower low-pressure pressure and make it easier to cause the liquid refrigerant inside the accumulator 24 to evaporate. Consequently, the controller 8 achieves the effect that it can quickly eliminate the liquid refrigerant accumulating inside the accumulator 24 by performing the liquid accumulation elimination promotion operation. For this reason, in the cooling operation in the refrigerant leak detection operation mode, the controller 8 can quickly create a state where the refrigerant in the inlet of the accumulator 24 is superheated and can shorten the amount of time it takes for the refrigerant leak detection operation mode.

(4) Modification 1

In the refrigerant leak detection operation mode, the air conditioning apparatus 301 of the fourth embodiment combines and performs, as one control of the liquid refrigerant accumulation elimination promotion operation, both control where it decreases the opening degree of the outdoor expansion valve 38 and control where it increases the rotational frequency of the compressor 21, but the air conditioning apparatus 301 is not limited to this, and it suffices for the air conditioning apparatus 301 to perform at least either one.

(5) Modification 2

In the refrigerant leak detection operation mode, the air conditioning apparatus 301 of the fourth embodiment increases the rotational frequency of the compressor 21 to increase the operation capacity thereof as one control of the liquid refrigerant accumulation elimination promotion operation, but the air conditioning apparatus 301 is not limited to this. For example, in the case of an air conditioning apparatus where an unload function is built into the compressor and the air conditioning apparatus is performing the refrigerant leak detection operation mode in a state where the compressor is caused to perform the unload function, the air conditioning apparatus may also drive the compressor in a full load state to increase the operation capacity thereof.

Other Embodiments

Embodiments of the present invention and modifications thereof have been described above on the basis of the drawings, but the specific configurations thereof are not limited to these embodiments and the modifications thereof and are alterable in a scope that does not depart from the gist of the invention.

For example, the present invention is also applicable to air conditioning apparatus dedicated to cooling operation rather than the air conditioning apparatus 1 and 101 that are capable of switching between cooling operation and heating operation and the air conditioning apparatus 201 that is capable of performing cooling operation and heating operation simultaneously.

INDUSTRIAL APPLICABILITY

The air conditioning apparatus and the refrigerant quantity determination method pertaining to the present invention achieve the effects that they can prevent pipes from being damaged and can perform determination of the properness of the quantity of refrigerant accurately and are useful as an air conditioning apparatus and a refrigerant quantity determination operation that perform determination of the properness of the quantity of refrigerant accurately while preventing pipes from being damaged in an air conditioning apparatus and a refrigerant quantity determination operation that determine the properness of the quantity of refrigerant inside a refrigerant circuit.

What is claimed is:

1. An air conditioning apparatus further comprising:

a refrigerant circuit that includes a heat source unit having a compressor, a heat source-side heat exchanger, and an accumulator, a utilization unit having a utilization-side heat exchanger, an expansion mechanism, and a liquid refrigerant connection pipe and a gas refrigerant connection pipe that interconnect the heat source unit and the utilization unit, with the refrigerant circuit being capable of performing at least cooling operation where the heat source-side heat exchanger functions as a condenser of refrigerant compressed in the compressor and where the utilization-side heat exchanger functions as an evaporator of refrigerant condensed in the heat source-side heat exchanger;

an operation controlling device configured to perform normal operation control where the operation controlling device performs control of each device of the heat source unit and the utilization unit in accordance with operating load of the utilization unit, and refrigerant quantity determination operation control where the operation controlling device determines properness of quantity of the refrigerant in the refrigerant circuit while performing the cooling operation;

a liquid refrigerant accumulation determining device configured to determine whether or not liquid refrigerant is accumulating in the accumulator;

a shut-off mechanism disposed on a downstream side of the heat source-side heat exchanger and on an upstream side of the liquid refrigerant connection pipe relative to a flow direction of refrigerant in the cooling operation, the shut-off mechanism being capable of shutting off passage of the refrigerant;

a refrigerant detection mechanism disposed on an upstream side of the shut-off mechanism relative to the flow direction of refrigerant in the cooling operation, the refrigerant detection mechanism being configured to perform detection of a state quantity relating to quantity of refrigerant existing on the upstream side of the shut-off mechanism; and a refrigerant quantity determining device configured to determine properness of quantity of refrigerant inside the refrigerant circuit on the basis of the state quantity relating to the quantity of refrigerant that the refrigerant detection mechanism has detected in liquid refrigerant storage control, the expansion mechanism being disposed in the utilization unit and being positioned on a near side of the utilization-side heat exchanger relative to the flow direction of refrigerant in the cooling operation, the operation controlling device being further configured to perform liquid refrigerant accumulation elimination control to eliminate liquid refrigerant accumulation in the accumulator when the liquid refrigerant accumulation determining device has determined that liquid refrigerant is accumulating in the accumulator, and the operation controlling device being further configured to perform liquid temperature constant control where the operation controlling device controls such that the temperature of refrigerant in a liquid refrigerant pipe portion of the refrigerant circuit between the expansion mechanism and the shut-off mechanism including the liquid refrigerant connection pipe becomes a constant value, thereafter perform liquid pipe closure control where the operation controlling device closes the shut-off mechanism and the expansion mechanism, and thereafter perform, as the refrigerant quantity determination operation control, the liquid refrigerant storage control where the operation controlling device accumulates liquid refrigerant in a portion on the upstream side of the shut-off mechanism.

2. The air conditioning apparatus according to claim 1, wherein during the liquid temperature constant control, the liquid refrigerant accumulation determining device determines whether or not liquid refrigerant is accumulating in the accumulator on the basis of an inlet temperature that an inlet temperature sensor disposed in a refrigerant pipe portion on an inlet side of the accumulator detects and an outlet temperature that an outlet temperature sensor disposed in a refrigerant pipe portion on an outlet side of the accumulator detects.

3. The air conditioning apparatus according to claim 2, wherein the liquid refrigerant accumulation determining device determines that liquid refrigerant is accumulating in the accumulator when a temperature difference between the inlet temperature and the outlet temperature is equal to or greater than a predetermined temperature difference.

4. The air conditioning apparatus according to claim 1, wherein during the liquid refrigerant storage control, the liquid refrigerant accumulation determining device determines whether or not liquid refrigerant is accumulating in the accumulator on the basis of a bottom portion temperature that a bottom portion temperature sensor disposed in a bottom portion of the accumulator detects.

5. The air conditioning apparatus according to claim 4, wherein the liquid refrigerant accumulation determining device determines that liquid refrigerant is accumulating in the accumulator when the bottom portion temperature is equal to or less than a predetermined temperature.

6. The air conditioning apparatus according to claim 1, further comprising a bypass pipe interconnecting a bottom portion of the accumulator and a pipe on a suction side of the compressor; and a bypass opening-and-closing mechanism capable of opening and closing a flow path of refrigerant inside the bypass pipe.

7. The air conditioning apparatus according to claim 6, wherein when the liquid refrigerant accumulation determining device has determined that liquid refrigerant is accumulating in the accumulator, the operation controlling device opens the bypass opening-and-closing mechanism to perform the liquid refrigerant accumulation elimination control.

8. The air conditioning apparatus according to claim 6, wherein during the liquid temperature constant control, when the liquid refrigerant accumulation determining device has determined that liquid refrigerant is accumulating in the accumulator, the operation controlling device performs, as the liquid refrigerant accumulation elimination control, first cancellation control where the operation controlling device decreases an opening degree of the expansion mechanism and cancels the liquid temperature constant control, liquid refrigerant release control where the operation controlling device opens the bypass opening-and-closing mechanism and releases liquid refrigerant from the accumulator after the first cancellation control, and first re-liquid temperature constant control where the operation controlling device increases the opening degree of the expansion mechanism and again performs the liquid temperature constant control after the liquid refrigerant release control.

9. The air conditioning apparatus according to claim 6, further comprising a supercooler including a supercooling expansion mechanism that depressurizes some liquid refrigerant that has been condensed by the heat source-side heat exchanger at the time of the cooling operation and a supercooling pipe having the supercooling expansion mechanism disposed therein, the supercooling pipe being configured to cause some liquid refrigerant to branch from a liquid refrigerant pipe portion including the liquid refrigerant connection pipe between the expansion mechanism and the shut-off mechanism and which is connected to a gas refrigerant pipe portion between the gas refrigerant connection pipe and the accumulator, during the liquid temperature constant control, when the liquid refrigerant accumulation determining device has determined that liquid refrigerant is accumulating in the accumulator, the operation controlling device performs, as the liquid refrigerant accumulation elimination control, second cancellation control where the operation controlling device decreases an opening degree of the supercooling expansion mechanism and cancels the liquid temperature constant control, liquid refrigerant release control where the operation controlling device opens the bypass opening-and-closing mechanism and releases liquid refrigerant from the accumulator after the second cancellation control, and second re-liquid temperature constant control where the operation controlling device increases the opening degree of the supercooling expansion mechanism and again performs the liquid temperature constant control after the liquid refrigerant release control.

10. The air conditioning apparatus according to claim 1, wherein during the liquid temperature constant control, when the liquid refrigerant accumulation determining device has determined that liquid refrigerant is accumulating in the accumulator, the operation controlling device performs, as the liquid refrigerant accumulation elimination control, first cancellation control where the operation controlling device decreases an opening degree of the expansion mechanism and cancels the liquid temperature constant control, elimination standby control where the operation controlling device waits for liquid refrigerant accumulation to be eliminated in the accumulator after the first cancellation control, and first re-liquid temperature constant control where the operation controlling device increases the opening degree of the expansion mechanism and again performs the liquid temperature constant control after the elimination standby control.

11. The air conditioning apparatus according to claim 1, further comprising a supercooler including a supercooling expansion mechanism that depressurizes some of liquid refrigerant that has been condensed by the heat source-side heat exchanger at the time of the cooling operation and a supercooling pipe having the supercooling expansion mechanism disposed therein, the supercooling pipe being configured to cause some liquid refrigerant to branch from a liquid refrigerant pipe portion including the liquid refrigerant connection pipe between the expansion mechanism and the shut-off mechanism and which is connected to a gas refrigerant pipe portion between the gas refrigerant connection pipe and the accumulator, during the liquid temperature constant control, when the liquid refrigerant accumulation determining device has determined that liquid refrigerant is accumulating in the accumulator, the operation controlling device performs, as the liquid refrigerant accumulation elimination control, second cancellation control where the operation controlling device decreases an opening degree of the supercooling expansion mechanism and cancels the liquid temperature constant control, elimination standby control where the operation controlling device waits for liquid refrigerant accumulation to be eliminated in the accumulator after the second cancellation control, and second re-liquid temperature constant control where the operation controlling device increases the opening degree of the supercooling expansion mechanism and again performs the liquid temperature constant control after the elimination standby control.

12. The air conditioning apparatus according to claim 1, wherein during the liquid refrigerant storage control, when the liquid refrigerant accumulation determining device has determined that liquid refrigerant is accumulating in the accumulator, the operation controlling device causes determination of properness of quantity of refrigerant to stand by and not be performed until liquid refrigerant accumulation in the accumulator is eliminated and determination of properness of quantity of refrigerant after liquid refrigerant accumulation in the accumulator has been eliminated to be performed.

13. An air conditioning apparatus comprising a refrigerant circuit that includes a heat source unit having a compressor, a heat source-side heat exchanger, and an accumulator, a utilization unit having a utilization-side heat exchanger, an expansion mechanism, and a liquid refrigerant connection pipe and a gas refrigerant connection pipe that interconnect the heat source unit and the utilization unit, with the refrigerant circuit being capable of performing at least cooling operation where the heat source-side heat exchanger functions as a condenser of refrigerant compressed in the compressor and where the utilization-side heat exchanger functions as an evaporator of refrigerant condensed in the heat source-side heat exchanger;

an operation controlling device configured to perform normal operation control where the operation controlling device performs control of each device of the heat source unit and the utilization unit in accordance with operating load of the utilization unit, and refrigerant quantity determination operation control where the operation controlling device determines properness of quantity of the refrigerant in the refrigerant circuit while performing the cooling operation;

a liquid refrigerant accumulation determining device configured to determine whether or not liquid refrigerant is accumulating in the accumulator; and a detecting device configured to detect a supercooling degree of refrigerant in an outlet of the heat source-side heat exchanger or an operation state quantity that fluctuates in accordance with fluctuations in a degree of supercooling as a first detection value, the operation controlling device being further configured to perform liquid refrigerant accumulation elimination control to eliminate liquid refrigerant accumulation in the accumulator when the liquid refrigerant accumulation determining device has determined that liquid refrigerant is accumulating in the accumulator, in the refrigerant quantity determination operation control, the operation controlling device performing, as refrigerant quantity properness determination, determination of properness of quantity of refrigerant with which inside of the refrigerant circuit is charged on the basis of the first detection value while controlling the expansion mechanism such that the degree of supercooling of refrigerant in at least one place between an outlet of the utilization-side heat exchanger and an inlet of the compressor becomes a positive value.

14. The air conditioning apparatus according to claim 13, wherein during the refrigerant quantity determination operation control, the liquid refrigerant accumulation determining device determines whether or not liquid refrigerant is accumulating in the accumulator on the basis of an inlet temperature that an inlet temperature sensor disposed in a refrigerant pipe portion on an inlet side of the accumulator detects and an outlet temperature that an outlet temperature sensor disposed in a refrigerant pipe portion on an outlet side of the accumulator detects.

15. The air conditioning apparatus according to claim 14, wherein the liquid refrigerant accumulation determining device determines that liquid refrigerant is accumulating in the accumulator when a temperature difference between the inlet temperature and the outlet temperature is equal to or greater than a predetermined temperature difference.

16. The air conditioning apparatus according to claim 13, wherein during the refrigerant quantity determination operation control, when the liquid refrigerant accumulation determining device has determined that liquid refrigerant is accumulating in the accumulator, the operation controlling device performs, as the liquid refrigerant accumulation elimination control, low-pressure pressure lowering control where the operation controlling device decreases an opening degree of the expansion mechanism and lowers low-pressure pressure.

17. The air conditioning apparatus according to claim 13, wherein during the refrigerant quantity determination operation control, when the liquid refrigerant accumulation determining device has determined that liquid refrigerant is accumulating in the accumulator, the operation controlling device performs, as the liquid refrigerant accumulation elimination control, operation capacity increase control where the operation controlling device increases operation capacity of the compressor.

* * * * *